US012302986B2

(12) United States Patent
Cavaliere et al.

(10) Patent No.: US 12,302,986 B2
(45) Date of Patent: May 20, 2025

(54) SOLE STRUCTURES AND ARTICLES OF FOOTWEAR HAVING CONFORMABLE HEEL COUNTER STRUCTURES

(71) Applicant: NIKE, Inc., Beaverton, OR (US)

(72) Inventors: Sergio Cavaliere, Venice (IT); John Cross, Portland, OR (US); Neil Crumbleholme, Lake Oswego, OR (US); Roberto De Marchi, Treviso (IT); Ryan R. Larson, Portland, OR (US); Tetsuya T. Minami, Portland, OR (US); Courtney M. Wright, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 105 days.

(21) Appl. No.: 18/125,391

(22) Filed: Mar. 23, 2023

(65) Prior Publication Data

US 2023/0404211 A1 Dec. 21, 2023

Related U.S. Application Data

(60) Provisional application No. 63/353,448, filed on Jun. 17, 2022.

(51) Int. Cl.
*A43B 13/37* (2006.01)
*A43B 5/00* (2022.01)
(Continued)

(52) U.S. Cl.
CPC ..... *A43B 13/37* (2013.01); *A43B 5/00* (2013.01); *A43B 13/125* (2013.01); *A43B 17/18* (2013.01)

(58) Field of Classification Search
CPC ..... A43B 13/37; A43B 13/125; A43B 13/41; A43B 17/18; A43B 17/16; A43B 17/08;
(Continued)

(56) References Cited

U.S. PATENT DOCUMENTS 2,095,613 A 10/1937 Ornsteen
D192,208 S 2/1962 Bradley
(Continued)

FOREIGN PATENT DOCUMENTS

EP 3459378 B1 3/2021
WO 8808678 A1 11/1988
(Continued)

OTHER PUBLICATIONS

"Heel Clutching System", Asics, asics.com, Jun. 27, 2021, https://web.archive.org/web/20170627013653/https://corp.asics.com/en/about_asics/institute_of_sport_science/technology/heel-clutching-system.

(Continued)

*Primary Examiner* — Patrick J. Lynch
*Assistant Examiner* — Brianna T. Duckworth
(74) *Attorney, Agent, or Firm* — Banner & Witcoff, Ltd.

(57) ABSTRACT

Articles of footwear in accordance with some aspects of this technology include a foot support component and/or heel counter structure that includes openings, voids, and/or grooves around the heel area. These openings, voids, or grooves may make the heel counter structure more conformable, lightweight, and/or flexible. The openings, voids, or grooves may allow the heel or heel counter structure to conform better to the heel/foot of a user, providing and an "adaptive" response, adapting differently to different heels. The openings, voids, or grooves may be customized within the heel counter component based on the shape of the foot and/or heel of the user. Additionally or alternatively, these openings, voids, or grooves may make the heel construction better to conform to the wearer's heel and better to contain and move with the wearer's heel, e.g., during use and to improve flexion, comfort, and fit.

11 Claims, 29 Drawing Sheets

Figure 1:
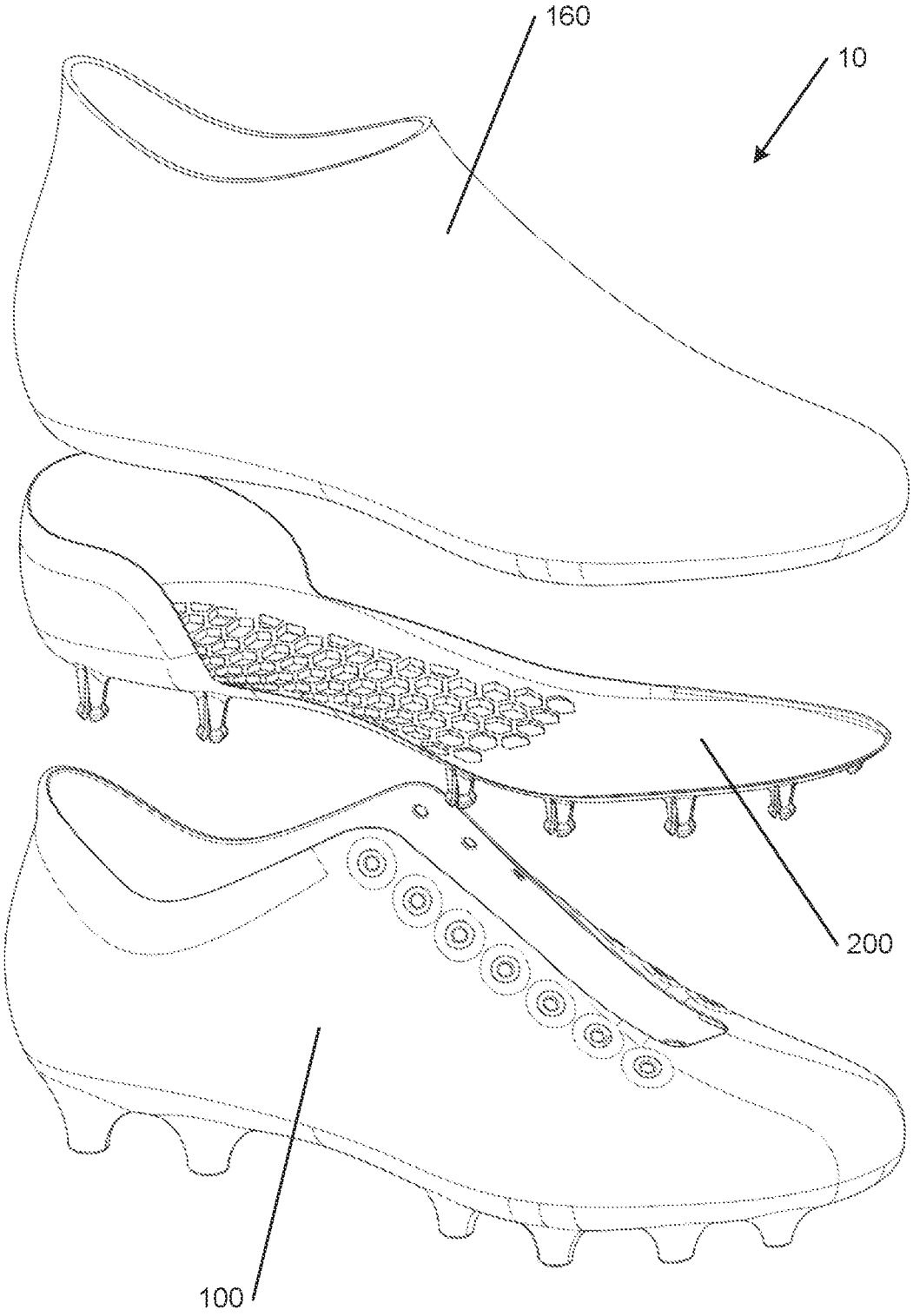

(51) Int. Cl.
*A43B 13/12* (2006.01)
*A43B 17/18* (2006.01)

(58) Field of Classification Search
CPC .. A43B 5/00; A43B 5/02; A43B 5/185; A43B 3/34; A43B 3/344; A43B 7/1405; A43C 15/161
See application file for complete search history.

(56) References Cited

U.S. PATENT DOCUMENTS

| | | | | |
|---|---|---|---|---|
| D192,784 | S | 5/1962 | Bradley | |
| 3,046,582 | A | 7/1962 | Blustein | |
| 3,538,628 | A * | 11/1970 | Einstein, Jr. | A43B 3/0078 36/15 |
| 6,000,148 | A | 12/1999 | Cretinon | |
| 6,173,511 | B1 | 1/2001 | Perrault | |
| 6,279,251 | B1 | 8/2001 | Davis | |
| 6,662,474 | B2 | 12/2003 | Tomat | |
| 7,730,636 | B2 | 6/2010 | Auger | |
| 8,020,317 | B1 | 9/2011 | Sokolowski | |
| 8,205,357 | B2 * | 6/2012 | Keating | A43B 13/125 36/141 |
| 8,677,656 | B2 | 3/2014 | Nishiwaki et al. | |
| 9,655,406 | B2 | 5/2017 | Cavaliere | |
| 10,568,385 | B2 | 2/2020 | Beers et al. | |
| 10,973,279 | B2 | 4/2021 | Cheney et al. | |
| 11,122,861 | B2 | 9/2021 | Tresser | |
| 11,191,320 | B2 | 12/2021 | Happen | |
| 11,191,321 | B2 | 12/2021 | Kilgore et al. | |
| 2003/0079373 | A1 * | 5/2003 | Geer | A43B 3/26 36/30 R |
| 2005/0188562 | A1 * | 9/2005 | Clarke | A43B 3/244 36/3 R |
| 2006/0236564 | A1 * | 10/2006 | Allard | A61F 5/14 36/140 |
| 2006/0248752 | A1 | 11/2006 | Kittner | |
| 2014/0305005 | A1 | 10/2014 | Yeh | |
| 2018/0332926 | A1 * | 11/2018 | Kramer | A43B 21/32 |
| 2019/0159548 | A1 * | 5/2019 | Strelli | A43B 17/14 |
| 2020/0068991 | A1 * | 3/2020 | Steere, Jr. | A43B 3/24 |
| 2020/0253333 | A1 | 8/2020 | Kilgore et al. | |
| 2021/0015204 | A1 * | 1/2021 | Buck | A43B 7/143 |
| 2021/0259364 | A1 | 8/2021 | Takashima | |
| 2023/0276893 | A1 * | 9/2023 | Mittal | A43B 3/26 36/97 |

FOREIGN PATENT DOCUMENTS

| | | | |
|---|---|---|---|
| WO | 2004103105 | A1 | 12/2004 |
| WO | 2008005912 | A2 | 1/2008 |
| WO | 2018155804 | A1 | 8/2018 |
| WO | 2020152821 | A1 | 7/2020 |

OTHER PUBLICATIONS

Jun. 30, 2023 (WO) International Search Report and Written Opinion—App PCT/US2023/064851, 16 pages.

* cited by examiner

SOLE STRUCTURES AND ARTICLES OF FOOTWEAR HAVING CONFORMABLE HEEL COUNTER STRUCTURES

CROSS-REFERENCE TO RELATED APPLICATIONS

This application is claims priority to U.S. Provisional Patent Application No. 63/353,448, filed Jun. 17, 2022, entitled Sole Structures and Articles of Footwear Having Conformable Heel Counter Structures, which is incorporated herein by reference in its entirety and made a part hereof.

FIELD OF THE INVENTION

The present invention relates to the field of footwear. More specifically, aspects of the present invention pertain to heel counter structures, footwear support structures, and articles of footwear that include such structures. Additional aspects of this invention relate to methods of making footwear sole structures and/or articles of footwear including these heel counter structures.

1.0 BACKGROUND

Articles of footwear, and specifically athletic footwear, may include a heel counter component that provides stability to the foot and also longevity to the article of footwear. Without reinforced heel counters the shoe loses it shape and provides limited support to the foot. The heel counter component may be positioned at the back of the article of footwear where the heel bone sits.

2.0 SUMMARY

The present invention generally provides articles of footwear in accordance with some aspects of this technology that include a foot support component and/or heel counter structure that includes openings, voids, and/or grooves around the heel area. These openings, voids, or grooves may make the heel counter structure more conformable, lightweight, and/or flexible. The openings, voids, or grooves may allow the heel or heel counter structure to conform better to the heel/foot of a user, providing and an "adaptive" response, adapting differently to different heels. The openings, voids, or grooves may be customized within the heel counter component based on the shape of the foot and/or heel of the user. These openings, voids or grooves may make it easier to fit the foot support component into the article of footwear. Additionally or alternatively, these openings, voids, or grooves may make the heel construction better to conform to the wearer's heel and better to contain and move with the wearer's heel, e.g., during use and to improve flexion, comfort, and fit.

According to one embodiment, a footwear structure may comprise: an outer cage component; an inner upper component that defines a foot-receiving chamber; and a foot support component releasably engaged with the outer cage component and the inner upper component to form the footwear structure, with the inner upper component fitting inside the outer cage component. The outer cage component may include: (i) an outsole portion, and (ii) an upper portion. The outer cage component may define an interior chamber. The inner upper component may include a bottom surface, a heel-containing region, a midfoot-containing region, and a forefoot-containing region. The foot support component may comprise: a top surface for supporting an entire plantar surface of a wearer's foot; a bottom surface opposite the top surface; and an integrally formed heel counter structure extending from the top surface at a heel region of the foot support component. The heel counter structure may include a sidewall defined by a lateral sidewall, a medial sidewall, and a rear sidewall formed between the lateral sidewall and the medial sidewall. The heel counter structure may further include a void structure formed in the sidewall. The void structure may be defined by one or more of openings, voids, or grooves. The void structure may include a central hub with a plurality of spokes that radiate from the central hub. The one or more of the plurality of spokes may include a circular hole opposite the central hub. The plurality of spokes may be spaced equidistant when radiating from the central hub. Additionally or alternatively, the void structure may include a circular opening and a slit extending upward from the opening towards an upper portion of the sidewall, wherein the opening and the slit are located on the rear sidewall. Additionally or alternatively, the void structure may include a groove that extends from a portion of the medial sidewall through the rear sidewall to a portion of the lateral sidewall, wherein the groove extends in a vertical continuous V-shape from a bottom portion of the heel counter structure to an upper portion of the heel counter structure. The foot support component may be formed as a unitary, one-piece construction.

According to another embodiment, a foot support component may be configured to releasably engage with an outer cage component and an inner upper component to form an article of footwear, the outer cage component including an outsole portion and an upper portion, with the inner upper component fitting inside the outer cage component. The foot support component may comprise: a top surface for supporting an entire plantar surface of a wearer's foot; a bottom surface opposite the top surface; and an integrally formed heel counter structure extending from the top surface at a heel region of the foot support component. The heel counter structure may include a sidewall having a lateral sidewall, a medial sidewall, and a rear sidewall extending between the lateral sidewall and the medial sidewall. The heel counter structure may further include a void structure formed in the sidewall. The void structure may be defined by one or more of openings, voids, or grooves. The void structure may include a central hub with a plurality of spokes that radiate from the central hub. The one or more of the plurality of spokes may include a circular hole opposite the central hub. The plurality of spokes may be spaced equidistant when radiating from the central hub. Additionally or alternatively, the void structure may include a circular opening and a slit extending upward from the opening towards an upper portion of the sidewall, wherein the opening and the slit are located on the rear sidewall. Additionally or alternatively, the void structure may include a groove that extends from a portion of the medial sidewall through the rear sidewall to a portion of the lateral sidewall, wherein the groove extends in a vertical continuous V-shape from a bottom portion of the heel counter structure to an upper portion of the heel counter structure. The foot support component may be formed as a unitary, one-piece construction.

According to another embodiment, a footwear structure may comprising: an outer cage component; an inner upper component that defines a foot-receiving chamber; and a foot support component releasably engaged with the outer cage component and the inner upper component to form the footwear structure, with the inner upper component fitting inside the outer cage component. The outer cage component may include: (i) an outsole portion including a plurality of cleat shells, and (ii) an upper portion. The outer cage component may define an interior chamber. The inner upper component may include a bottom surface, a heel-containing region, a midfoot-containing region, and a forefoot-containing region. The foot support component may comprise: a top surface for supporting an entire plantar surface of a wearer's foot; a bottom surface opposite the top surface; and an integrally formed heel counter structure extending from the top surface at a heel region of the foot support component. The bottom surface may include a plurality of cleat inserts. One or more of the plurality of cleat inserts may be configured to extend into a corresponding one of a plurality of recesses defined in the outsole portion of the outer cage component. The heel counter structure may include a sidewall defined by a lateral sidewall, a medial sidewall, and a rear sidewall formed between the lateral sidewall and the medial sidewall. The heel counter structure may further include a void structure formed in the sidewall, the void structure defined by one or more of openings, voids, or grooves. The void structure may include a central hub with a plurality of spokes that radiate from the central hub. The one or more of the plurality of spokes may include a circular hole opposite the central hub. The plurality of spokes may be spaced equidistant when radiating from the central hub. Additionally or alternatively, the void structure may include a circular opening and a slit extending upward from the opening towards an upper portion of the sidewall, wherein the opening and the slit are located on the rear sidewall. Additionally or alternatively, the void structure may include a groove that extends from a portion of the medial sidewall through the rear sidewall to a portion of the lateral sidewall, wherein the groove extends in a vertical continuous V-shape from a bottom portion of the heel counter structure to an upper portion of the heel counter structure. The foot support component may be formed as a unitary, one-piece construction.

Other features and advantages of the invention will be apparent from the following specification taken in conjunction with the following drawings.

3.0 BRIEF DESCRIPTION OF THE DRAWINGS

The following Detailed Description will be better understood when considered in conjunction with the accompanying drawings in which like reference numerals refer to the same or similar elements in all of the various views in which that reference number appears.

FIG. 1 provides a component view of an article of footwear in accordance with some examples of this technology.

FIGS. 2A-2E provide various views an outer cage component of an article of footwear in accordance with some examples of this technology.

Figure 2A:
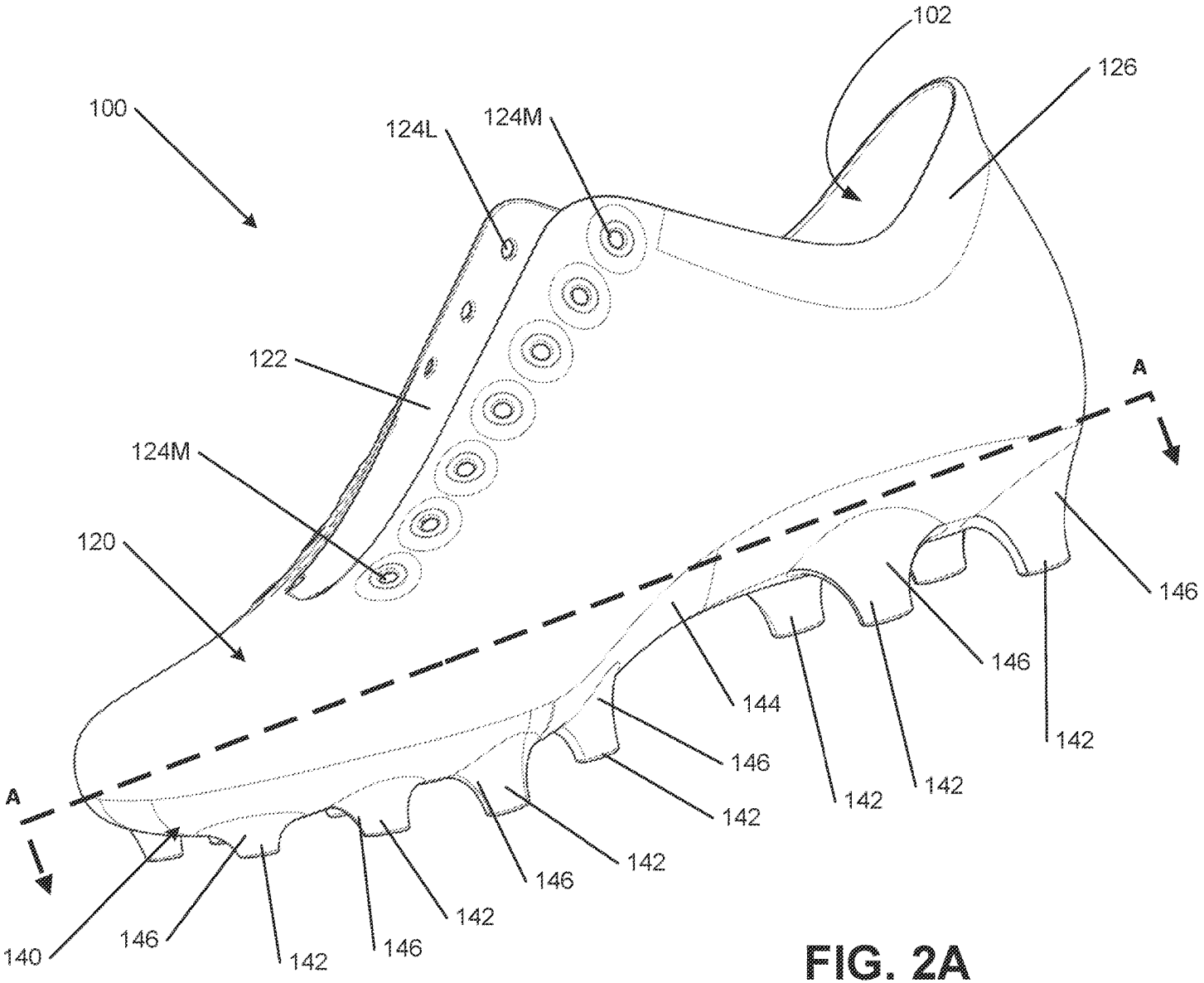
Figure 2B:
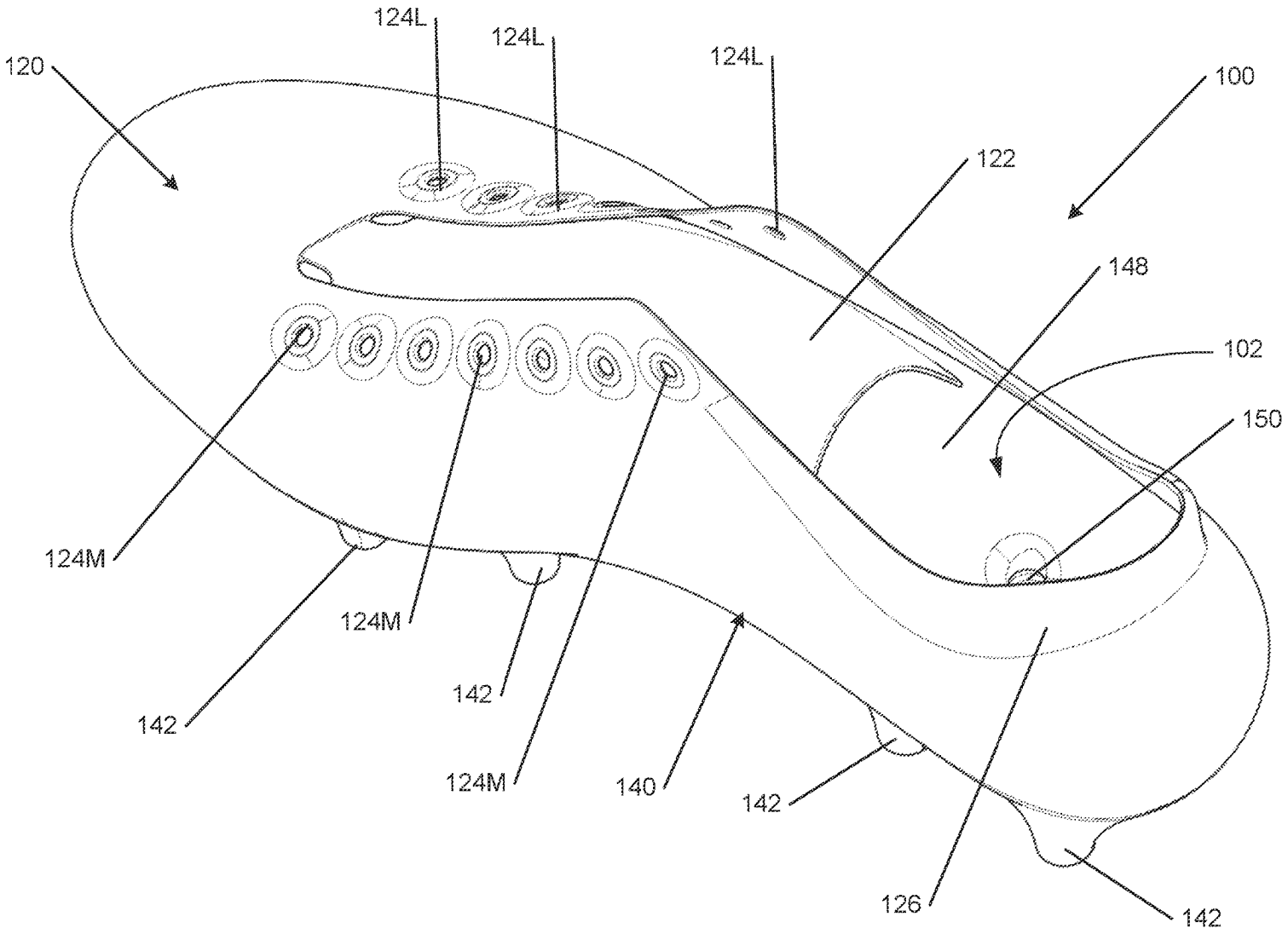
Figure 2C:
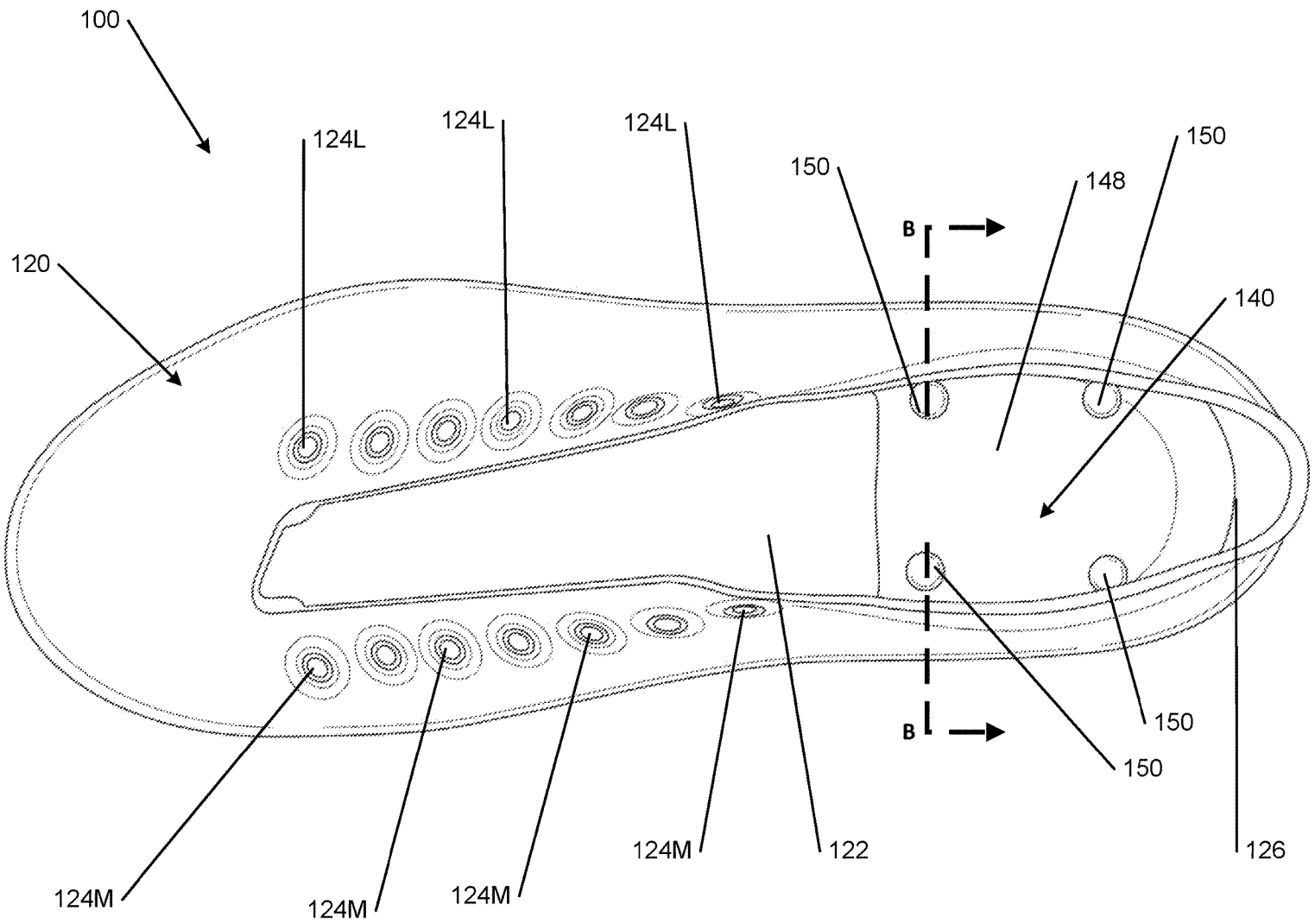
Figure 2D:
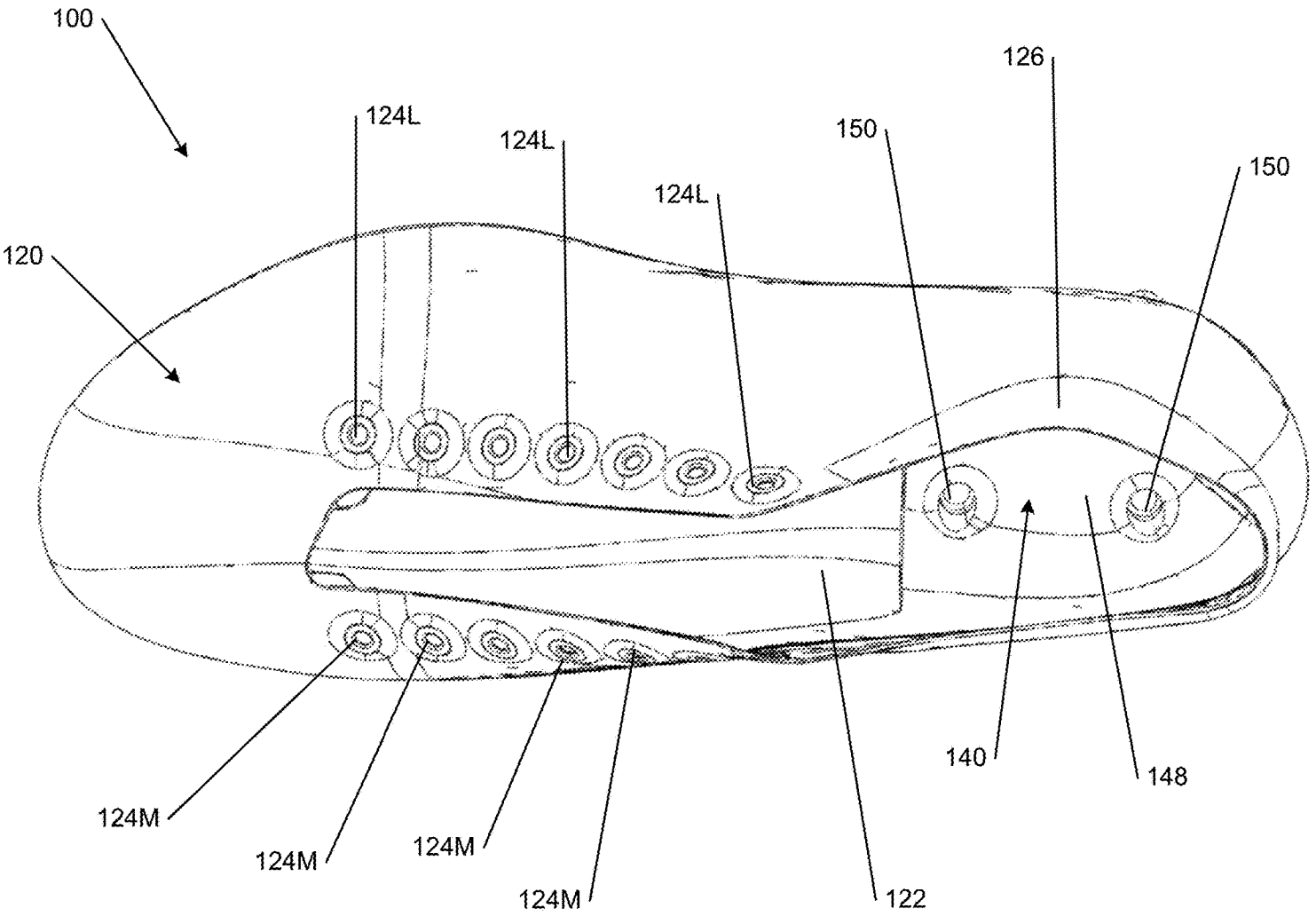
Figure 2E:
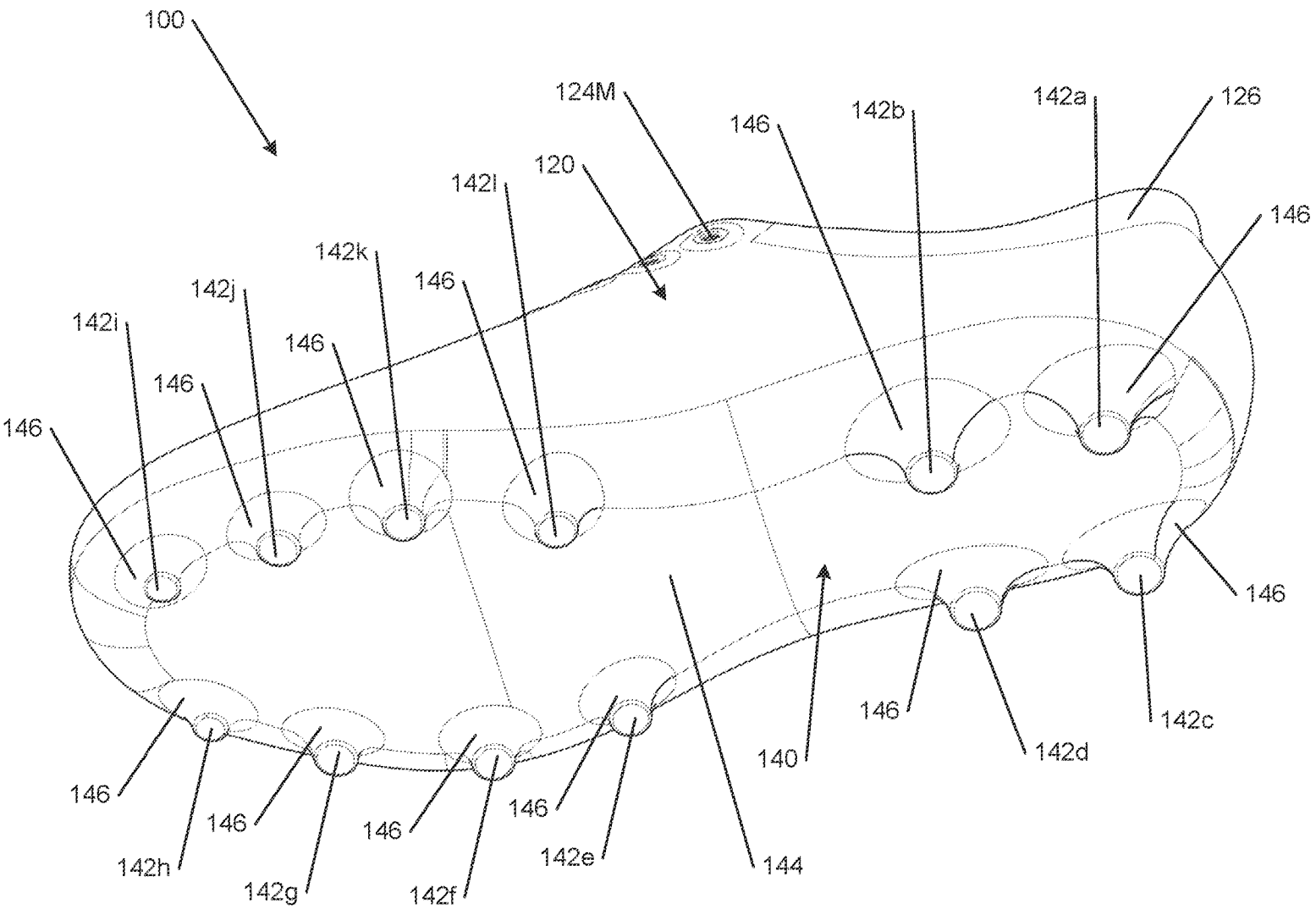
Figure 2F:
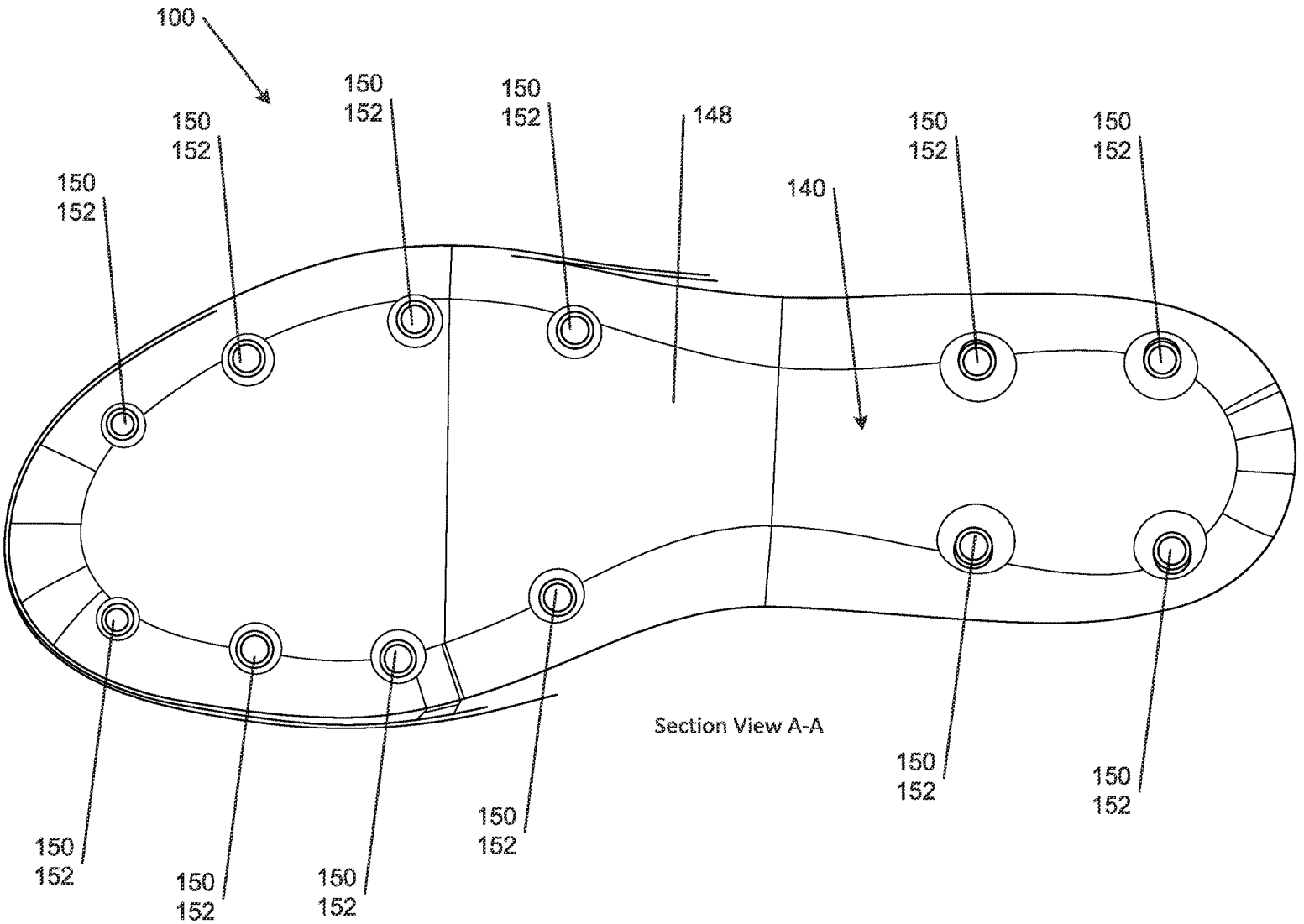

FIG. 2F provides a cross sectional view taken along section line A-A in FIG. 2A of the outer cage component of an article of footwear in accordance with some examples of this technology.

Figure 2G:
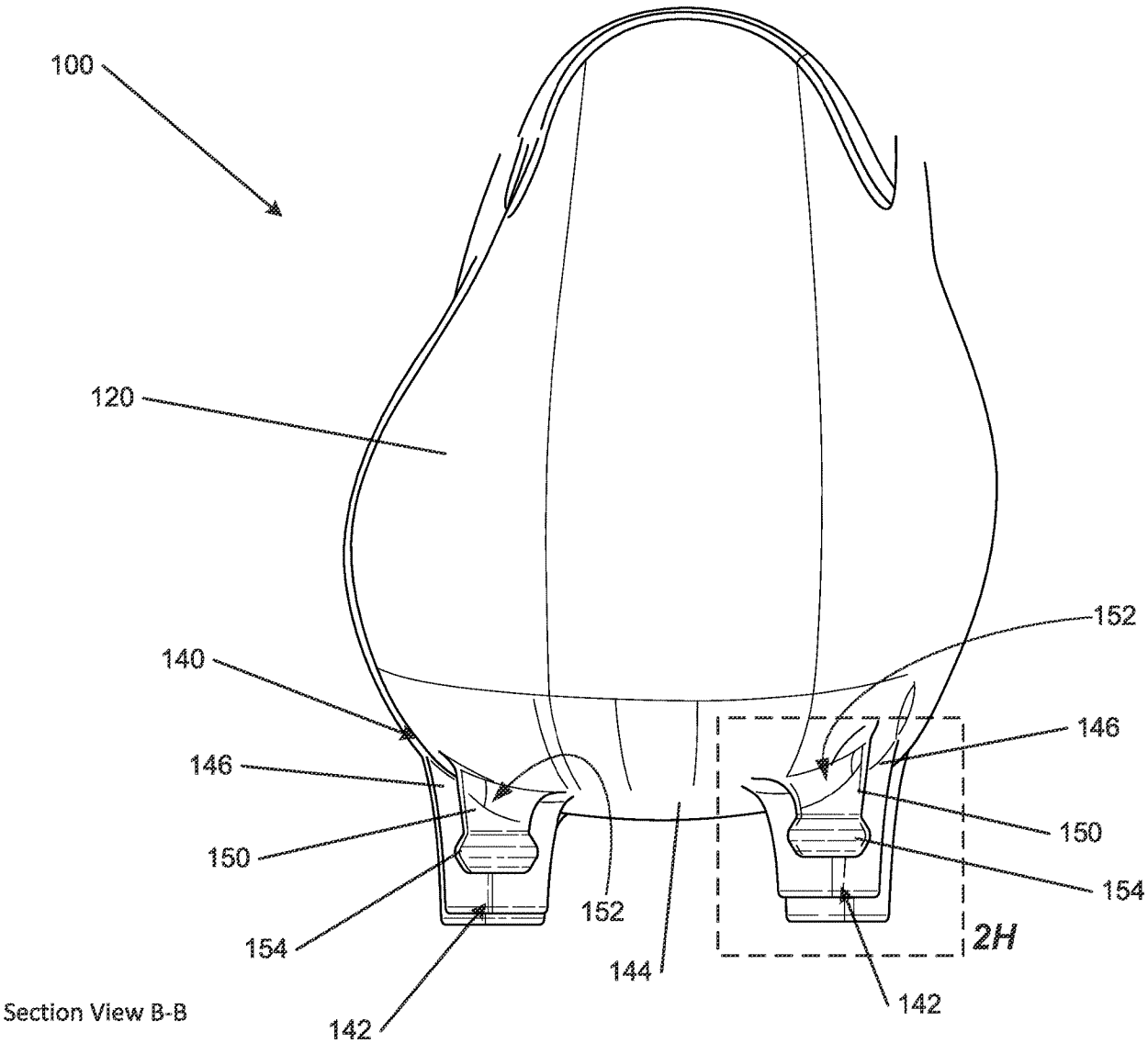

FIG. 2G provides a cross sectional view taken along section line B-B in FIG. 2C of the outer cage component of an article of footwear in accordance with some examples of this technology.

Figure 2H:
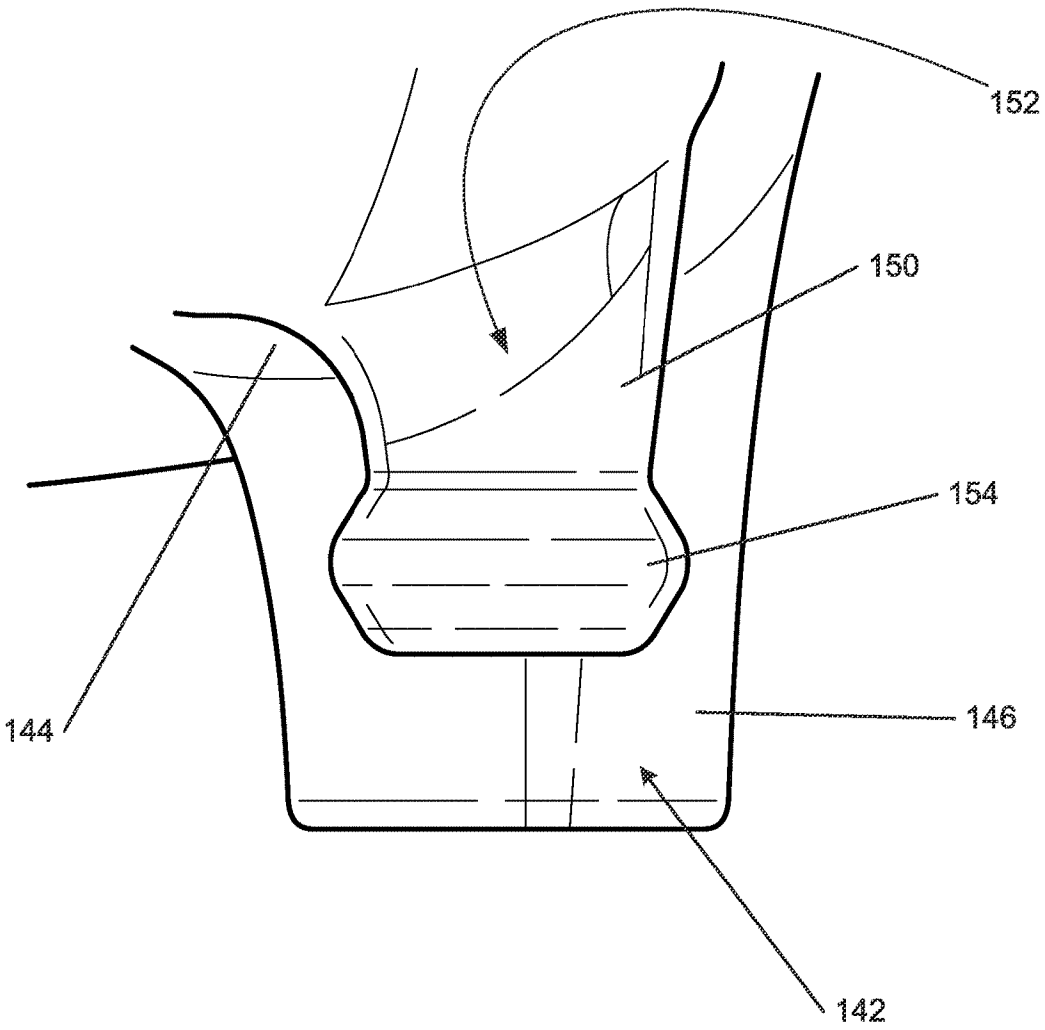

FIG. 2H provides an enlarged view of area 2H shown in FIG. 2G to illustrate specific features of a cleat outer shell on the outer cage component of an article of footwear in accordance with some examples of this technology.

Figure 3A:
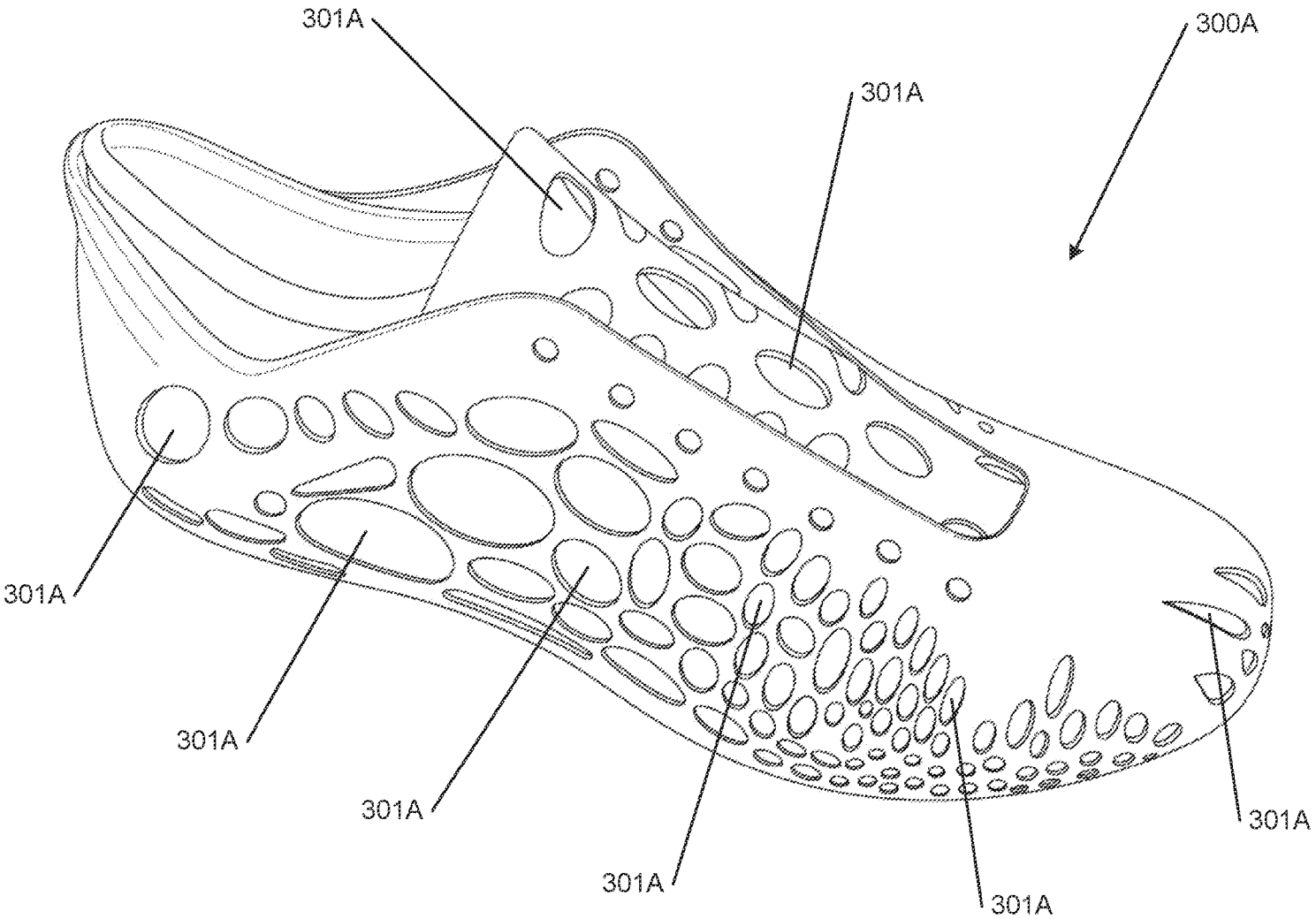
Figure 3B:
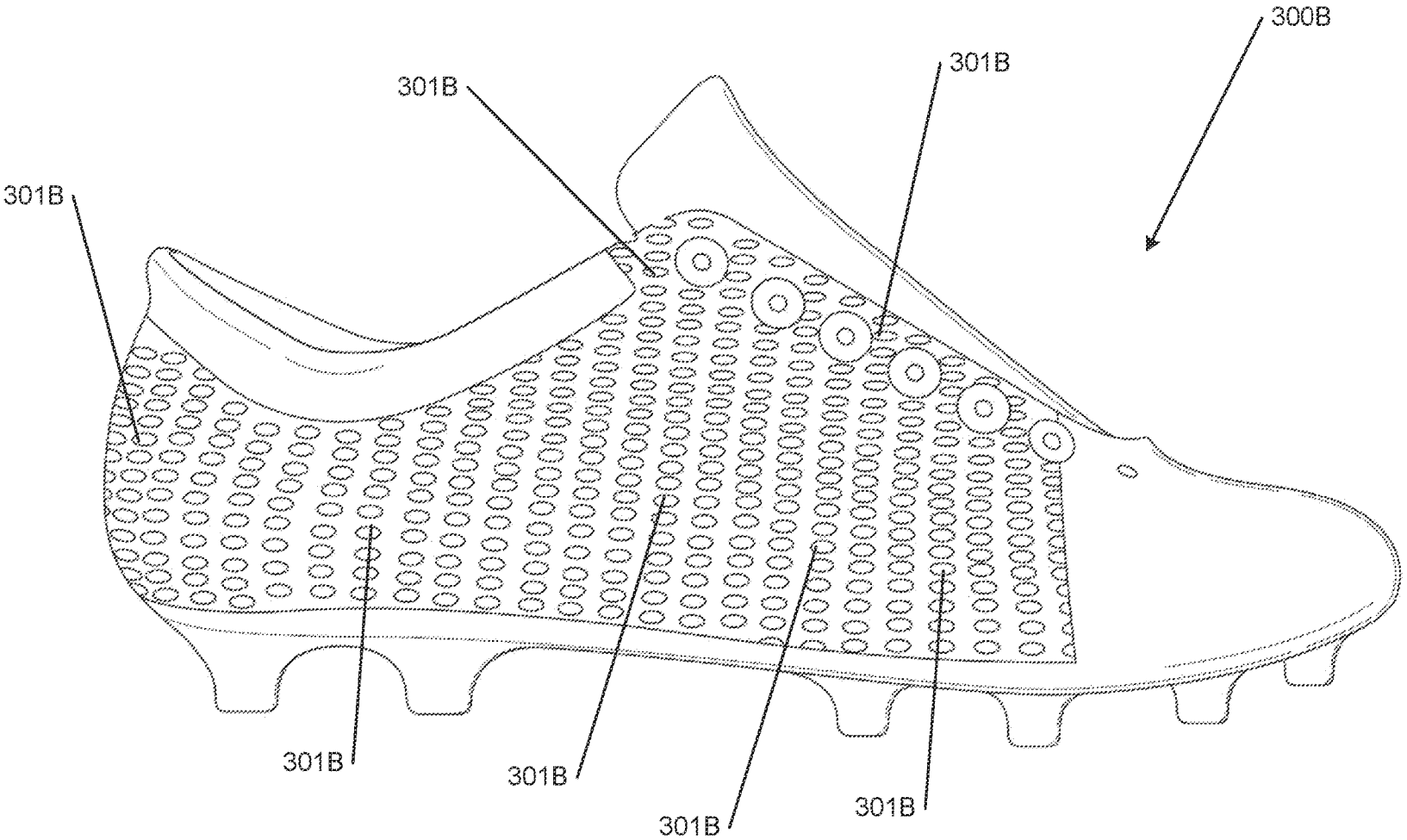
Figure 3C:
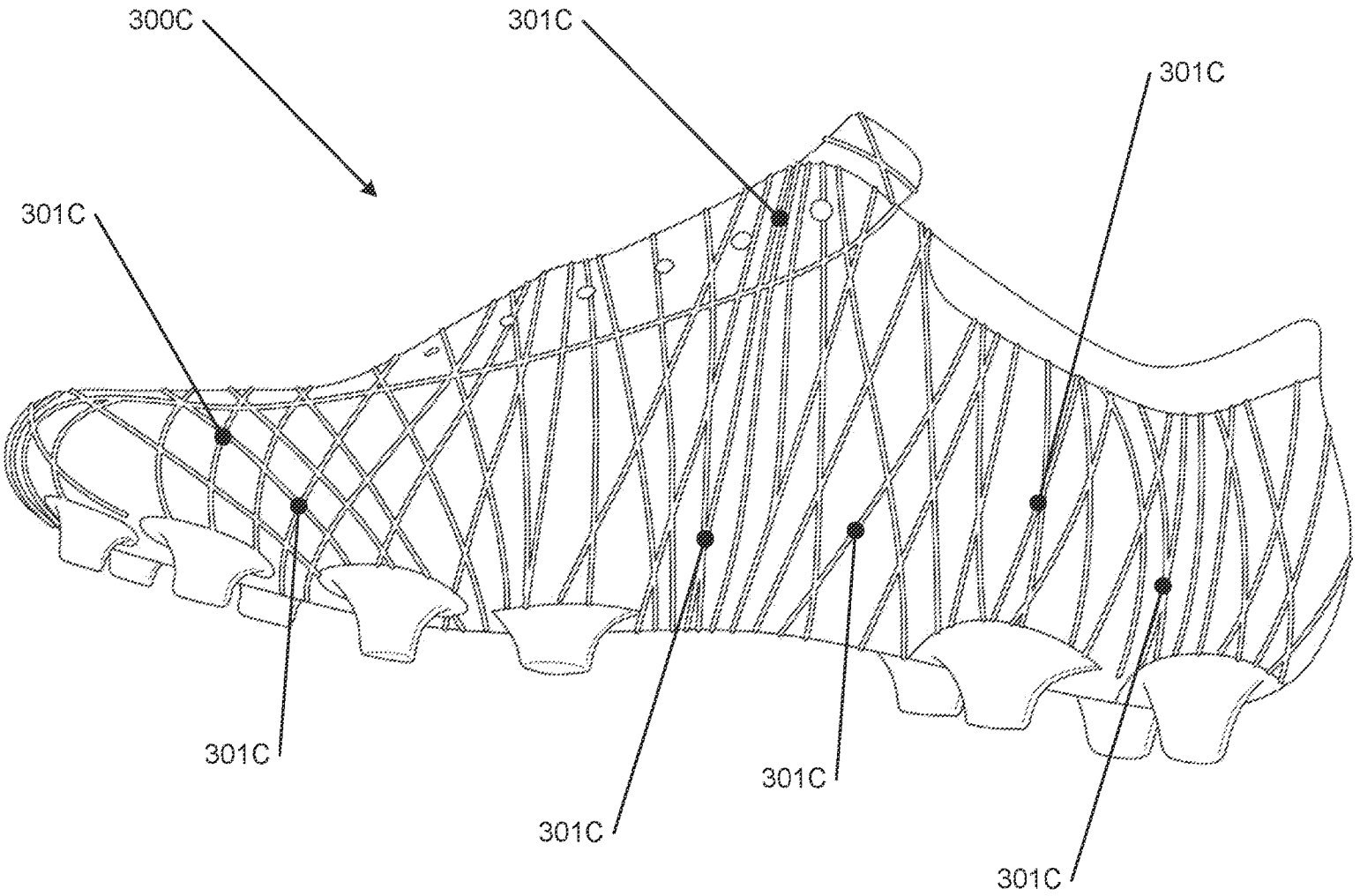

FIGS. 3A-3C provide views of various alternative embodiments of outer cage components of articles of footwear in accordance with some examples of this technology.

Figure 4A:
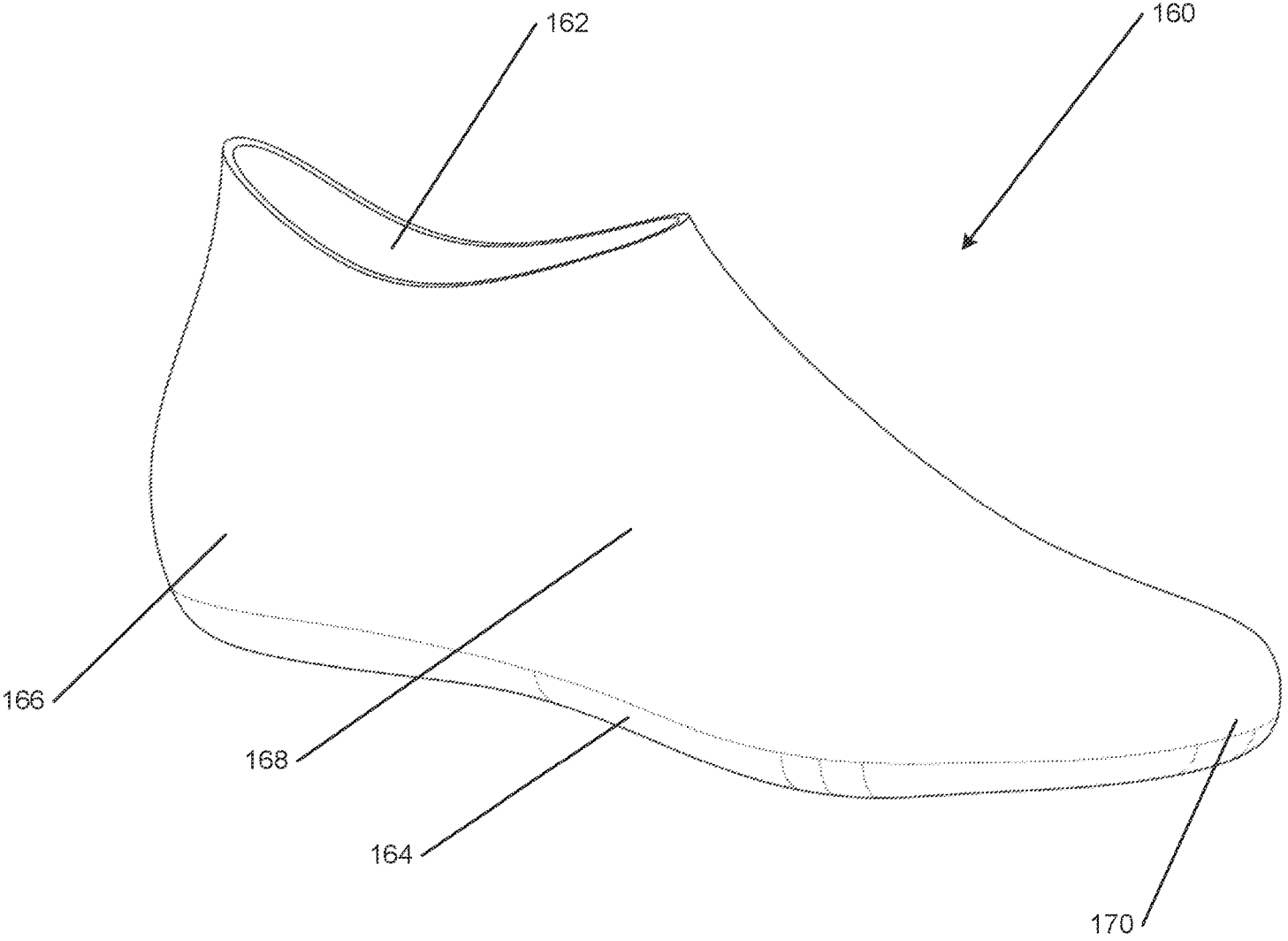
Figure 4B:
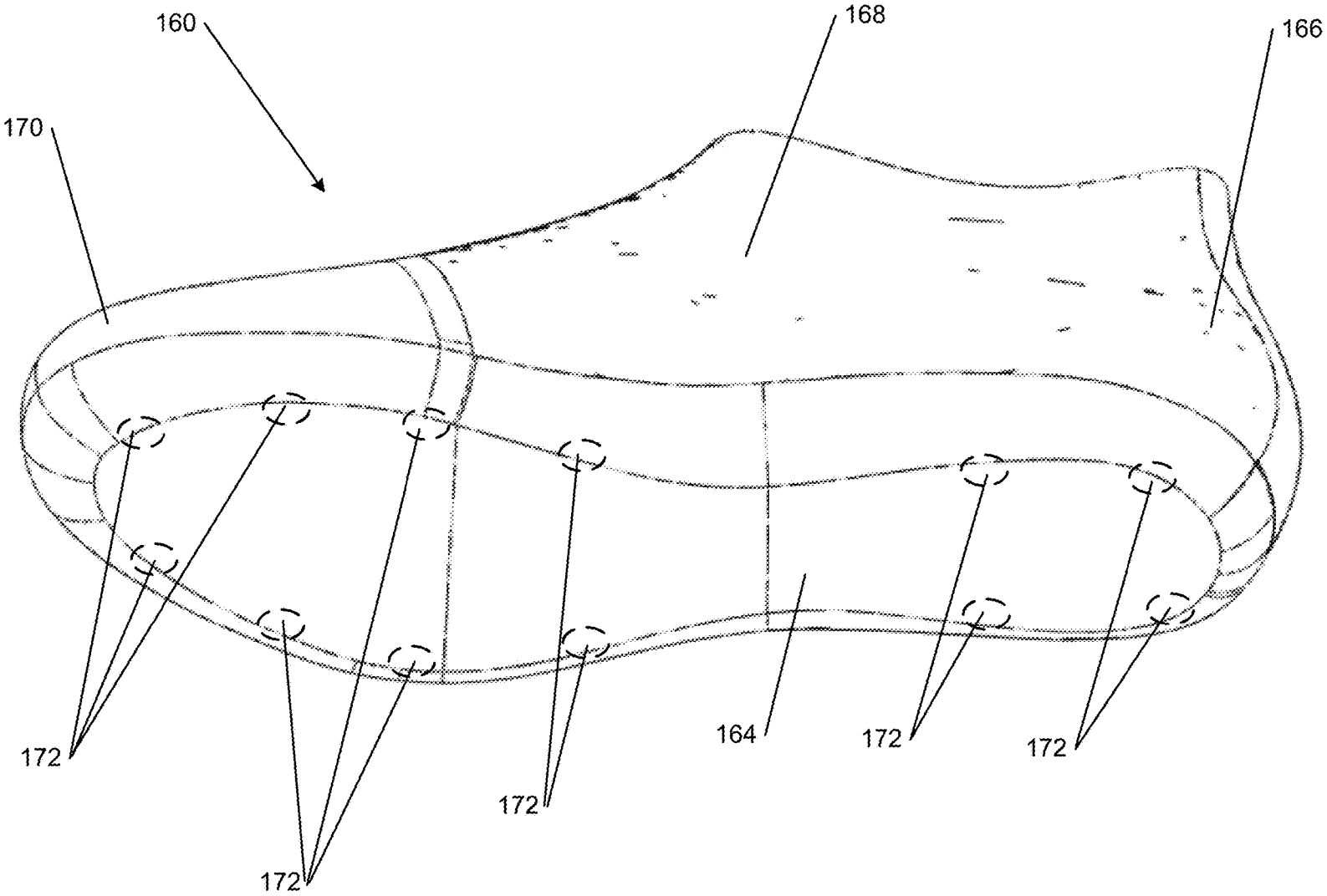

FIGS. 4A and 4B provide views of an inner upper component of an article of footwear in accordance with some examples of this technology.

Figure 5A:
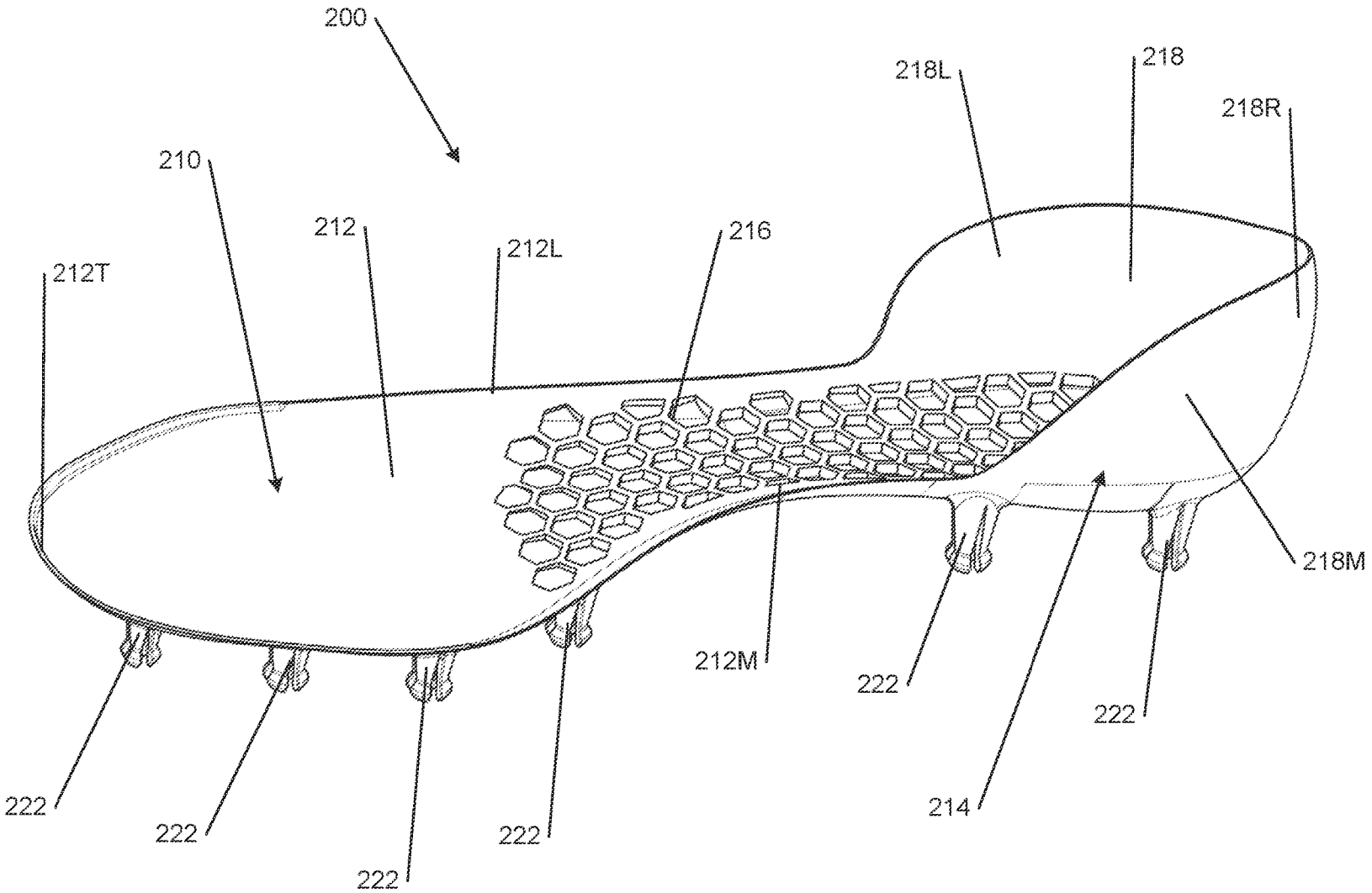
Figure 5B:
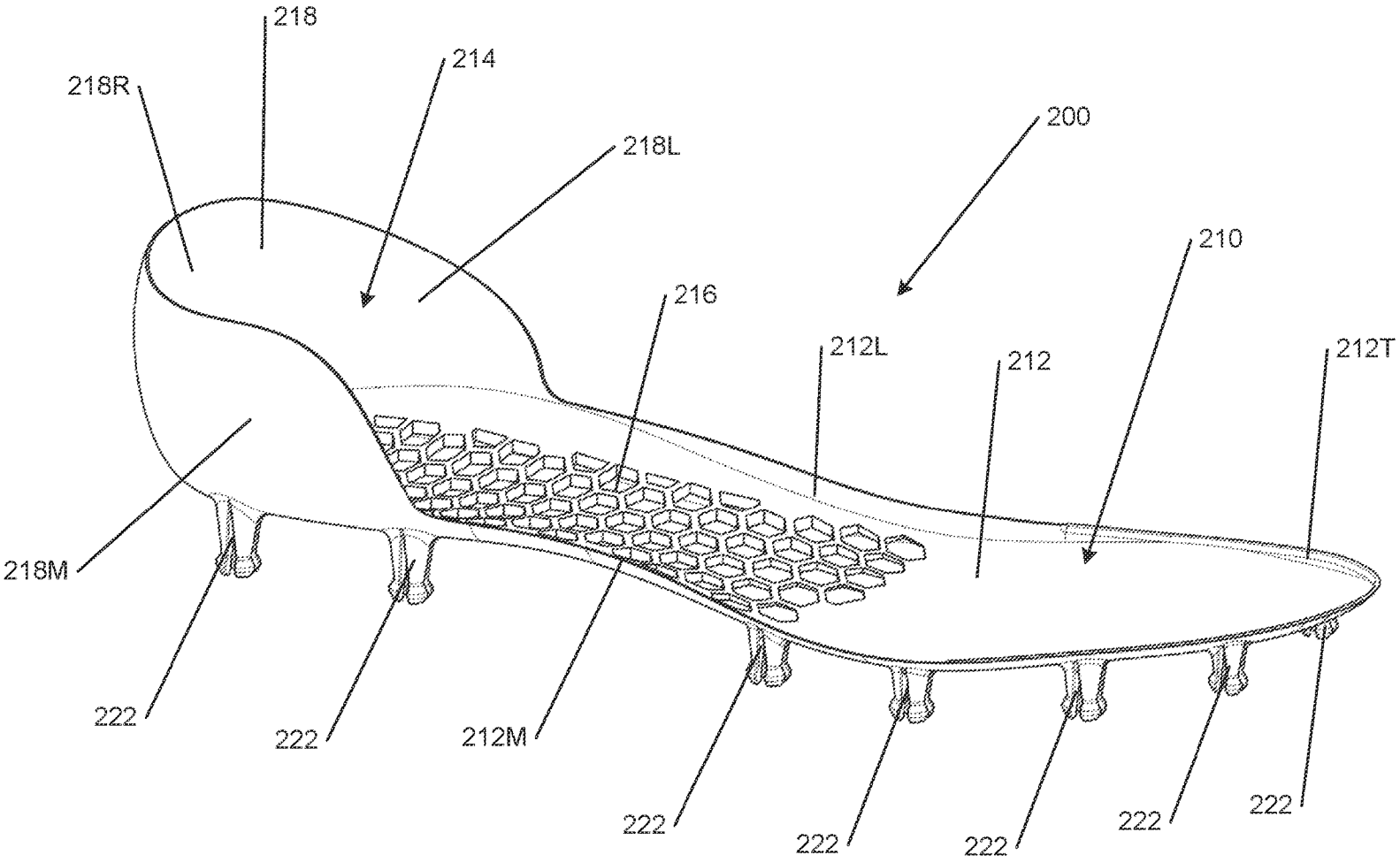
Figure 5C:
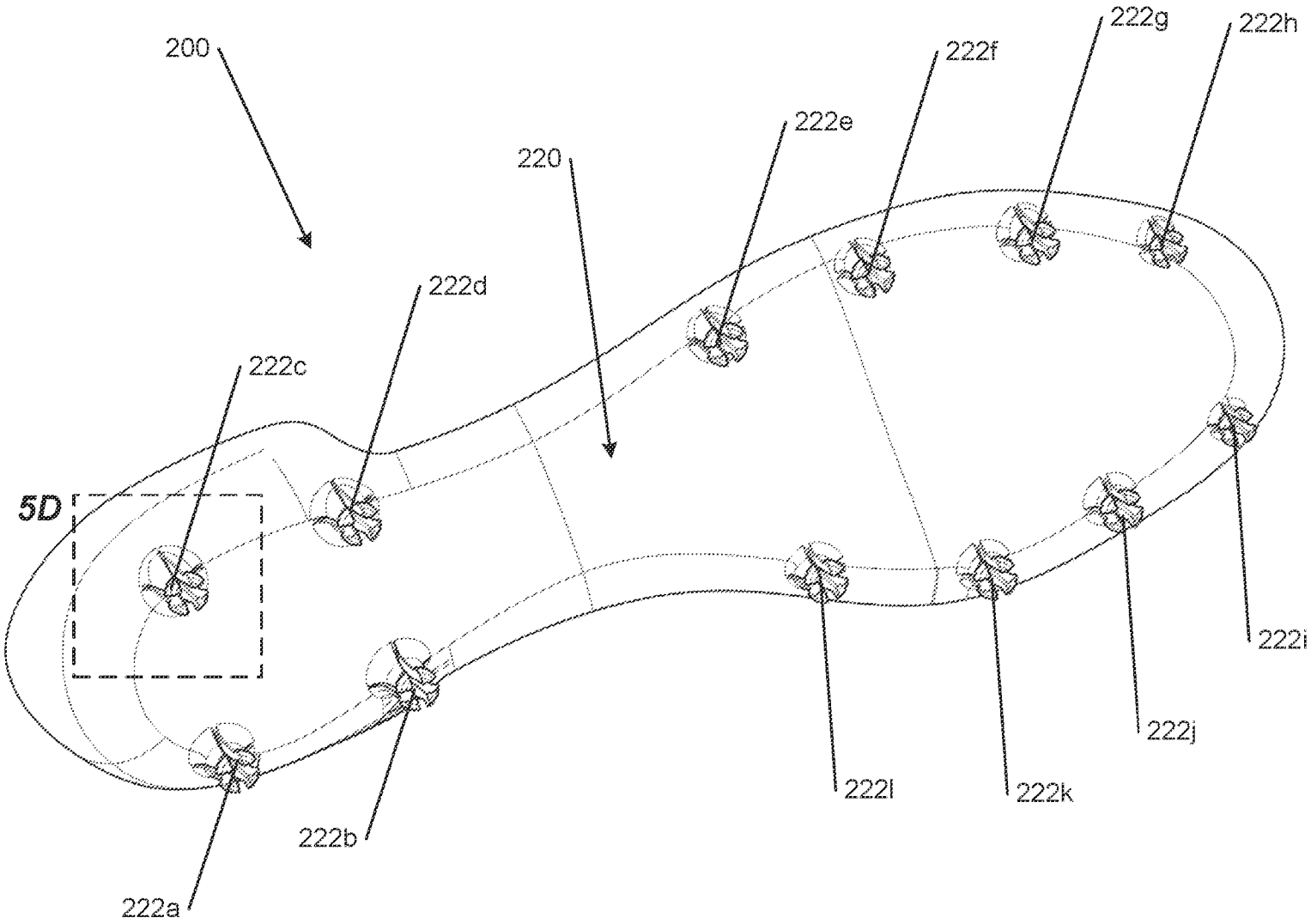

FIGS. 5A-5C provide various views of a foot support component of an article of footwear in accordance with some examples of this technology.

Figure 5D:
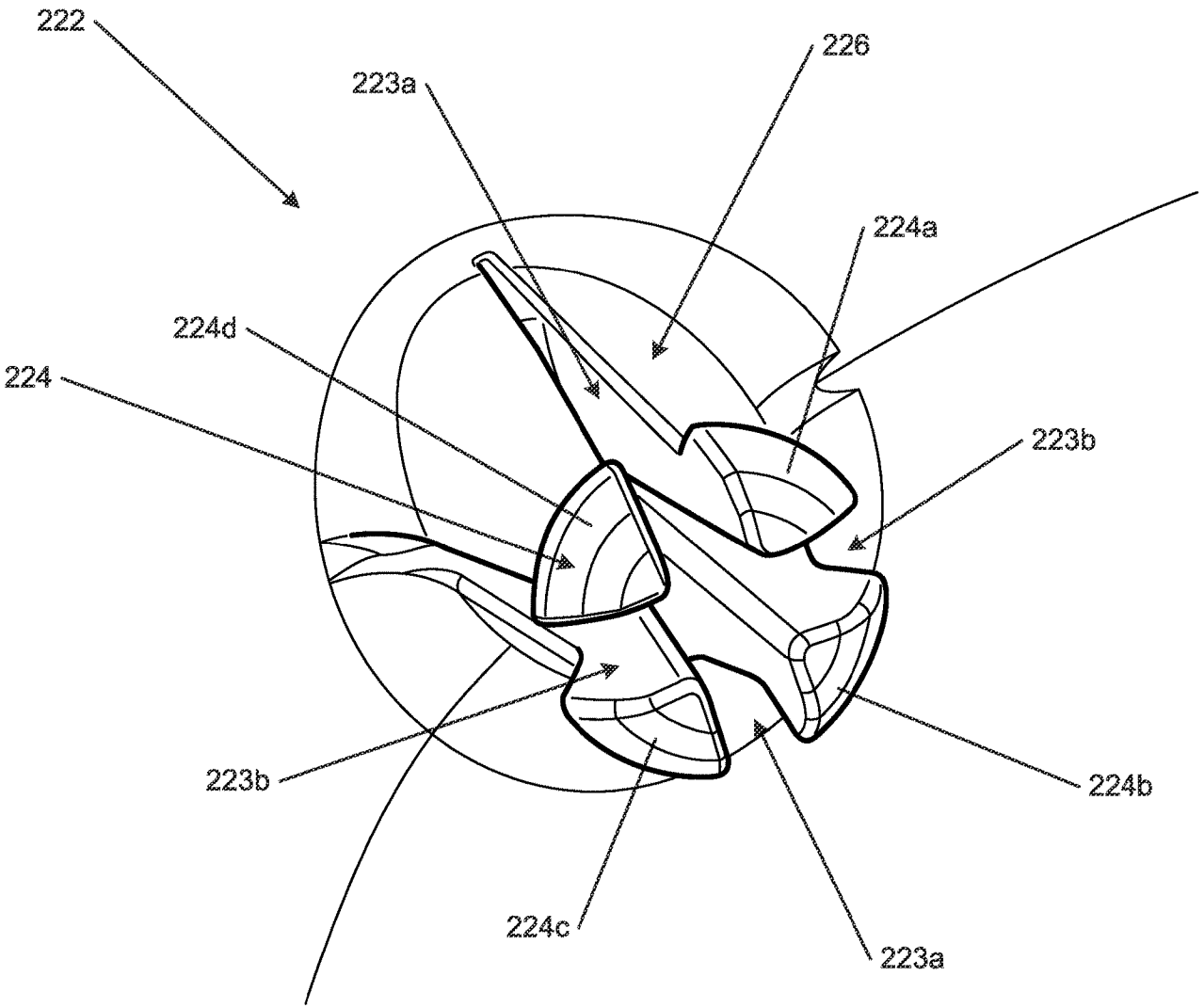

FIG. 5D provides an enlarged view of area "5D" shown in FIG. 5C to illustrate specific features of a cleat insert on the foot support component of an article of footwear in accordance with some examples of this technology.

Figure 5E:
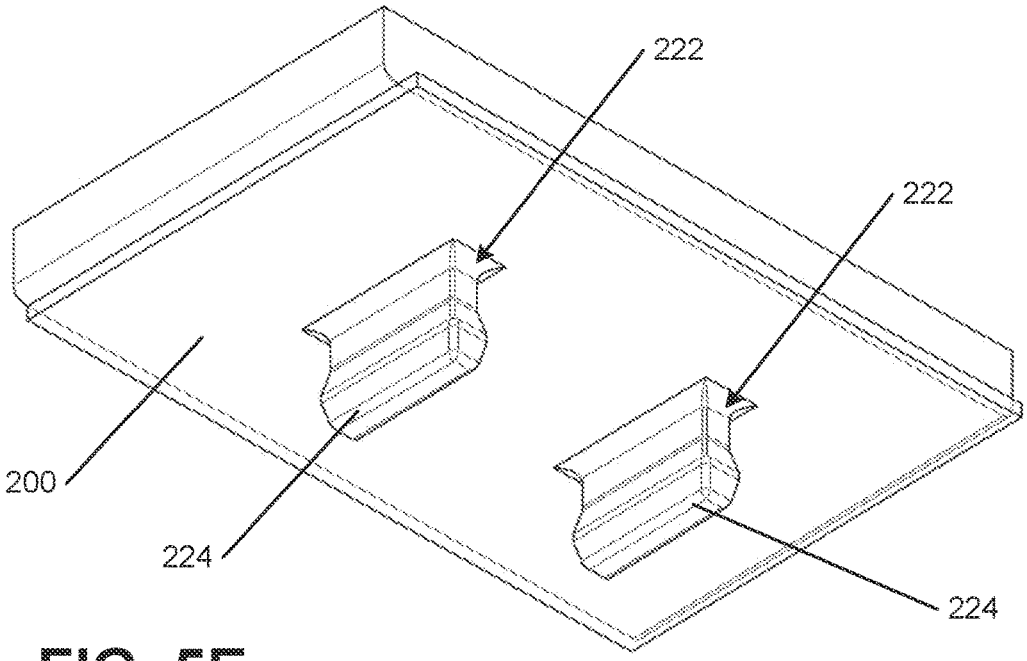
Figure 5F:
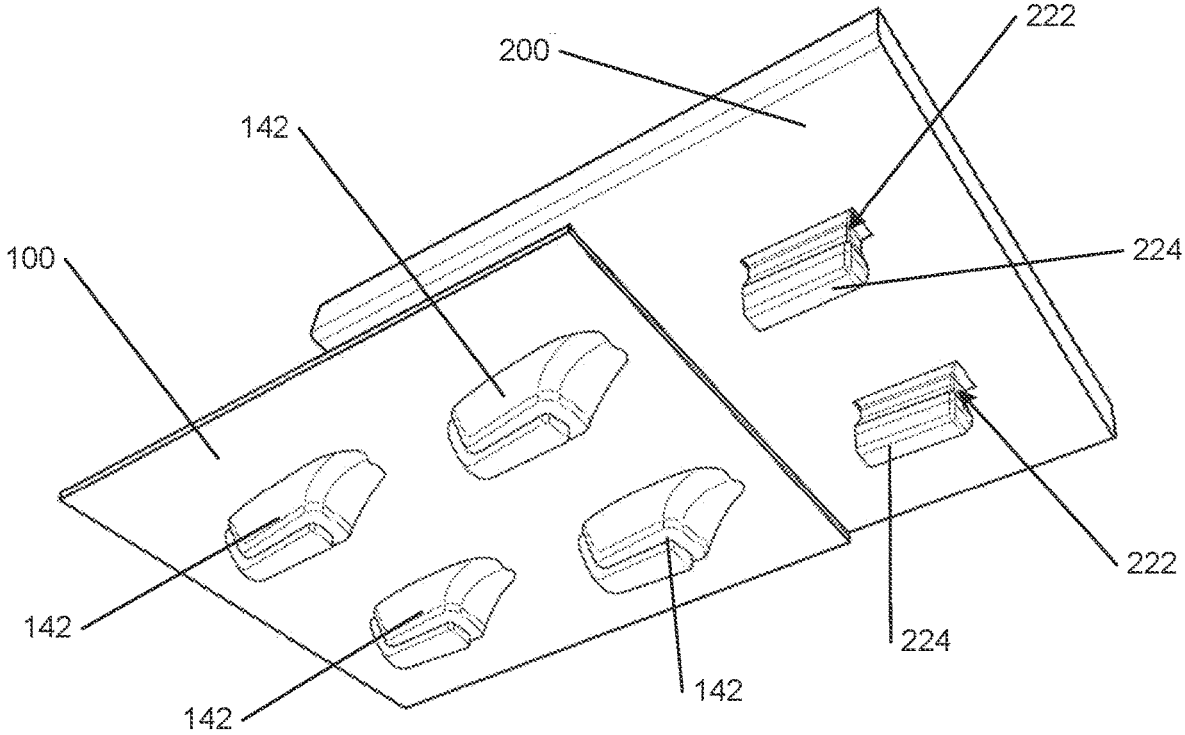

FIGS. 5E and 5F provide a side perspective view of another cleat insert engaged with another cleat outer shell in accordance with examples and aspects of this technology.

Figure 5G:
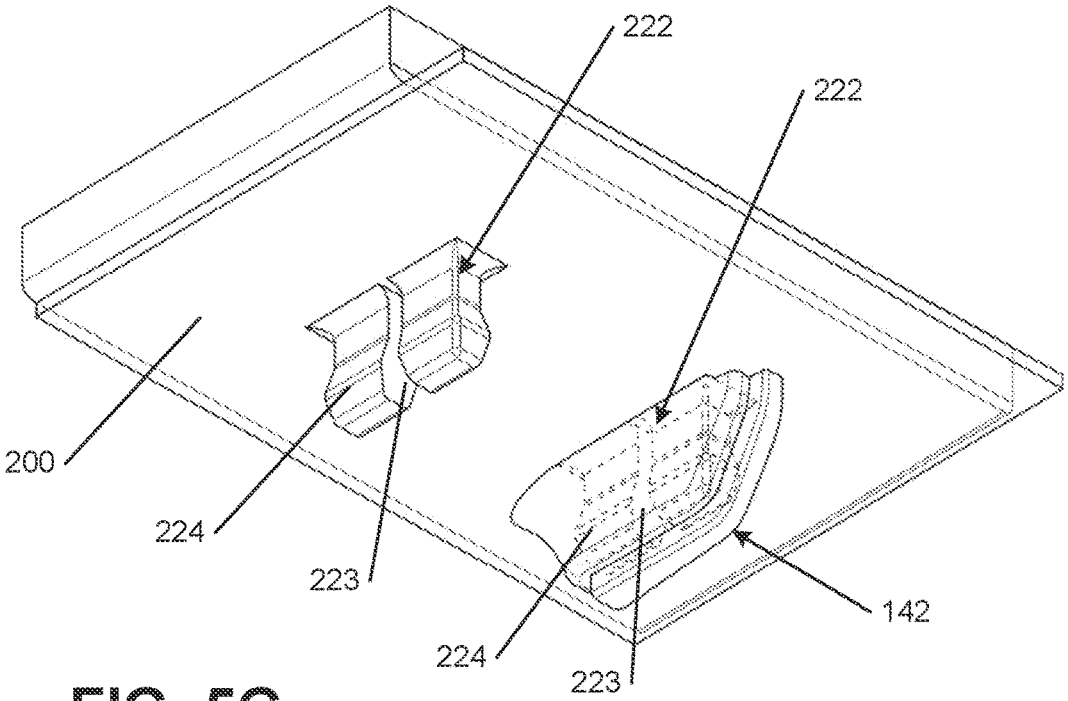
Figure 5H:
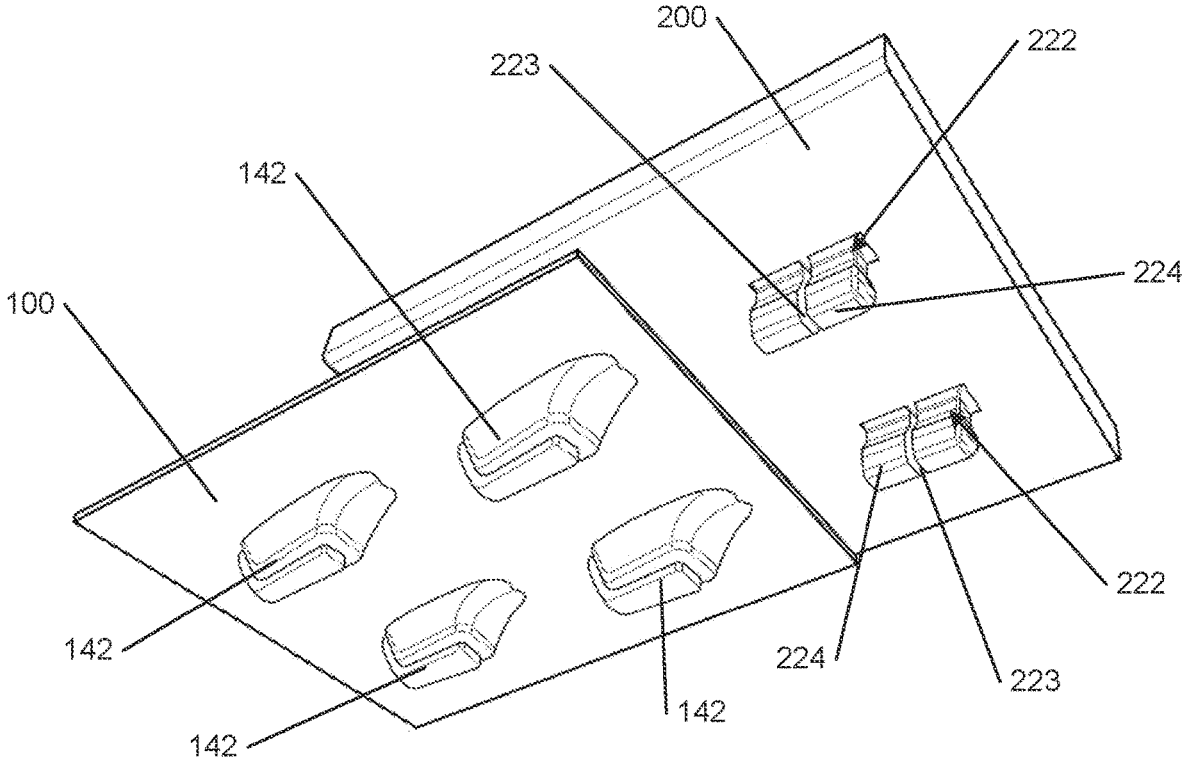

FIGS. 5G and 5H provide a side perspective view of another cleat insert engaged with another cleat outer shell in accordance with examples and aspects of this technology.

Figure 6A:
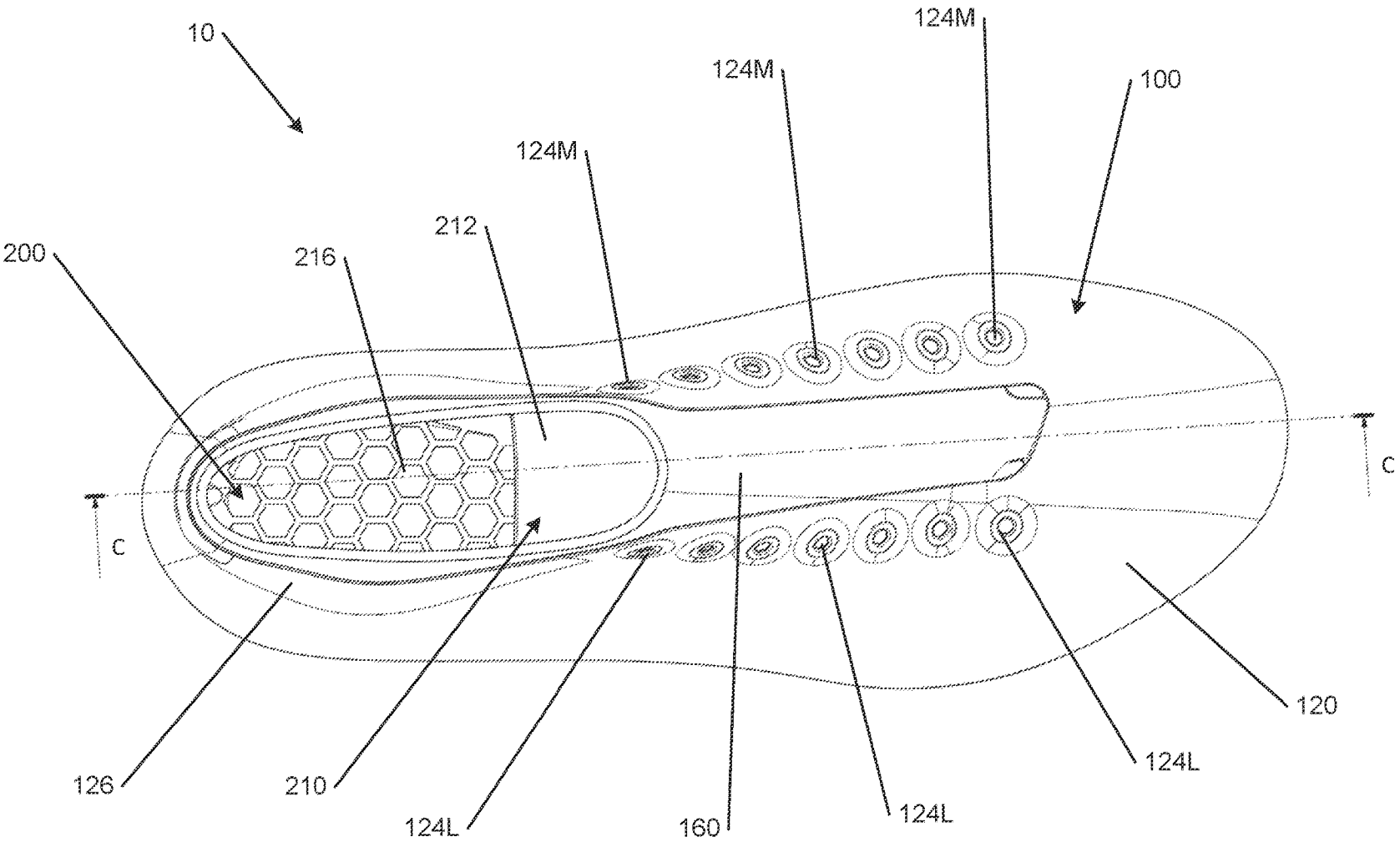

FIG. 6A provides a top view of an article of footwear in accordance with some examples of this technology.

Figure 6B:
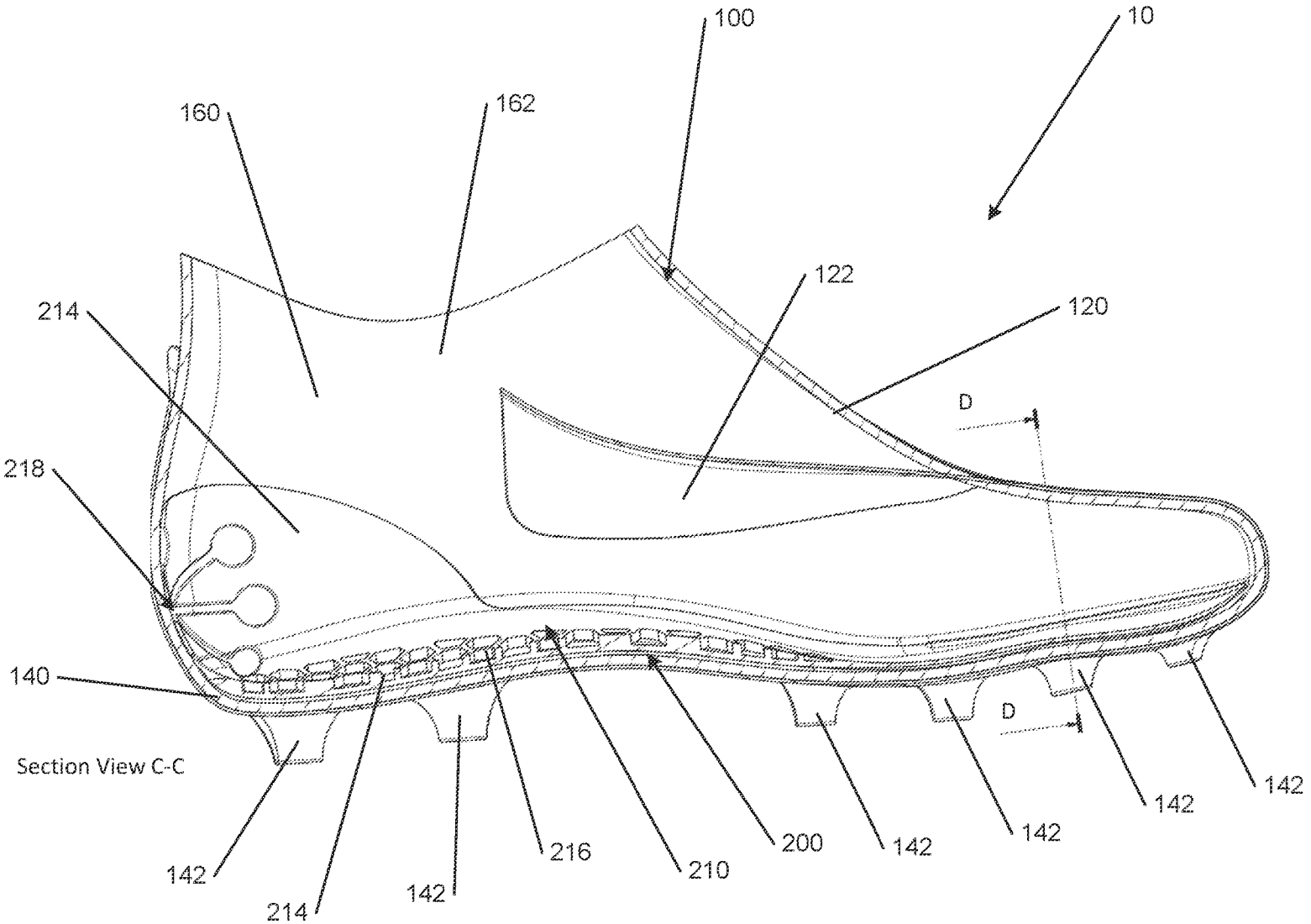

FIG. 6B provides a cross sectional view taken along section line C-C in FIG. 6A of the article of footwear in accordance with some examples of this technology.

Figure 6C:
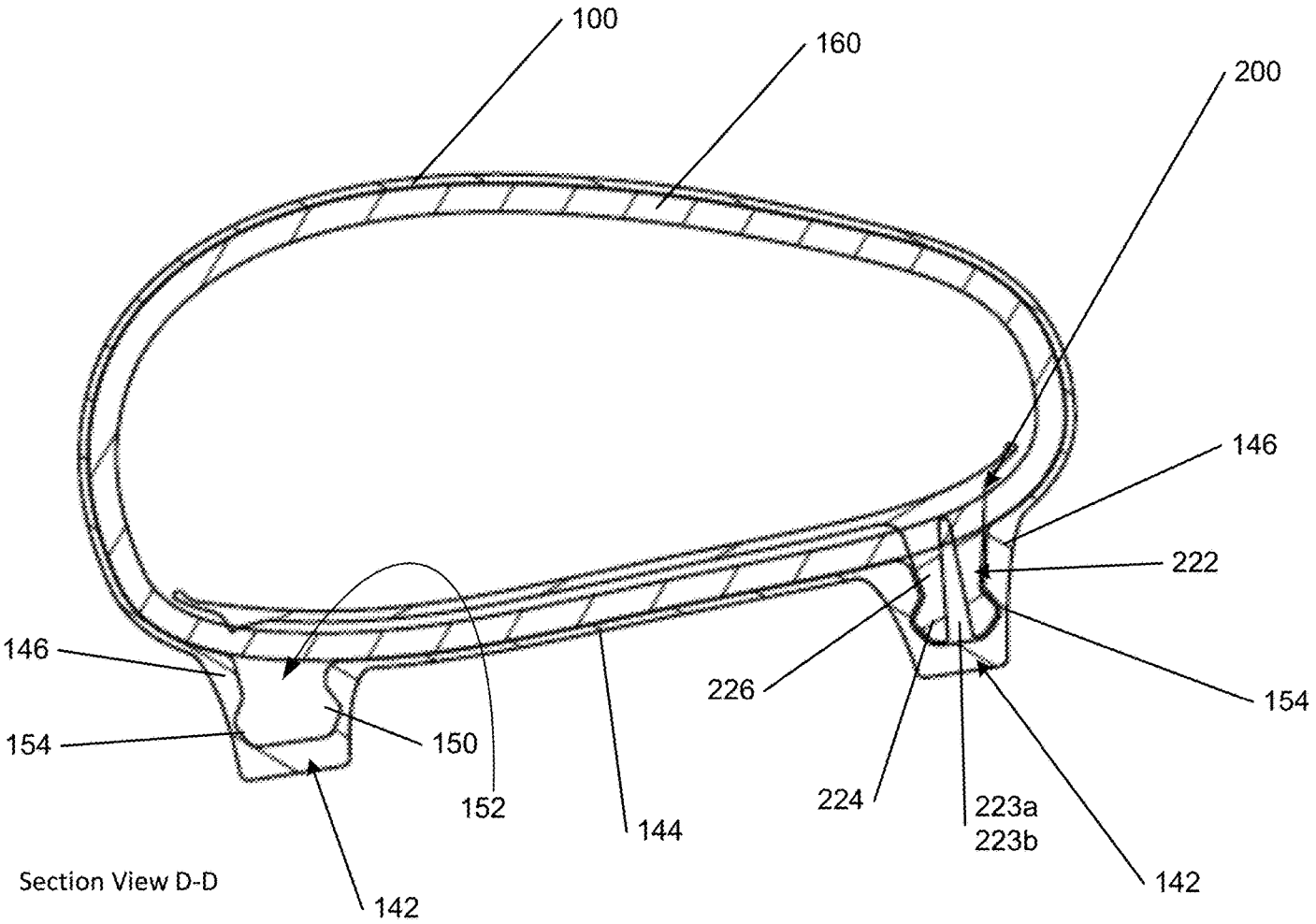

FIG. 6C provides a cross sectional view taken along section line D-D in FIG. 6B of the article of footwear in accordance with some examples of this technology.

Figure 7A:
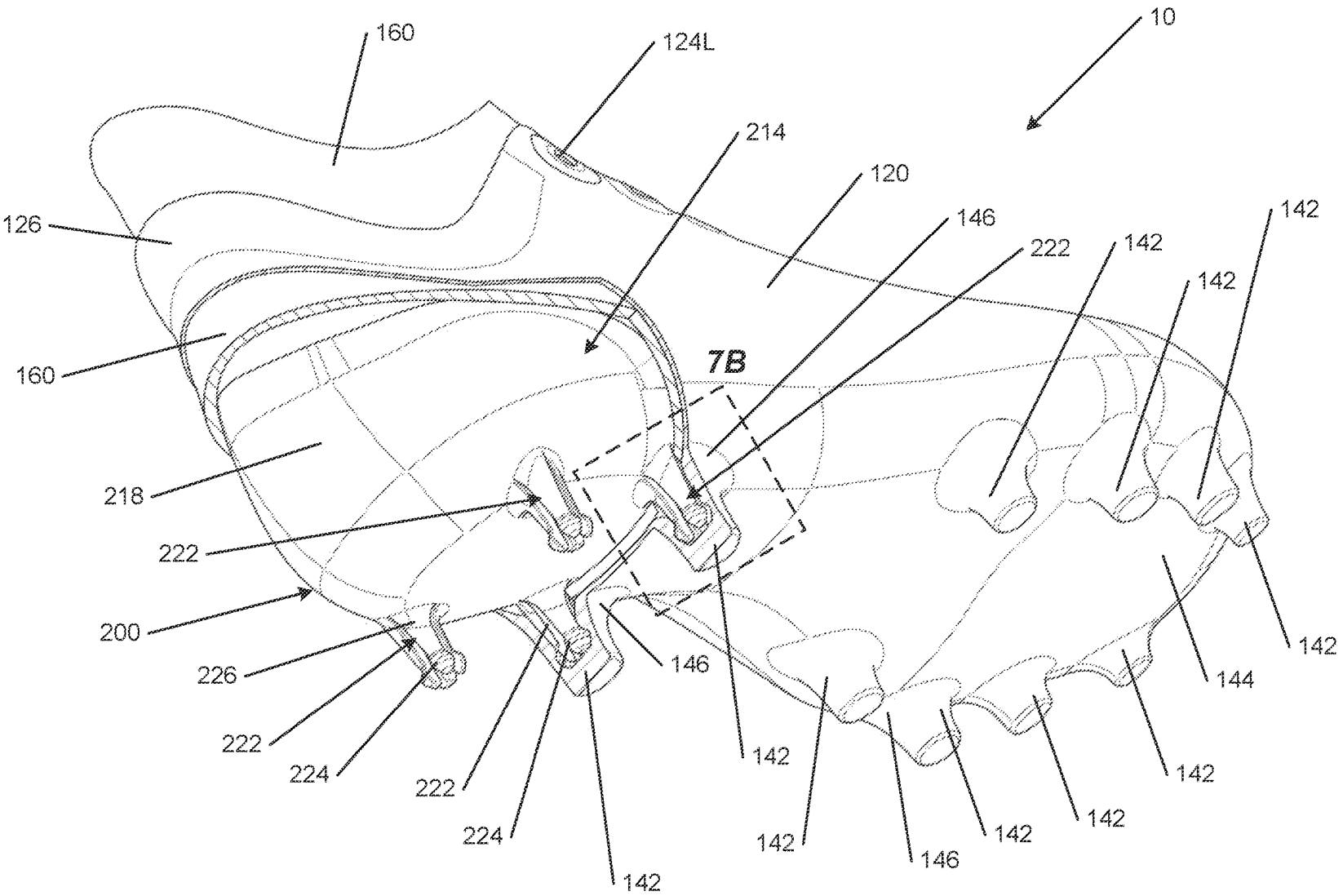

FIG. 7A provides a rear perspective cutaway view of the article of footwear highlighting the engagement between a cleat insert and a cleat outer shell in accordance with some examples of this technology.

Figure 7B:
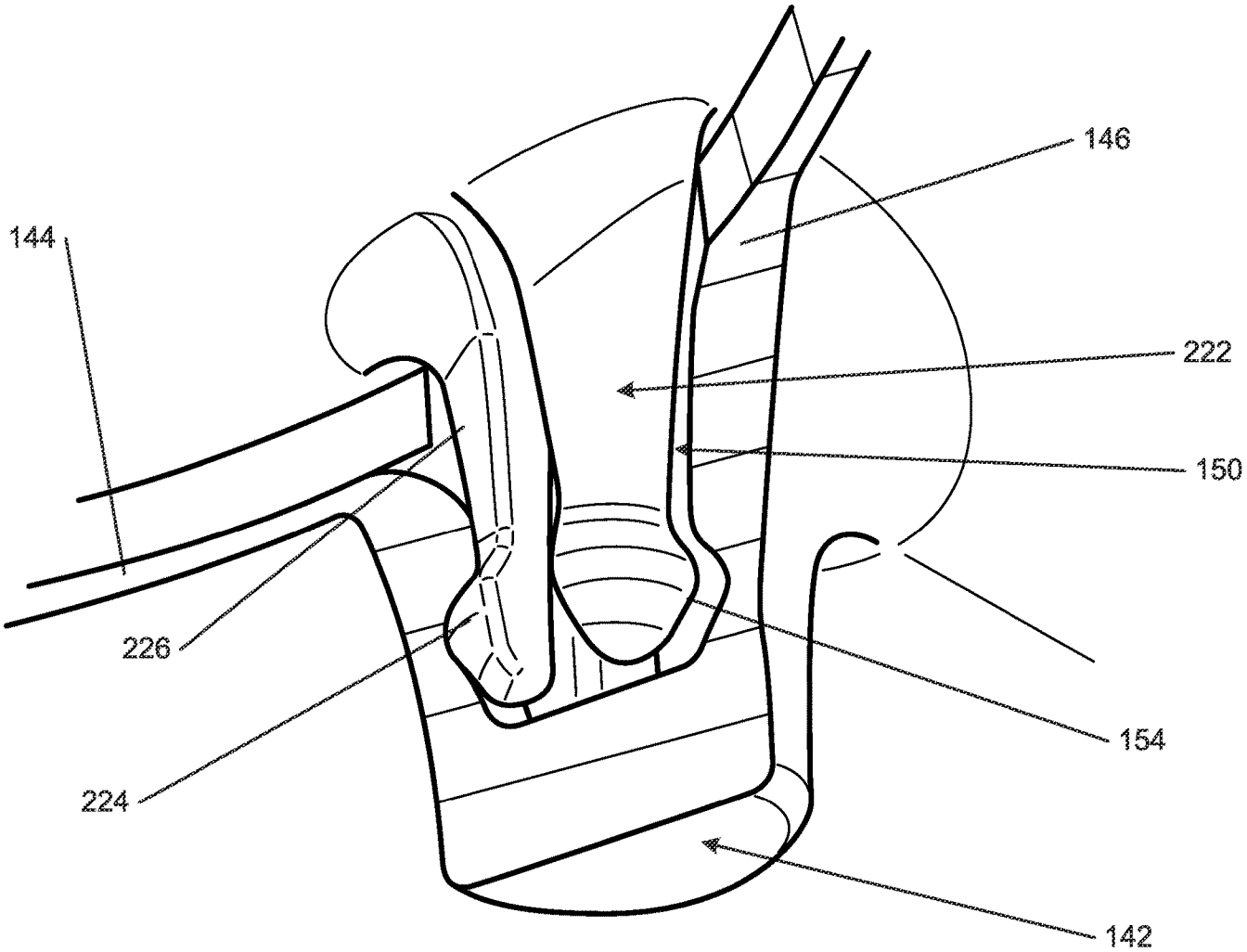

FIG. 7B provides an enlarged view of area "7B" shown in FIG. 7A to illustrate the cleat insert engaged with the cleat outer shell in accordance with some examples and aspects of this technology.

Figure 8A:
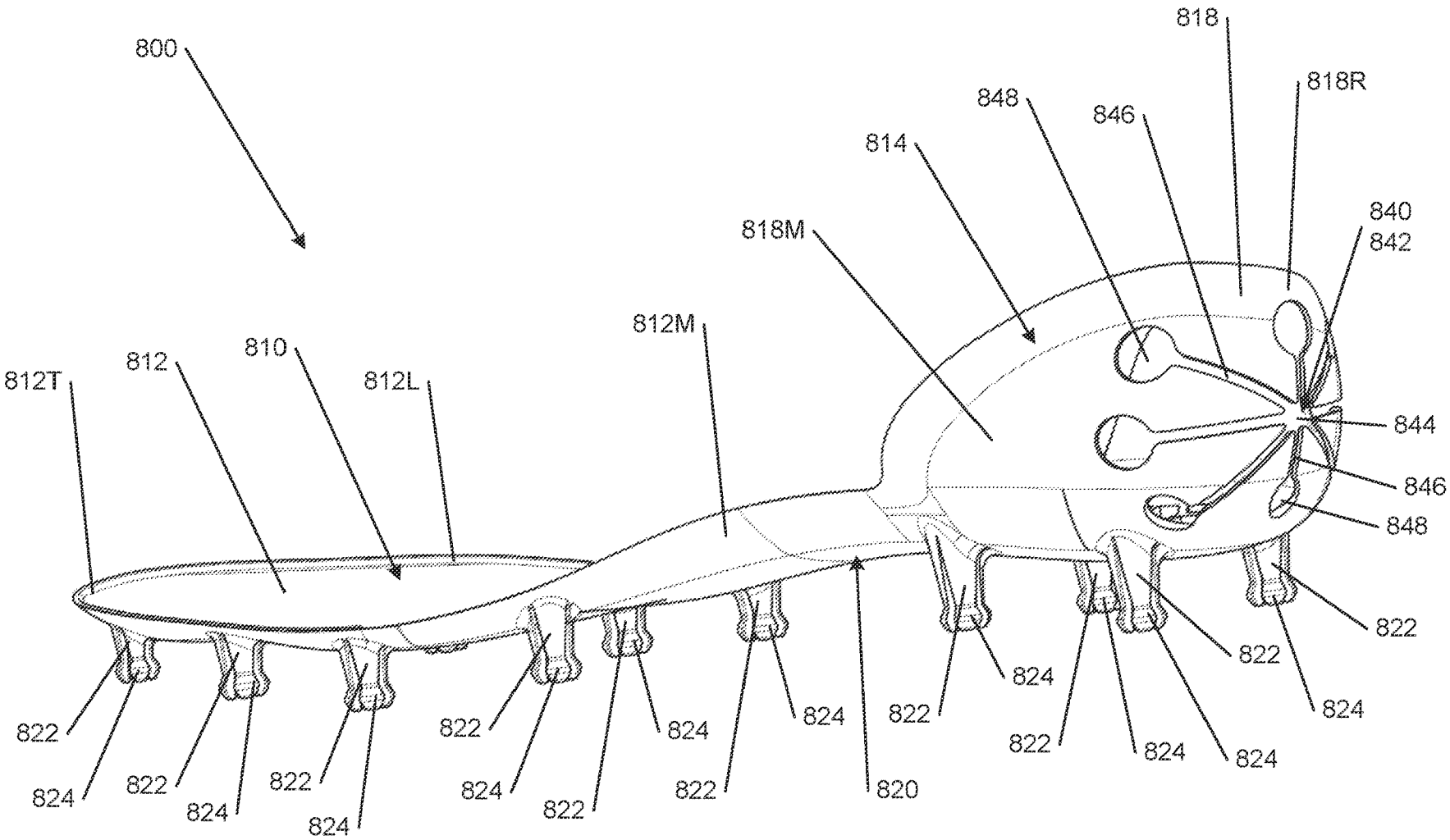
Figure 8B:
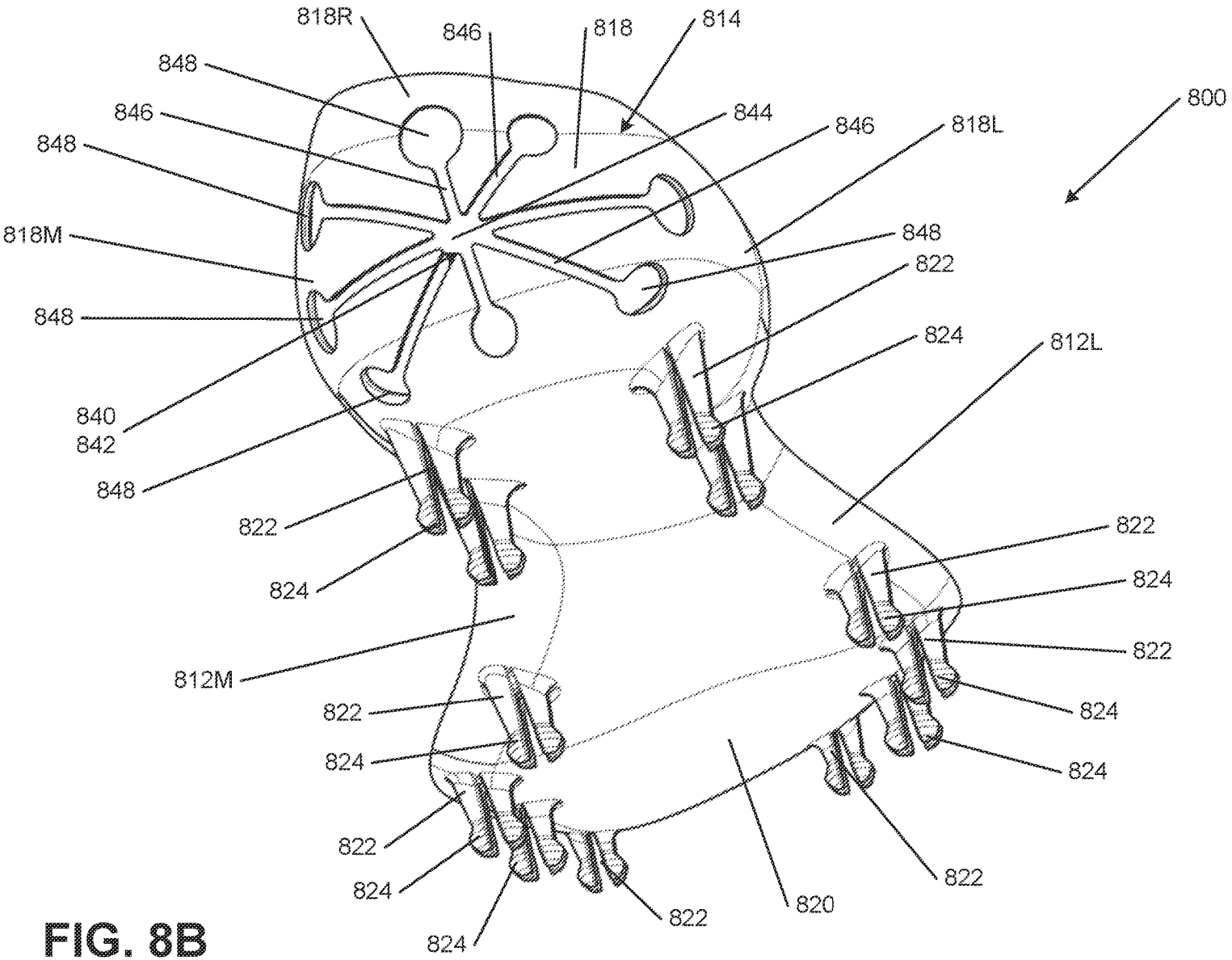

FIGS. 8A and 8B provide various views of another foot support component of an article of footwear in accordance with some examples of this technology.

Figure 9A:
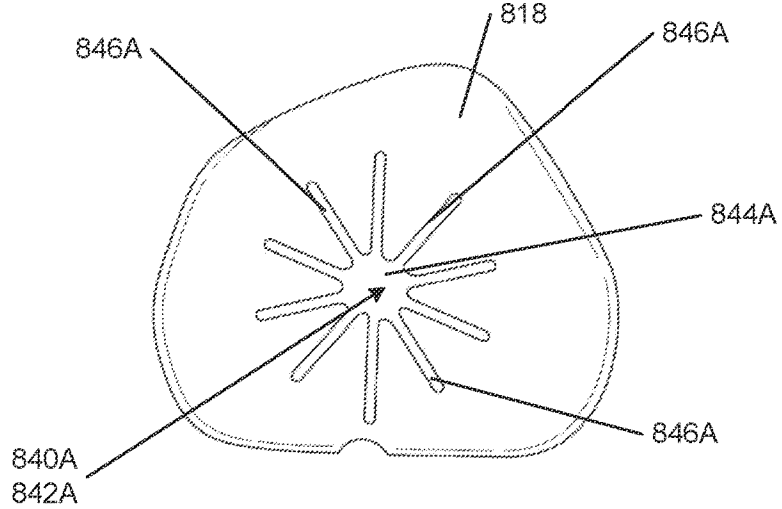
Figure 9B:
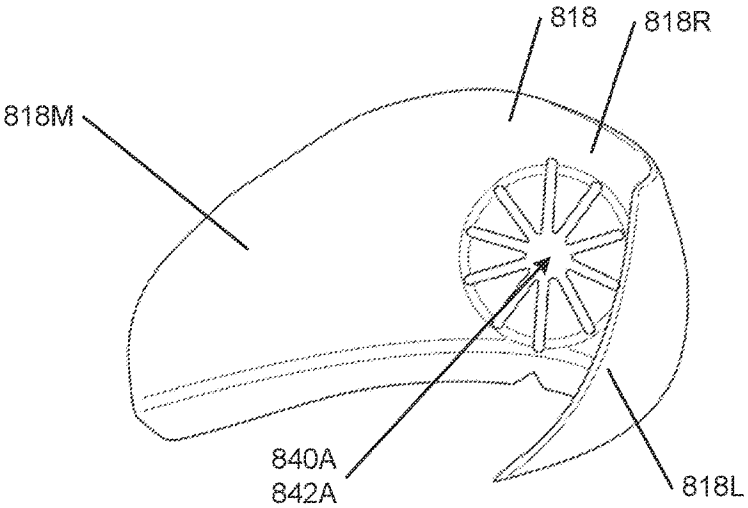

FIGS. 9A and 9B provide various views of another heel counter structure of a foot support component of an article of footwear in accordance with some examples of this technology.

Figure 10A:
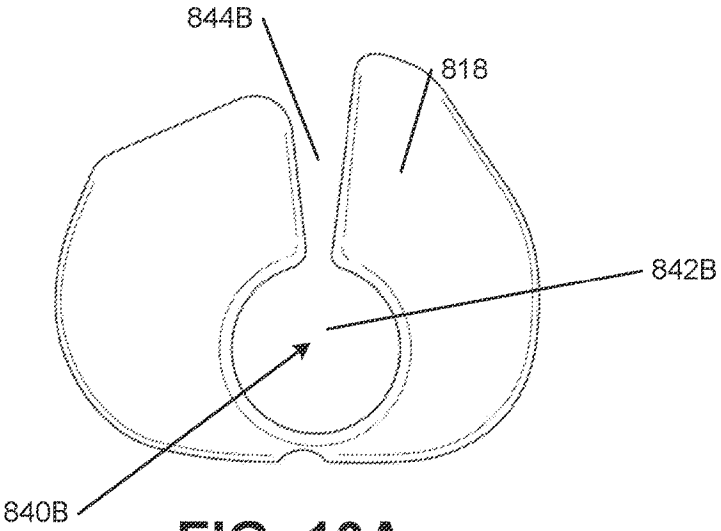
Figure 10B:
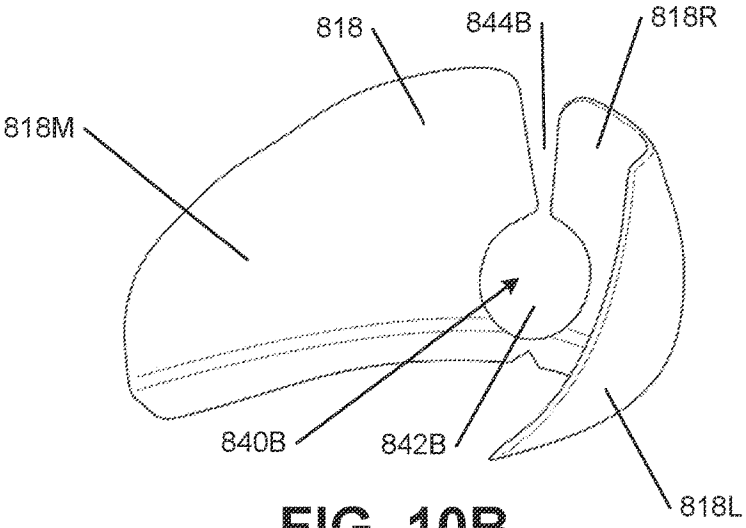

FIGS. 10A and 10B provide various views of another heel counter structure of a foot support component of an article of footwear in accordance with some examples of this technology.

Figure 11A:
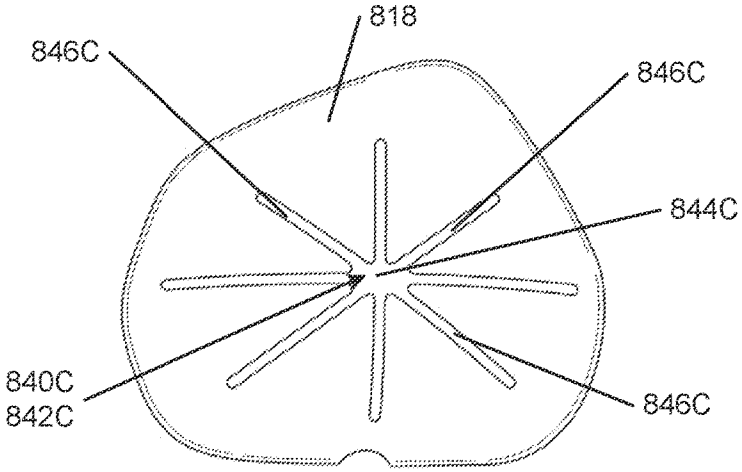
Figure 11B:
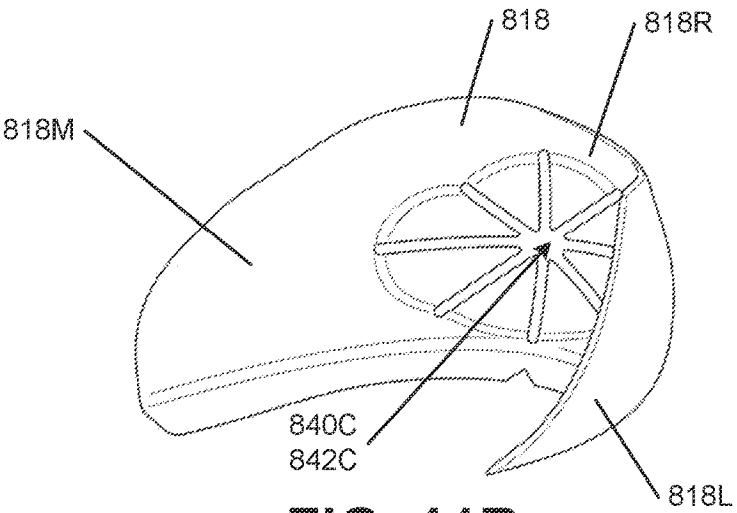

FIGS. 11A and 11B provide various views of another heel counter structure of a foot support component of an article of footwear in accordance with some examples of this technology.

Figure 12A:
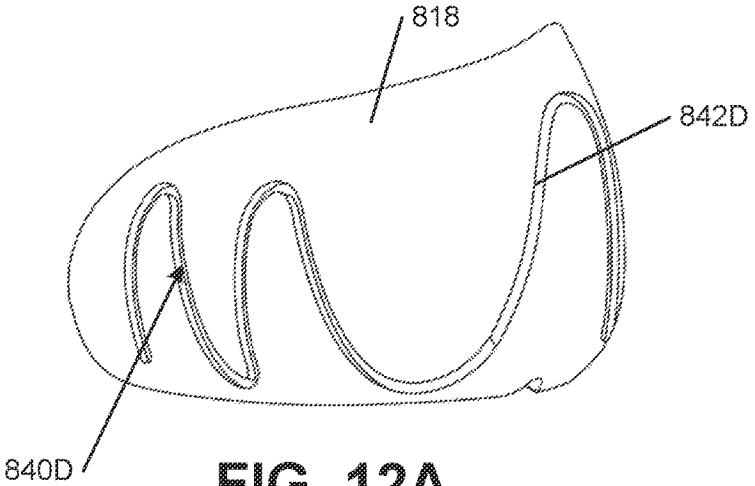
Figure 12B:
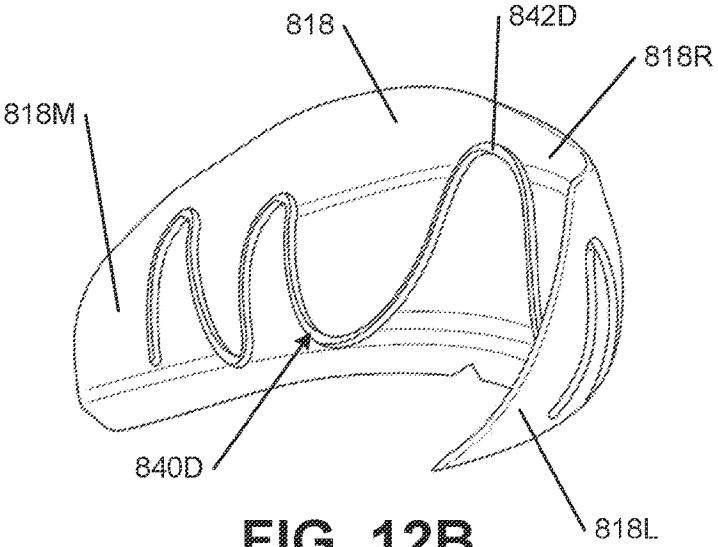

FIGS. 12A and 12B provide various views of another heel counter structure of a foot support component of an article of footwear in accordance with some examples of this technology.

4.0 DETAILED DESCRIPTION

In the following description of various examples of footwear structures and components according to the present technology, reference is made to the accompanying drawings, which form a part hereof, and in which are shown by way of illustration various example structures and environments in which aspects of this technology may be practiced. It is to be understood that other structures and environments may be utilized and that structural and functional modifications may be made to the specifically described structures, functions, and methods without departing from the scope of the present disclosure.

"Footwear," as that term is used herein, means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, basketball shoes, cross training shoes, dance shoes, urban dance shoes, etc.), and the like.

The terms "removably engaged" or "removably attached" as used herein (unless otherwise noted or clear from the context) mean that the two "engaged" or "attached" objects are designed to be repeatedly "engaged/disengaged" and/or "attached/unattached" to one another without damaging either object or structures with which those objects are engaged. In other words, the terms "removably engaged" and/or "removably attached" mean that the two "engaged" or "attached" objects are "non-destructibly removable" and/or releasable from one another.

This application and/or claims use the adjectives, e.g., "first," "second," "third," and the like, to identify certain components and/or features relating to this technology. These adjectives are used merely for convenience, e.g., to assist in maintaining a distinction between components and/or features of a specific structure. Use of these adjectives should not be construed as requiring a specific order or arrangement of the components and/or features being discussed. Also, use of these specific adjectives in the specification for a specific structure does not require that the same adjective be used in the claims to refer to the same part (e.g., a component or feature referred to as the "fourth" in the specification may correspond to any numerical adjective used for that component or feature in the claims).

Various structures and parameters of articles of footwear and sole structures therefor are described based on a "longitudinal length" parameter L. The longitudinal length L can be found with the article of footwear and/or sole structure oriented on a horizontal support surface on its ground-facing surface in an unloaded condition (e.g., with no weight applied to it other than weight of other components of the article of footwear and/or sole structure). Once so oriented, parallel vertical planes that are perpendicular to the horizontal support surface are oriented to contact the rearmost heel location(s) and forwardmost toe location(s) of the article of footwear and/or sole structure. The parallel vertical planes should be oriented facing one another, as far away from one another as possible while still in contact with the rearmost heel and forwardmost toe locations. The direct distance between these vertical planes corresponds to the length (e.g., a longitudinal length) L of the article of footwear and/or sole structure. The locations of some footwear components are described in this specification based on their respective locations along the length as measured forward from the rear heel vertical plane. The rearmost heel location(s) is (are) located at position 0L and the forwardmost toe location(s) is (are) located at position 1L along the sole length L. Intermediate locations along the sole length L are referred to by fractional locations (e.g., 0.25L) along the sole length L measured forward from the rear heel vertical plane. The term "parallel planes" as used herein are planes oriented parallel to the vertical planes. These parallel planes may intersect the longitudinal length or longitudinal direction somewhere between P=0L and P=1.0L.

The term "rearward" as used herein means at or toward the heel region of the article of footwear (or component thereof), and the term "forward" as used herein means at or toward a forefoot or forward toe region of the article of footwear (or component thereof). Unless otherwise defined, the terms "heel" or "heel region" refer to a region bounded by parallel planes at 0L and 0.3L, the term "midfoot" or "arch" refers to a region bounded by parallel planes at 0.3L and 0.6L, and the term "forefoot" refers to a region bounded by parallel planes at 0.6L and 1.0L. Also, the term "lateral" means the "little toe" side of an article of footwear or component thereof (e.g., an upper, a sole structure, etc.), and the term "medial" means the "big toe" side of an article of footwear or component thereof (e.g., an upper, a sole structure, etc.).

I. General Description of Aspects of this Technology

Articles of footwear in accordance with some aspects of this technology include a simple construction that includes three main parts, with each made from a single material and fit together in a releasable manner. Aspects of this technology may enhance the recyclability and sustainable nature of the article of footwear and its component parts.

At least some more specific aspects of this technology relate to articles of footwear that may include three main parts: (a) an outer cage, which may include a single piece having features of: (i) a footwear upper and (ii) a sole structure having one or more cleat outer shells; (b) an inner upper component; and (c) a chassis and heel counter component with a bottom surface thereof that includes one or more cleat inserts and supports that fit inside the one or more cleat outer shells.

Some additional or alternative aspects of this technology relate to a footwear structure consisting essentially of: an outer cage component, an inner upper component, and a foot support component. The outer cage component may be formed as a unitary, one-piece construction that may include: (i) an outsole portion including a first cleat shell and a second cleat shell separate from the first cleat shell, and (ii) an upper portion. The outer cage component may define an interior chamber. The interior chamber may include a footbed portion formed by an interior surface of the outsole portion. The footbed portion may include a first recess extending into an interior of the first cleat shell and defining a first undercut within the interior of the first cleat shell and a second recess extending into an interior of the second cleat shell and defining a second undercut within the interior of the second cleat shell. The inner upper component may be formed as a unitary, one-piece construction that defines a foot-receiving chamber including a bottom surface, a heel-containing region, a midfoot-containing region, and a forefoot-containing region. The inner upper component may be formed of a fabric material. The bottom surface may include a first opening at least partially aligned with the first recess and a second opening separated from the first opening and at least partially aligned with the second recess. The foot support component may be formed as a unitary, one-piece construction that includes: (i) a first surface for supporting an entire plantar surface of a wearer's foot and (ii) a second surface opposite the first surface. The second surface may include a first cleat insert extending into the first recess and a second cleat insert extending into the second recess. The first cleat insert may include a first enlarged free end positioned to engage the first undercut and secure the first cleat insert within the first recess. The second cleat insert may include a second enlarged free end positioned to engage the second undercut and secure the second cleat insert within the second recess. The foot support component may be received within the foot-receiving chamber of the inner upper component. The first cleat insert may extend through the first opening and the second cleat insert may extend through the second opening.

Still additional or alternative aspects of this technology relate to a footwear structure comprising: an outer cage component, an inner upper component, and a foot support component. The outer cage component may be formed as a unitary, one-piece construction that includes: (i) an outsole portion including a plurality of cleat shells, and (ii) an upper portion. The outer cage component may define an interior chamber. The interior chamber may include a footbed portion formed by an interior surface of the outsole portion. The footbed portion may include a plurality of recesses. Each of the plurality of recesses may extend into an interior of each of the plurality of cleat shells and define an undercut within the interior of each of the plurality of cleat shells. The inner upper component may be formed as a unitary, one-piece construction that defines a foot-receiving chamber including a bottom surface, a heel-containing region, a midfoot-containing region, and a forefoot-containing region. The inner upper component may be formed of a fabric material. The bottom surface may include a plurality of openings. Each of the plurality of openings may be at least partially aligned with a respective one of the plurality of recesses. The foot support component may be formed as a unitary, one-piece construction that includes: (i) a top surface for supporting an entire plantar surface of a wearer's foot and (ii) a bottom surface opposite the top surface. The bottom surface may include a plurality of cleat inserts. Each of the plurality of cleat inserts may extend into a respective one of the plurality of recesses. Each of the plurality of cleat inserts may include an enlarged free end positioned to engage a respective undercut and secure each of the plurality of cleat inserts within a respective one of the plurality of recesses. The foot support component may be received within the foot-receiving chamber of the inner upper component. Each of the plurality of cleat inserts may extend through a respective one of the plurality of openings.

Alternatively, some aspects of this technology relate to footwear component structures and/or articles of footwear of the types described above in which the components according to any of the examples described above are permanently engaged with one another (e.g., by adhesives or cements, by mechanical fasteners, etc.).

Still additional aspects of this technology relate to methods of making footwear component structures and/or articles of footwear of the various types described above as well as to methods of using footwear component structures and/or articles of footwear of the types described above (e.g., by attaching and detaching the foot support component from the outer cage component, by attaching and detaching the sole structure (or at least a portion thereof) from a footwear upper component, by interchanging different outsole components on a midsole structure, by interchanging different midsole structures on an outsole component, by interchanging different sole structures on an upper component, by interchanging different upper components on a sole structure, etc.).

Given the general description of features, examples, aspects, structures, processes, and arrangements according to certain examples of this technology provided above, a more detailed description of specific example footwear component structures, articles of footwear, and/or methods in accordance with this technology follows.

II. Detailed Description of Example Articles of Footwear, Footwear Component Structures, and Other Components/Features/Methods According to Aspects of this Technology Referring to the figures and following discussion, examples of footwear component structures and articles of footwear in accordance with aspects of this technology are described. The article of footwear 10 of FIG. 1 includes an outer cage component 100, an inner upper component 160, and a foot support component 200. Each of the outer cage component 100, inner upper component 160, and foot support component 200 may be formed as a unitary, one-piece construction and/or each made from a single material. The foot support component 200 may fit inside the inner upper component 160 and further the inner upper component 160 and the foot support component 200 together may fit inside the outer cage component 100. Once the foot support component 200 is fit inside the inner upper component 160, these combined components may be fit into an interior chamber 102 of the outer cage component 100.

In another embodiment, the foot support component 200 may fit inside the outer cage component 100 and further the inner upper component 160 may sit on top of the foot support component 200 and fit inside the outer cage component 100. Once the foot support component 200 is fit inside the outer cage component 100, the inner upper component 160 may be fit into an interior chamber 102 of the outer cage component 100 and sit on top of the foot support component 200.

In the figures, FIG. 2A provides a front, medial perspective view; FIG. 2B provides a rear, medial perspective view; FIG. 2C provides a top view; FIG. 2D provides a top, lateral perspective view; and FIG. 2E provides a bottom, medial perspective view of an outer cage component 100 of an article of footwear 10 in accordance with some examples of this technology. Further, FIG. 2F provides a sectional view from FIG. 2C along line A-A of the outer cage component 100 of an article of footwear in accordance with some examples of this technology.

The outer cage component 100 may include an upper portion 120 and a sole structure 140 engaged with the upper portion 120. In some examples, the upper portion 120 and sole structure 140 may be formed as a single part (as a unitary, one-piece structure). The upper portion 120 may also be referenced as an "upper." The sole structure 140 may also be referenced as an "outsole portion." The upper portion 120 (which may be formed from one or more parts), potentially together with the sole structure 140, defines a foot-receiving interior chamber 102 for containing a wearer's foot.

As further illustrated in FIGS. 2A-2F, the upper portion 120 of outer cage component 100 may include other components engaged with or integrally formed with the upper portion 120. For example, the upper portion 120 may include a tongue member 122 located across the foot instep area and positioned to moderate the feel of the footwear's closure system on the wearer's foot. The upper 120 may also include a heel counter, a toe cap, or securing straps. Additionally, the upper portion 120 may include a closure system (e.g., including one or more of a lace type closure system, a zippered closure system, a buckle type closure system, elastic stretch elements, etc.). The closure system may include, as illustrated, a plurality of lace engaging openings 124. The article of footwear 10 may further include one or more lace elements extending through the lace engaging openings 124. In the illustrated example, a lace element may extend over the tongue member 122 (for example, in a crisscrossed manner), passing through one or more lace engaging openings 124L, 124M located at a lateral side and a medial side of an instep portion of the upper portion 120 (and/or adjacent a lateral side and a medial side of the instep opening). The lace elements may include a tightening mechanism and/or lock mechanism. The lock mechanism may be located at a rear heel area of the upper portion 120. Further, the upper portion 120 may include a collar 126 extending around opening 102.

As illustrated in FIGS. 2A, 2B, 2E, and 2F, the sole structure 140 of the outer cage 100 may include a plurality of cleats members 142 extending from a sole base surface 144 of the sole structure 140. FIG. 2H provides an enlarged view of a cleat member 142 that may be provided in the encircled area labeled "2H" in FIG. 2F. As illustrated, the cleat members 142 of this example may be permanently fixed to the sole base surface 144 of the sole structure 140 with respect to their respective base members 146 (e.g., by molding, in-molding, rapid manufacturing additive fabrication techniques, or the like). The base member 146 may be in the shape of a frustoconical curved surface around the cleat members 142. The base member 146 forms an exterior cleat surface for directly engaging the ground (or other contact surface).

While other numbers and/or arrangements of cleat elements are possible, this example sole structure 140 includes twelve cleat members 142*a*, 142*b*, 142*c*, 142*d*, 142*e*, 142*f*, 142*g*, 142*h*, 142*i*, 142*j*, 142*k*, 142*l*. A first set of four cleat members 142*a*, 142*b*, 142*c*, 142*d* may be located at the rear heel area of the sole structure 140, with two cleat members 142*a*, 142*b* located on the medial (inside) of the rear heel area of the sole structure 140 and two cleat members 142*c*, 142*d* located on the lateral (outside) of the sole structure 140.

Additionally, a second set of four cleat members 142*e*, 142*f*, 142*g*, 142*h* and a third set of four cleat members 142*i*, 142*j*, 142*k*, 142*l* may be provided in the midfoot area and/or forefoot area (e.g., beneath the metatarsal head and/or toe areas of a wearer's foot) of the sole structure 140. The second set of four cleat members 142*e*, 142*f*, 142*g*, 142*h* may be located on the lateral (outside) of the midfoot area and/or forefoot area of the sole structure 140. The third set of four cleat members 142*i*, 142*j*, 142*k*, 142*l* may be located on the medial (inside) of the midfoot area and/or forefoot area of the sole structure 140. Various numbers and sets of cleat members 142 may be provided and located at the various locations along the sole structure 140, such as at the heel area, midfoot area, and/or forefoot area of the sole structure 140 and/or along the lateral (outside) and/or medial (inside) of the sole structure 140.

The illustrated cleat members 142 of this example may have similar structures (albeit potentially with somewhat different sizes and/or shapes). Those skilled in the art will understand, given the benefit of this disclosure, that cleat members 142 may have similar structures, features and/or properties. The cleat members 142 may have any desired sizes or dimensions in accordance with this technology. For forefoot type cleat members 142*e*, 142*f*, 142*g*, 142*h*, 142*i*, 142*j*, 142*k*, 142*l* of the type described above, the height of the cleat member 142 or largest dimension (from and in a direction away from the sole base surface 144), $H_{Cleat}$, may be at least 5 mm (e.g., in the range of 2 mm to 20 mm), and in some examples, at least 10 mm high, or even at least 14 mm high. For heel type cleat members 142*a*, 142*b*, 142*c*, 142*d* of the type described above, the height of the cleat member 142 or largest dimension (from and in a direction away from the sole base surface 144), $H_{Cleat}$, may be at least 20 mm (e.g., in the range of 15 mm to 30 mm), and in some examples, at least 23 mm high, or even at least 25 mm high.

As further illustrated in FIGS. 2B, 2C, 2D, and 2F, the sole structure 140 and the interior chamber 102 of the outer cage component 100 may include a footbed portion 148 of the sole structure 140. The footbed portion 148 may extend along the medial and lateral sides from the toe to the heel of the sole structure 140. The footbed portion 148 may include one or more cleat outer shells 150. The cleat outer shells 150 may be defined by holes in the interior chamber 102 and footbed portion 148 of the outer cage component 100, so that the interior of the cleat members 142 are hollowed out, thereby forming the cleat outer shells 150. For each cleat outer shell 150, the footbed portion 148 may also include a recess 152 extending into an interior of the cleat outer shell 150. The recess 152 may be located circumferentially around the cleat outer shell 150 on the footbed portion 148. Further, each cleat outer shell 150 may include an undercut portion 154 within the interior of the cleat outer shell 150. See also FIGS. 2G and 2H. The interior surface defined by recess 152 may form a closed end having an enlarged or "bulbous" structure beneath the undercut portion. The undercut portion 154 provides a "stop surface" within the interior of the cleat outer shell 150 that engages with and/or cooperates with the cleat inserts 222 as will be explained and detailed below.

An exterior surface of the cleat member 142 may define a volume of 4,000 $mm^3$ or less. For example, the volume defined by the exterior surface of the cleat member 142 may be within a range of approximately 500 $mm^3$ to 4,000 $mm^3$, or in some examples, between 700 $mm^3$ and 3,500 $mm^3$, or between 800 $mm^3$ and 2,700 $mm^3$.

An interior surface of the cleat outer shell 150 or the recess 152 may define a volume of 1,500 $mm^3$ or less. For example, the volume of interior surface of the cleat outer shell 150 or the recess 152 may be within a range of approximately 300 $mm^3$ to 1,500 $mm^3$, or in some examples, between 400 $mm^3$ and 1,000 $mm^3$, or between 450 $mm^3$ and 900 $mm^3$.

The upper portion 120 and the sole structure 140 may be a one-piece construction. Alternatively, if desired, the upper portion 120 and the sole structure 140 may be engaged together in any desired manner (such as by one or more of adhesives or cements, stitching or sewing, mechanical connectors, etc.), including in manners conventionally known and used in the footwear arts. This would enable the upper portion 120 and sole structure 140 to still be separated, e.g., for recycling purposes.

The upper portion 120 may be made from any desired material(s) and/or in any desired constructions and/or manners without departing from this technology. As some more specific examples, all or at least a portion of the upper portion 120 (and optionally a majority, substantially all, or even all of the upper portion 120) may be formed as a woven textile component, a knitted textile component, another textile component, a natural leather component, a synthetic leather component, a polymeric component (e.g., a TPU, etc.), a plastic component, etc. The component(s) for upper portion 120 may have structures and/or constructions like those used in footwear products commercially available from NIKE, Inc. of Beaverton, OR and/or other manufacturers, including conventional structures and constructions as are known and used in the art.

Additionally or alternatively, if desired, the upper portion 120 construction may include foot securing and engaging structures (e.g., "dynamic" and/or "adaptive fit" structures), e.g., of the types described in U.S. Patent Appln. Publn. No. 2013/0104423, which publication is entirely incorporated herein by reference. As some additional examples, if desired, upper portions 120 and articles of footwear 10 in accordance with this technology may include foot securing and engaging structures of the types used in footwear products commercially available from NIKE, Inc. of Beaverton, Oregon. These types of wrap-around and/or adaptive or dynamic fit structures may at least partially wrap around and securely hold the wearer's foot.

As yet another alternative or additional feature, if desired, upper portions 120 and articles of footwear 10 in accordance with at least some examples of this technology may include fused layers of upper materials, e.g., uppers of the types that include upper materials bonded by hot melt or other adhesive materials, such as in footwear products commercially available from NIKE, Inc. of Beaverton, Oregon. As still additional examples, upper portions of the types described in U.S. Pat. Nos. 7,347,011 and/or 8,429,835 may be used without departing from this technology (each of U.S. Pat. Nos. 7,347,011 and 8,429,835 is entirely incorporated herein by reference).

FIGS. 3A-3C illustrate alternate embodiments for the outer cage component 100. FIG. 3A provides a front, lateral perspective view of a first alternate embodiment of an outer cage component 300A in accordance with some examples of this technology. FIG. 3B provides a front, lateral perspective view of another alternate embodiment of an outer cage component 300B in accordance with some examples of this technology. FIG. 3C provides a front, medial perspective view of another alternate embodiment of an outer cage component 300C in accordance with some examples of this technology.

As illustrated in FIG. 3A, this outer cage component 300A includes a variety of holes 301A with various different sizes and shapes, such as ovals, circles, triangular shapes, and rectangular shapes. Holes having shapes and sizes not shown in FIG. 3A may be utilized for the outer cage component 300A. Additionally, the variety of holes 301A may be located throughout the outer cage component 300A, such as on the upper portion, the medial side, the lateral side, the toe portion, the heel portion, and/or the tongue portion. The variety of holes 301A may be utilized for various benefits, such as providing breathability, flexibility, weight reduction, etc., while providing strength to the outer cage component 300A and the overall article of footwear 10. Also, holes 301A may be provided or omitted at specific local areas of the outer cage component 300A, e.g., to control the properties (e.g., breathability, flexibility, etc.) at that local area.

As illustrated in FIG. 3B, this outer cage component 300B includes a pattern of holes 301B with each of the holes substantially the same size and shape, e.g., oval shaped. The pattern of holes 301B of the outer cage component 300B may define a linear pattern both horizontal and vertical along the upper portions of the outer cage component 300B. Other patterns may define the pattern of holes 301B along the outer cage component 300B, such as diagonal, circular, matrix, etc. The holes as illustrated in FIG. 3B are generally defined by smaller ovals. Other sizes and shapes of holes may define the pattern of holes 301B along the outer cage component 300B. The pattern of holes 301B may be located along an upper portion of the outer cage component 300B to include the heel and midfoot portion and not along the toe portion (as illustrated in FIG. 3B). The pattern of holes 301B may also be located at various other locations along the outer cage component 300B, such as on the upper portion, the medial side, the lateral side, the toe portion, the heel portion, and/or the tongue portion. The variety of holes 301A may be utilized for various benefits, such as providing breathability, flexibility, weight reduction, etc., while providing strength to the outer cage component 300B and the overall article of footwear 10. Also, holes 301B may be provided or omitted at specific local areas of the outer cage component 300B, e.g., to control the properties (e.g., breathability, flexibility, etc.) at that local area.

As illustrated in FIG. 3C, this outer cage component 300C includes a variety of chords 301C extending around the base of the outer cage component 300C. The variety of chords 301C may extend at various angles around any of the various locations of the outer cage component 300C, such as extending around the upper portion, the sole structure, the medial side, the lateral side, the toe portion, the heel portion, and/or the tongue portion. The variety of chords 301C may intersect other chords or they may not intersect with the other chords. The variety of chords 301C may be utilized for various benefits, such as strength, stretch resistance, etc., along the outer cage component 300C and the overall article of footwear 10.

Example articles of footwear 10, an inner upper component 160, and components thereof now will be described in more detail in conjunction with FIG. 4. The inner upper component 160 may be formed as a unitary, one-piece construction that defines a foot-receiving chamber 162. The inner upper component 160 may include bottom surface 164, a heel-containing region 166, a midfoot-containing region 168, and a forefoot-containing region 170. The inner upper component 160 may be formed of a fabric material, such as a knit fabric component (e.g., having a sock-like structure). Further, the bottom surface 164 of the inner upper component 160 may include a plurality of openings 172. Each of the plurality of openings 172 on the inner upper component 160 may at least partially align with each of the recesses 152 and cleat outer shell 150 of the footbed portion 148 of the sole structure 140 on the outer cage component 100.

Example articles of footwear 10, a foot support component 200, and components thereof now will be described in more detail in conjunction with FIGS. 5A-5D. FIG. 5A provides a top, medial perspective view; FIG. 5B provides a front, lateral perspective view; and FIG. 5C provides a bottom perspective view of a foot support component 200 in accordance with some examples and aspects of this technology. FIG. 5D provides an enlarged view of a cleat insert 222 of the foot support component 200 that may be provided in the encircled area labeled "5D" from FIG. 5C in accordance with some examples and aspects of this technology.

The foot support component 200 may include a chassis and heel counter component with a bottom surface thereof that includes one or more cleat inserts 222 that fit inside the one or more cleat outer shells 150. The foot support component 200 may be formed as a unitary, one-piece construction that includes both a first (top) surface 210 and a second (bottom) surface 220 opposite the first surface 210. The first surface 210 may be utilized for supporting an entire plantar surface of a wearer's foot (or at least some portion thereof). The second surface 220 may include a plurality of flexible cleat inserts 222.

As illustrated in FIGS. 5A-5C, the top surface 210 may include a top panel 212 and a heel support 214 provided around the heel area of the foot support component 200. The heel support 214 may provide additional support for the heel area of a wearer's foot (e.g., akin to a heel counter structure). As illustrated in FIGS. 5A and 5B, the top panel 212 may include a lateral rim 212L and a medial rim 212M. The lateral rim 212L may extend from the top panel 212 around at least a portion of the perimeter of the lateral side of the foot support component 200. The medial rim 212M may extend from the top panel 212 around at least a portion of the perimeter of the medial side of the foot support component 200. Additionally, the top panel 212 may include a toe rim 212T that extends from the top panel 212 and around at least a portion of the top perimeter of the toe area of the foot support component 200.

The top panel 212 may also include recesses 216. As shown in FIGS. 5A and 5B, the recesses 216 of this example include a plurality of polygons, specifically hexagons (although other shapes may be used), distributed on the top panel 212. As shown, the recesses 216 may be provided along the heel area and the mid-foot area of the top panel 212 and the foot support component 200. The recesses 216 may also include other shapes, such as other polygons, shapes, ridges, dimples, circles, stars, or through holes. The recesses 216 may also extend along other portions of the top panel 212 and the foot support component 200, such as along the toe area, the mid-foot area, and/or the heel area or any combination thereof these areas. The recesses 216 may provide "gripping structures" (e.g., for engaging and help prevent slipping of a wearer's foot within the article of footwear 10, for preventing an interior footwear component, such as an insole provided within the foot support component 200 from moving within the footwear interior), may provide flexibility (e.g., to assist in inserting the foot support component 200 into inner upper component 160 and/or the outer cage component 100), and/or may reduce weight of the foot support component 200.

The heel support 214 may constitute a heel counter structure 218, e.g., to limit or control movement of the heel. The heel counter structure 218 may be an integrally formed structure with the foot support component 200. The heel counter structure 218 may include a heel counter lateral sidewall 218L, a heel counter medial sidewall 218M, and a heel counter rear sidewall 218R formed between the heel counter lateral sidewall 218L and the heel counter medial sidewall 218M. As illustrated in FIGS. 5A and 5B, the heel counter structure 218 may be a full and closed counter structure at the rear heel area. In other embodiments as will be explained further below, the heel counter structure 218 may include structures with openings or grooves around the heel area.

FIG. 5C illustrates the second (bottom) surface 220 and the foot support component 200 with a plurality of flexible cleat inserts 222. While other numbers and/or arrangements of cleat inserts 222 are possible, this example second surface 220 of the foot support component 200 includes twelve cleat inserts. Similar to the cleat members 142 as detailed above, the second surface 220 of the foot support component 200 includes twelve cleat inserts 222*a*, 222*b*, 222*c*, 222*d*, 222*e*, 222*f*, 222*g*, 222*h*, 222*i*, 222*j*, 222*k*, 222*l*. A first set of four cleat inserts 222*a*, 222*b*, 222*c*, 222*d* may be located on the rear heel area of the second surface 220 of the foot support component 200. Two cleat inserts 222*a*, 222*b* may be located on the medial (inside) of the rear heel area of the second surface 220 of the foot support component 200 and two cleat inserts 222*c*, 222*d* may be located on the lateral (outside) of the second surface 220 of the foot support component 200.

Additionally, a second set of four cleat inserts 222*e*, 222*f*, 222*g*, 222*h* and a third set of four cleat members 222*i*, 222*j*, 222*k*, 222*l* may be provided in the midfoot area and/or forefoot area (e.g., beneath the metatarsal head and/or toe areas of a wearer's foot) of the second surface 220 of the foot support component 200. The second set of four cleat inserts 222*e*, 222*f*, 222*g*, 222*h* may be located on the lateral (outside) of the midfoot area and/or forefoot area of the second surface 220 of the foot support component 200. The third set of four cleat inserts 222*i*, 222*j*, 222*k*, 222*l* may be located on the medial (inside) of the midfoot area and/or forefoot area of the second surface 220 of the foot support component 200.

The flexible cleat inserts 222 may at least partially align with each of the cleat members 142, recesses 152, and cleat outer shells 150 of the sole structure 140 on the outer cage component 100. The flexible cleat inserts 222 may be sized, shaped, and located for one cleat insert 222 to fit into and extend into one cleat member 142 and recess 152 of the cleat outer shell 150. In another embodiment, two or more cleat inserts 222 may be sized, shaped, and located to fit into and extend into one cleat member 142 and recess 152 of the cleat outer shell 150.

As illustrated specifically in FIGS. 5C and 5D, the flexible cleat inserts 222 may include an enlarged free end 224 extending from a cleat arm 226. The free end 224 may be positioned to engage the undercut portion 154 within the interior of the cleat outer shell 150 and secure the cleat insert 222 within the recess 152 of the cleat outer shell 150. Further, the free end 224 of the example flexible cleats inserts 222 may have four "fin-type" enlarged cleat components 224*a*-224*d* arranged around an intersection of two flex grooves or slits 223*a*, 223*b* (e.g., with one separate cleat component 224*a*-224*d* provided in each quadrant or sector around the flex grooves or slits 223*a*, 223*b*). Other flexible cleat structures and arrangements are possible without departing from this invention. For example, a flexible cleat insert 222 may include three cleat components arranged around a "capital T-shaped" junction or intersection of two flex grooves (either or both of the flex grooves may have curvature, if desired). As another example, a flexible cleat insert 222 may include three cleat components 224*a*-224*c* arranged around a "capital Y-shaped" junction or intersection of three flex grooves, e.g., arranged at any desired angles (one or more of these flex grooves may have curvature, if desired). While other specific shapes and arrangements are possible, cleat components may have shapes similar to the fin-type enlarged cleat components 224*a*-224*d* described above (and may have any of the various specific structural features and/or options described above for enlarged cleat components 224*a*-224*d*). In another example, a cleat component with more of a T-shaped structure, may have a structure akin to two adjacent cleat components pushed together so that one extended wall or side faces the groove. The illustrated cleat inserts 222 of this example may have similar structures (albeit potentially with somewhat different sizes and/or shapes). Those skilled in the art will understand that cleat inserts 222 may have similar structures, features and/or properties. The cleat inserts 222 may have any desired sizes, shapes, or dimensions in accordance with this technology.

FIGS. 5E-5H illustrate alternate embodiments for flexible cleat structures and arrangements and interaction of a cleat insert 222 and a cleat member 142. FIGS. 5E and 5F illustrate an elongated rectangular-shaped cleat insert 222 and a corresponding elongated rectangular-shaped cleat member 142. FIGS. 5G and 5H illustrate an elongated rectangular-shaped cleat insert 222 with a slit 223 and a corresponding elongated rectangular-shaped cleat member 142. The cleat member 142 may include a recess with the cleat outer shell formed to include an undercut portion. The cleat insert 222 may include an enlarged end 224 that extends into the recess. As the cleat insert 222 is pushed into the recess, the enlarged end 224 may push past the undercut portion into the recess to lock and hold the cleat insert 222 in the cleat member 142 within the recess and the cleat outer shell. For the cleat insert 222 with a slit 223 from FIGS. 5G and 5H, the cleat insert 222 may resiliently spring back (splay outward) to enlarge, hold, and lock the cleat insert 222 in the cleat member 142 within the recess and the cleat outer shell. Other shapes of cleat inserts 222 and cleat members 142 may be utilized without departing from the invention. Various dimensions may be utilized with the cleat insert 222 and the cleat member 142 as illustrated in FIGS. 5E and 5H. For example, the inner cleat insert 222 may be approximately 2 mm wide by approximately 7 mm tall. The inner cleat insert 222 may also be within a range of approximately 1-3 mm wide by approximately 5-9 mm tall without departing from the inventions. Additionally, the cleat member 142 may include a wall thickness of approximately 0.8 mm, or within a range of 0.5-2.5 mm thickness, or within a range of 0.5-1.5 mm thickness. For example, an overhang of the enlarged end 224 on the cleat insert 222 may be approximately 0.5 mm, or within a range of 0.2-0.8 mm. The enlarged end 224 may be approximately 0.8 mm tall, or within a range of 0.5-1.5 mm tall. Other dimensions may be utilized as these dimensions are examples.

Example articles of footwear 10 and components thereof now will be described in more detail in conjunction with FIGS. 6A-6C and 7A-7B. FIG. 6A provides a top view; FIG. 6B provides a sectional view along line C-C from FIG. 6A; and FIG. 6C provides a sectional view along line D-D from FIG. 6B of the article of footwear 10 in accordance with some examples and aspects of this technology.

FIGS. 6A and 6B illustrate an exemplary article of footwear 10 with all of the components together to include the outer cage component 100, the inner upper component 160, and the foot support component 200. As illustrated, the foot support component 200 may fit inside the inner upper component 160. Further, the inner upper component 160 and the foot support component 200 together may fit inside the outer cage component 100. Once the foot support component 200 is fit inside the inner upper component 160, the combined components of the foot support component 200 and the inner upper component 160 may be fit into an interior chamber 106 of the outer cage component 100. The foot support component 200 may be oriented so that cleat inserts 222 extend through respective openings in the inner upper component 160 and into respective recesses 152 of cleat outer shells 150. In at least some examples of this technology, a separate insole component, interior midsole component, or other comfort-enhancing component may be provided over the top surface 210 of the foot support component 200, e.g., to prevent direct contact between the foot support component 200 and the wearer's foot.

FIG. 6C illustrates the enlarged free end 224 of the cleat insert 222 of foot support component 200 fitting inside and engaging with the cleat outer shell 150 and the undercut portion 154 of the cleat outer shell 150 on the outer cage component 100. FIG. 7A provides a rear perspective cutaway view of the article of footwear 10 highlighting the engagement between the cleat insert 222 of the foot support component 200 and the cleat outer shell 150 of the outer cage component 100. FIG. 7B provides an enlarged view of the cleat insert 222 of the foot support component 200 engaged with the cleat outer shell 150 of the outer cage component 100 from the encircled area labeled "7B" in FIG. 7A.

As illustrated in the above views, the recesses 152 of the cleat outer shells 150 are formed to include an undercut portion 154 (e.g., the undercut portion 154 providing an opening to a bulbous closed end of the recess 152), and the cleat inserts 222 include an enlarged end 224 (e.g., a bulbous free end), e.g., formed with enlarged cleat components 224*a*-224*d* that extend into the recesses 152. The flexible grooves or slits 223*a*, 223*b* in the cleat insert 222 may narrow with the enlarged cleat components 224*a*-224*d* moving inward towards the flexible grooves or slits 223*a*, 223*b* as the cleat insert 222 is being pushed past the undercut portion 154 into the recess 152 and toward the closed end of the cleat outer shell 150. Once the enlarged cleat components 224*a*-224*d* of the cleat insert 222 pass beyond the undercut portion 154, the enlarged cleat components 224*a*-224*d* of the cleat insert 222 may resiliently spring back (splay outward) to enlarge the flexible grooves or slits 223*a*, 223*b* and hold the cleat insert 222 within the cleat outer shells 150. The bulbous free end of the cleat insert 222 formed by the enlarged cleat components 224*a*-224*d* extends into the bulbous closed end of the recess 152 and will contact the undercut portion 154 to prevent the cleat insert 222 from easily pulling out of the recess 152. The cleat insert 222 also may provide interior reinforcement or support for the overall cleat construction (e.g., helps prevent the cleat outer shell 150 from collapsing under applied force to the ground). Other spring elements or biasing components may be provided to help the enlarged cleat components 224*a*-224*d* (or other retaining structures) spring back to their enlarged spacing to providing this engagement feature.

The outer cage component 100 and/or the foot support component 200 may include a rigid plastic material. For example, the rigid plastic material may include one or more (combination) of the following: thermoplastic polyurethane (TPU), polyurethane, nylon, acrylic or polymethyl methacrylate (PMMA), polycarbonate (PC), polyethylene (PE), polypropylene (PP), polyethylene terephthalate (PETE or PET), polyvinyl chloride (PVC), or acrylonitrile-butadiene-styrene (ABS). Other rigid plastic materials may be utilized for the outer cage component 100 and/or the foot support component 200. The outer cage component 100 and/or the foot support component 200 may be made of other materials similar to and having similar material properties to rigid plastic materials. Various thicknesses and hardness properties may be utilized for the outer cage component 100 and/or the foot support component 200.

In at least some examples of this technology, the volume defined by the interior surface of the recess 152 ($V_{RES}$) and the volume defined by the outer surface of the cleat insert 222 ($V_{INS}$) within the recess 152 when fully inserted into the recess 152 may be substantially equal. As some more specific examples, ratio of $V_{INS}$:$V_{RES}$ may be within a range of 0.75 to 1, and in some examples, from 0.75 to 0.99, 0.75 to 0.95, 0.8 to 1, 0.8 to 0.99, or even 0.8 to 0.95. Additionally or alternatively, in at least some examples of this technology, at least 75% (and in some examples, at least 80%, at least 85%, at least 90%, at least 95%, or even at least 98%) of an exterior surface area of the cleat insert 222 within the insert may directly contact and/or lie immediately adjacent the interior surface of the recess 152. A tight fit with little extra open space within the recess 152 helps prevent undesired "play" or movement of the cleat inserts 222 within their respective recesses 152.

Further, in at least some examples of this technology, the cleat inserts 222 extending into their respective recesses 152 (e.g., the engagement of the free ends 224*a*-224*d* of cleat inserts 222 with the undercut surfaces 154) will be the only connector structures holding the foot support component 200 to the outer cage component 100 and/or to the remainder of the footwear structure. Additionally or alternatively, in at least some examples of this technology, the cleat inserts 222 extending into their respective recesses 152 (e.g., the engagement of the free ends 224*a*-224*d* of cleat inserts 222 with the undercut surfaces 154) will be the only connector structures holding the inner upper component 160 with the rest of the footwear structure (e.g., its only connection with the foot support component 200 and/or the outer cage component 100). Thus, the footwear structure of these examples may be very environmentally friendly and have improved sustainability, e.g., by avoiding use of adhesives. In other embodiments, the cleat inserts 222 may extend through and/or penetrate the cleat outer shells 150 and/or the cleat members 142.

When one or more of the components' useful life ends, one or more of the components of the article of footwear 10 may be pulled apart, such as by pulling the cleat inserts 222 out of the cleat outer shells 150. For example, the foot support component 200 and the cleat inserts 222 may be pulled out of the outer cage component 100 and cleat outer shells 150. The parts, such as the outer cage component 100, the inner upper component 160, and the foot support component 200 may then be easily recycled and replaced.

In the illustrated examples, there are twelve cleat inserts 222*a*, 222*b*, 222*c*, 222*d*, 222*e*, 222*f*, 222*g*, 222*h*, 222*i*, 222*j*, 222*k*, 222*l* that correspond to twelve cleat members 142*a*, 142*b*, 142*c*, 142*d*, 142*e*, 142*f*, 142*g*, 142*h*, 142*i*, 142*j*, 142*k*, 142*l* with twelve cleat outer shells 150 and twelve recesses 152. Each of the twelve cleat inserts 222*a*, 222*b*, 222*c*, 222*d*, 222*e*, 222*f*, 222*g*, 222*h*, 222*i*, 222*j*, 222*k*, 222*l* may engage the corresponding cleat member 142*a*, 142*b*, 142*c*, 142*d*, 142*e*, 142*f*, 142*g*, 142*h*, 142*i*, 142*j*, 142*k*, 142*l* and cleat outer shell 150. However, other numbers of cleat inserts 222 and cleat members 142 may be engaged and correspond with each other for the article of footwear 10. For example, one or more cleat inserts 222 may correspond and engage with one or more recesses 152 in the cleat outer shells 150. In another example, two cleat inserts 222 may correspond and engage with two recesses 152 in the cleat outer shells 150. In another example, three, four, or five cleat inserts 222 may correspond and engage with three, four, or five recesses 152 in the cleat outer shells 150. In another example, six, seven, or eight cleat inserts 222 may correspond and engage with six, seven, or eight recesses 152 in the cleat outer shells 150. In another example, nine, ten, or eleven cleat inserts 222 may correspond and engage with nine, ten, or eleven recesses 152 in the cleat outer shells 150. In another example, more than twelve cleat inserts 222 may correspond and engage with more than twelve recesses 152 in the cleat outer shells 150. Any of the cleat inserts 222 located throughout the foot support component 200, such as along the toe portion, heel portion, or midsection of the foot support component 200, may engage with a corresponding recess 152 in the cleat outer shell 150 located in the similar location along the outer cage component 100, along the toe, heel, or midsection of the outer cage component 100.

This type of removable engagement, when used, is advantageous because it allows individual replacement of parts (e.g., the outer cage component 100, the inner upper component 160, and/or the foot support component 200) and/or separation of parts (e.g., the outer cage component 100, the inner upper component 160, and/or the foot support component 200) for potential recycling purposes. Additionally or alternatively, this type of removable engagement, when used, is advantageous because it allows the user to create a customized shoe for the user, e.g., traction, cleat location, geometry of the shoe, geometry of the user's foot, position of the cleats, type of the cleats, and/or size of the cleats, etc. Additionally or alternatively, this type of removable engagement, when used, is advantageous because it allows the user to swap out the individual parts for other parts, e.g., depending on the activity to be conducted. More specifically, different outer cage components 100, inner upper components 160, foot support components 200, and/or combinations thereof may be used for different activities, e.g., to provide better traction, better support, and/or other desired characteristics for the specific activity. As an even more specific example, the same inner upper component 160 and foot support component 200 combination may be used (and switched between) two different outer upper components 100, e.g., one outer upper component 100 designed for football and another upper component 100 designed for baseball. Additionally or alternatively, different outer cage components 100, inner upper components 160, foot support components 200, and/or combinations thereof may be used based on a user's preferences at a specific time (e.g., for different colors and/or color combinations, etc.). Additionally or alternatively, the cleat inserts engaging their corresponding cleat shells may form the only means of fastening and attaching the shoe components together, such as for example, fastening and attaching the outer cage component, the inner upper component, and the foot support component together.

Conformable Heel Counter

Example articles of footwear 10, an alternative foot support component 800, and components thereof now will be described in more detail in conjunction with FIGS. 8A and 8B. FIG. 8A provides a side, medial perspective view; and FIG. 8B provides a rear, bottom perspective view of a foot support component 800 in accordance with some examples and aspects of this technology. The foot support component 800 may replace the foot support component 200 with the article of footwear 10 as described and detailed above. The foot support component 800 may include openings, voids, and/or grooves 840 around the heel area. These openings, voids, or grooves 840 may make the heel structure 814 and heel counter component 818 more conformable, lightweight, and/or flexible. The openings, voids, or grooves 840 may allow the heel or counter to conform better to the heel/foot of a user, providing and an "adaptive" response, adapting differently to different heels. The openings, voids, or grooves 840 may be customized within the heel counter component 818 based on the shape of the foot and/or heel of the user. These openings, voids, or grooves 840 may make it easier to fit the foot support component 800 into the inner upper component 160 and/or the outer cage component 100. Additionally or alternatively, these openings, voids, or grooves 840 may make the heel construction better to conform to the wearer's heel and better to contain and move with the wearer's heel, e.g., during use and to improve flexion, comfort, and fit.

The foot support component 800 may be formed as a unitary, one-piece construction that includes both a first (top) surface 810 and a second (bottom) surface 820 opposite the first surface 810. The foot support component 800 may include a chassis and heel counter component with the bottom surface 820 thereof that includes one or more cleat inserts 822 that fit inside the one or more cleat outer shells 150 of the outer cage component 100. The first surface 810 may be utilized for supporting an entire plantar surface of a wearer's foot (or at least some portion thereof).

As was described above, the flexible cleat inserts 822 may at least partially align with each of the cleat members 142, recesses 152, and cleat outer shells 150 of the footbed portion 148 of the sole structure 140 on the outer cage component 100. The flexible cleat inserts 822 may be sized, shaped, and located to fit into and extend into the cleat member 142 and recesses 152 of the cleat outer shells 150. The flexible cleat inserts 822 may include an enlarged free end 824 extending from a cleat arm 826. The free end 824 may be positioned to engage the undercut portion 154 within the interior recess 152 of the cleat outer shell 150 and secure the cleat insert 822 within the recess 152 of the cleat outer shell 150. Further, the free end 824 of the example flexible cleats inserts 822 may have four "fin-type" enlarged cleat components arranged around an intersection of two flex grooves or slits (e.g., with one separate cleat component provided in each quadrant or sector around the flex grooves or slits). While other specific shapes and arrangements are possible, cleat components may have shapes similar to the fin-type enlarged cleat components described above (and may have any of the various specific structural features and/or options described above for enlarged cleat components). Those skilled in the art will understand that cleat inserts 822 may have similar structures, features and/or properties. The cleat inserts 822 may have any desired sizes or dimensions without departing from this invention.

As illustrated in FIGS. 8A and 8B, the top surface 810 may include a top panel 812 and a heel support 814 provided around the heel area of the foot support component 800. The heel support 814 may provide additional support for the heel area of a wearer's foot. As illustrated in FIGS. 8A and 8B, the top panel 812 may include a lateral rim 812L and a medial rim 812M. The lateral rim 812L may extend from the top panel 812 around at least a portion of the perimeter of the lateral side of the foot support component 800. The medial rim 812M may extend from the top panel 812 around at least a portion of the perimeter of the medial side of the foot support component 800. Additionally, the top panel 812 may include a toe rim 812T that extends from the top panel 812 around at least a portion of the top perimeter of the foot support component 800 at the toe area. The top panel 812 also may include recesses 216, e.g., of the types described above in conjunction with FIGS. 5A and 5B.

The heel support 814 may constitute a heel counter structure 818 to limit or control movement of the heel. The heel counter structure 818 may be an integrally formed structure with the foot support component 800. The heel counter structure 818 may include a heel counter lateral sidewall 818L, a heel counter medial sidewall 818M, and a heel counter rear sidewall 818R formed between the heel counter lateral sidewall 818L and the heel counter medial sidewall 818M. Additionally or alternatively, heel counter structure 818 may be connected and/or engaged with the lace engaging openings 124 of the article of footwear 10, providing a structure that pulls and/or tightens the heel counter structure 818 against the user's heel.

Additionally, as referenced above, the heel counter structure 818 may include openings, voids, or grooves 840 around the heel area. The openings, voids, or grooves 840, 840A, 840B, 840C, 840D as described below and illustrated in FIGS. 8A-12B around the heel area in the heel counter structure 818 may be provided, at least in part, to enhance comfort for the wearer. Generally, if blisters or hot spots on a user's foot form on the heel, the blisters typically form in the rear heel or the lateral side of the rear heel. Thus, the surface area of the heel counter openings, voids, or grooves 840, 840A, 840B, 840C, 840D may be somewhat larger on the lateral side of the heel as compared to on the medial side of the heel of the central rear heel line of the heel counter structure 818. For example, the heel counter structure 818 may include a lateral side on the outside of a vertical line passing through the rearmost heel (RH) location and a medial side on the inside of that vertical line. The surface area ($A_{OL}$) (Area of Openings on Lateral side) of the openings, voids, or grooves 840, 840A, 840B, 840C on the lateral side of the heel counter structure 818 may be greater than the surface area ($A_{OM}$) (Area of Openings on Medial side) of the openings, voids, or grooves 840, 840A, 840B, 840C on the medial side of the heel counter structure 818. In some examples, $A_{OL}$=1.05 to 2×$A_{OM}$; or $A_{OL}$=1.1 to 1.9×$A_{OM}$; or $A_{OL}$=1.2 to 1.8×$A_{OM}$.

The openings, voids, or grooves 840 shown and illustrated in FIGS. 8A and 8B define a hub and spoke void 842. For example, the hub and spoke void 842 may include a central hub 844 located on the heel counter rear sidewall 818R. A plurality of spokes 846 may radiate from the central hub 844. The size of the central hub 844 may vary, e.g., including smaller or bigger circular shaped hubs. The spokes 846 may include a circular hole 848 at the end of the spoke 846. In other examples, the spokes 846 may include other shaped holes at the end of the spoke 846. In the example illustrated in FIGS. 8A and 8B, the hub and spoke void 842 may include eight spokes 846 radiating from the central hub 844 and eight circular holes 848 located at the end of the eight spokes 846. The eight spokes 846 may be spaced equidistant from each other around the central hub 844. The individual spokes 846 may be straight grooves with constant and/or varying widths. In other examples, the spokes 846 may be curved grooves. In other examples, the hub and spoke void 842 may include other numbers of spokes 846 radiating from the central hub 844, such as three spokes, four spokes, five spokes, six spokes, seven spokes, or nine or more spokes. In other examples, the spokes 846 may not be spaced equidistant from each other around the central hub 844. Additionally, in some examples, the spokes 846 may be the same length. In other example, the spokes 846 may be different lengths. The hub and spoke void 842 may be predominately located on the heel counter rear sidewall 818R, however the spokes 846 and holes 848 may extend into portions of the heel counter medial sidewall 818M and the heel counter lateral sidewall 818L.

The hub and spoke void 842 and the central hub 844 as illustrated in FIGS. 8A and 8B may define a surface area of approximately 1,500 $mm^2$ or less. For example, the surface area of the hub and spoke void 842 and the central hub 844 may be within a range of approximately 500 $mm^2$ to 1,500 $mm^2$, or in some examples, between 750 $mm^2$ to 1,250 $mm^2$, or between 900 $mm^2$ to 1,100 $mm^2$. Additionally, the central hub 844 alone as illustrated in FIGS. 8A and 8B may define a surface area of 100 $mm^2$ or less. For example, the surface area of the central hub 844 may be within a range of approximately 20 $mm^2$ to 150 $mm^2$, or in some examples, between 30 $mm^2$ to 100 $mm^2$, or between 40 $mm^2$ to 60 $mm^2$.

FIGS. 9A and 9B illustrate another example heel counter structure 818 with openings, voids, or grooves 840A. The openings, voids, or grooves 840A shown and illustrated in FIGS. 9A and 9B define a hub and spoke void 842A. For example, the hub and spoke void 842A may include a central hub 844A located on the heel counter rear sidewall 818R. A plurality of spokes 846A may radiate from the central hub

844A. The size of the central hub 844A may vary, e.g., including smaller or bigger circular shaped hubs. In the example illustrated in FIGS. 9A and 9B, the hub and spoke void 842A may include ten spokes 846A radiating from the central hub 844A. The ten spokes 846A may be spaced equidistant from each other from the central hub 844A. The individual spokes 846A may be straight grooves with constant and/or varying widths. In other examples, the spokes 846A may be curved grooves. In other examples, the hub and spoke void 842A may include other numbers of spokes 846A radiating from the central hub 844A, such as three spokes, four spokes, five spokes, six spokes, seven spokes, eight spokes, nine spokes, or eleven or more spokes. In other examples, the spokes 846A may not be spaced equidistant from each other around the central hub 844A. Additionally, in some examples, the spokes 846A may be the same length. In other example, the spokes 846A may be different lengths. The hub and spoke void 842A may be predominately located on the heel counter rear sidewall 818R, however the spokes 846A may extend into portions of the heel counter medial sidewall 818M and the heel counter lateral sidewall 818L.

The hub and spoke void 842A as illustrated in FIGS. 9A and 9B may define a surface area of 1,000 $mm^2$ or less. For example, the surface area of the hub and spoke void 842A may be within a range of approximately 300 $mm^2$ to 1,000 $mm^2$, or in some examples, between 400 $mm^2$ to 850 $mm^2$, or between 500 $mm^2$ to 700 $mm^2$.

FIGS. 10A and 10B illustrate another example heel counter structure 818 with openings, voids, or grooves 840B. The openings, voids, or grooves 840B shown and illustrated in FIGS. 10A and 10B define an opening 842B with a slit 844B (e.g., an upwardly extending slit). The opening 842B may be circular shaped and located on the heel counter rear sidewall 818R. The opening 842B may be other shapes in other example embodiments, such as oval, triangular, rectangular, square, etc. The slit 844B may extend upward from the opening 842B towards an upper portion of the heel counter rear sidewall 818R. The slit 844B may be various widths in other example embodiments.

The opening 842B and slit 844B as illustrated in FIGS. 10A and 10B may define a surface area of 1,500 $mm^2$ or less. For example, the surface area of the opening 842B and slit 844B may be within a range of approximately 500 $mm^2$ to 1,500 $mm^2$, or in some examples, between 750 $mm^2$ to 1,250 $mm^2$, or between 900 $mm^2$ to 1,100 $mm^2$.

FIGS. 11A and 11B illustrate another example heel counter structure 818 with openings, voids, or grooves 840C. The openings, voids, or grooves 840C shown and illustrated in FIGS. 11A and 11B define a hub and spoke void 842C. For example, the hub and spoke void 842C may include a central hub 844C located on the heel counter rear sidewall 818R. A plurality of spokes 846C may radiate from the central hub 844C. The size of the central hub 844C may vary, e.g., including smaller or bigger circular shaped hubs. In the example illustrated in FIGS. 11A and 11B, the hub and spoke void 842C may include eight spokes 846C radiating from the central hub 844C. The eight spokes 846C may be spaced equidistant from each other from the central hub 844C. The individual spokes 846C may be straight grooves with constant and/or varying widths. In other examples, the spokes 846C may be curved grooves. In other examples, the hub and spoke void 842C may include other numbers of spokes 846C radiating from the central hub 844C, such as three spokes, four spokes, five spokes, six spokes, seven spokes, or nine or more spokes. In other examples, the spokes 846C may not be spaced equidistant from each other around the central hub 844C. Additionally, in some examples, the spokes 846C may be the same length. In other example, the spokes 846C may be different lengths. The hub and spoke void 842C may be predominately located on the heel counter rear sidewall 818R, however the spokes 846C may extend into portions of the heel counter medial sidewall 818M and the heel counter lateral sidewall 818L.

The hub and spoke void 842C as illustrated in FIGS. 11A and 11B may define a surface area of 1,000 $mm^2$ or less. For example, the surface area of the hub and spoke void 842C may be within a range of approximately 300 $mm^2$ to 1,000 $mm^2$, or in some examples, between 400 $mm^2$ to 850 $mm^2$, or between 500 $mm^2$ to 700 $mm^2$.

FIGS. 12A and 12B illustrate another example heel counter structure 818 with openings, voids, or grooves 840D. The openings, voids, or grooves 840D shown and illustrated in FIGS. 12A and 12B define a groove 842D. For example, the groove 842D may extend from the heel counter medial sidewall 818M around the heel counter rear sidewall 818R to the heel counter lateral sidewall 818L. In the example illustrated in FIGS. 12A and 12B, the groove 842D extends in a continuous curve that extends multiple times between a bottom portion of the heel counter structure 818 and an upper portion of the heel counter structure 818. The groove 842D may be a continuous groove with plural local minima at the bottom portion of the heel counter structure 818 and plural local maxima at the top portion of the heel counter structure 818. Additionally or alternatively, the groove 842D may also be continuous groove with straight sides and distinct angular corners (e.g., providing substantially V-shaped corners). The groove 842D may consist of multiple portions of grooves. The groove 842D may extend along the heel counter structure 818 in various shapes and methods, such as a horizontal zig-zag shape, a wave shape, and other shapes and methods.

The groove 842D as illustrated in FIGS. 12A and 12B may define a surface area of 1,500 $mm^2$ or less. For example, the surface area of the groove 842D may be within a range of approximately 500 $mm^2$ to 1,500 $mm^2$, or in some examples, between 750 $mm^2$ to 1,250 $mm^2$, or between 900 $mm^2$ to 1,100 $mm^2$.

III. Conclusion

The present technology is disclosed above and in the accompanying drawings with reference to a variety of embodiments. The purpose served by the disclosure, however, is to provide an example of the various features and concepts related to the technology, not to limit its scope. One skilled in the relevant art will recognize that numerous variations and modifications may be made to the embodiments described above without departing from the scope of the present invention, as defined by the appended claims.

For the avoidance of doubt, the present application includes at least the subject matter described in the following numbered Clauses:

Clause 1. A footwear structure consisting essentially of:

an outer cage component formed as a unitary, one-piece construction that includes: (i) an outsole portion including a first cleat shell and a second cleat shell separate from the first cleat shell, and (ii) an upper portion, wherein the outer cage component defines an interior chamber, wherein the interior chamber includes a footbed portion formed by an interior surface of the outsole portion, the footbed portion including a first recess extending into an interior of the first cleat shell and defining a first undercut within the interior of the first cleat shell and a second recess extending into an interior of the second cleat shell and defining a second undercut within the interior of the second cleat shell;

an inner upper component formed as a unitary, one-piece construction that defines a foot-receiving chamber including a bottom surface, a heel-containing region, a midfoot-containing region, and a forefoot-containing region, wherein the inner upper component is formed of a fabric material, and wherein the bottom surface includes a first opening at least partially aligned with the first recess and a second opening separated from the first opening and at least partially aligned with the second recess; and a foot support component formed as a unitary, one-piece construction that includes: (i) a first surface for supporting an entire plantar surface of a wearer's foot and (ii) a second surface opposite the first surface, wherein the second surface includes a first cleat insert extending into the first recess and a second cleat insert extending into the second recess, wherein the first cleat insert includes a first enlarged free end positioned to engage the first undercut and secure the first cleat insert within the first recess, wherein the second cleat insert includes a second enlarged free end positioned to engage the second undercut and secure the second cleat insert within the second recess, and wherein the foot support component is received within the foot-receiving chamber of the inner upper component, wherein the first cleat insert extends through the first opening, and wherein the second cleat insert extends through the second opening.

Clause 2. The footwear structure according to Clause 1, wherein the foot support component includes an integrally formed heel counter.

Clause 3. The footwear structure according to Clause 1, wherein the outer cage component includes lace-engaging openings and the overall footwear structure further including a lace extending thru the lace-engaging openings.

Clause 4. The footwear structure according to Clause 1, wherein each of the first cleat insert and the second cleat insert includes one or more slits.

Clause 5. The footwear structure according to Clause 1, wherein each of the first enlarged free end and the second enlarged free end includes four enlarged cleat components.

Clause 6. The footwear structure according to Clause 1, wherein each of the first enlarged free end and the second enlarged free end includes three enlarged cleat components.

Clause 7. The footwear structure according to Clause 1, wherein the cleat inserts engaging their corresponding cleat shells form the only means of fastening the outer cage component, the inner upper component, and the foot support component together.

Clause 8. The footwear structure according to Clause 1, wherein an exterior surface of the first cleat shell defines a volume of 4,000 $mm^3$ or less.

Clause 9. The footwear structure according to Clause 1, wherein an exterior surface of the first cleat shell defines a volume within the range of 500 $mm^3$ to 4,000 $mm^3$.

Clause 10. The footwear structure according to Clause 1, wherein an exterior surface of the first cleat shell defines a volume within the range of 700 $mm^3$ and 3,500 $mm^3$.

Clause 11. The footwear structure according to Clause 1, wherein an exterior surface of the first cleat shell defines a volume within the range of 800 $mm^3$ and 2,700 $mm^3$.

Clause 12. The footwear structure according to Clause 1, wherein an interior surface of the first recess defines a volume of 1,500 $mm^3$ or less Clause 13. The footwear structure according to Clause 1, wherein an interior surface of the first recess defines a volume between 300 $mm^3$ to 1,500 $mm^3$.

Clause 14. The footwear structure according to Clause 1, wherein an interior surface of the first recess defines a volume between 400 $mm^3$ and 1,000 $mm^3$.

Clause 15. The footwear structure according to Clause 1, wherein an interior surface of the first recess defines a volume between 450 $mm^3$ and 900 $mm^3$.

Clause 16. The footwear structure according to Clause 1, wherein a volume ratio of an interior surface of the first recess to an exterior surface of the first cleat shell is within the range of 0.3 to 0.7.

Clause 17. The footwear structure according to Clause 16, wherein the volume ratio is within the range of 0.35 to 0.65.

Clause 18. The footwear structure according to Clause 17, wherein the volume ratio is within the range of 0.4 to 0.6.

Clause 19. The footwear structure according to Clause 1, wherein the first cleat insert and the first recess are located in a forefoot region of the footwear structure and the second cleat insert and the second recess are located in a heel region of the footwear structure.

Clause 20. The footwear structure according to Clause 1, wherein the first cleat insert and the first recess are located in a forefoot region of the footwear structure and the second cleat insert and the second recess are located in the forefoot region of the footwear structure.

Clause 21. The footwear structure according to Clause 1, wherein the first cleat insert and the first recess are located in a heel region of the footwear structure and the second cleat insert and the second recess are located in the heel region of the footwear structure.

Clause 22. The footwear structure according to Clause 1, wherein the first cleat insert and the first recess are located forward of the second cleat insert and the second recess in the footwear structure.

Clause 23. The footwear structure according to Clause 1, wherein the first cleat insert and the first recess are located on a lateral side of the footwear structure and the second cleat insert and the second recess are located on a medial side of the footwear structure.

Clause 24. The footwear structure according to Clause 1, wherein each of the first cleat insert, the first recess, the second cleat insert, and the second recess are located on one of a lateral side or a medial side of the footwear structure.

Clause 25. The footwear structure according to Clause 1, wherein the outsole portion includes a third cleat shell and wherein the footbed portion includes a third recess extending into an interior of the third cleat shell and defining a third undercut within the interior of the third cleat shell, wherein the bottom surface of the inner upper component includes a third opening at least partially aligned with the third recess, and further wherein the second surface of the foot support component includes a third cleat insert extending into the third recess, wherein the third cleat insert includes a third enlarged free end positioned to engage the third undercut and secure the third cleat insert within the third recess, wherein the third cleat insert extends through the third opening.

Clause 26. The footwear structure according to Clause 25, wherein the outsole portion includes a fourth cleat shell and wherein the footbed portion includes a fourth recess extending into an interior of the fourth cleat shell and defining a fourth undercut within the interior of the fourth cleat shell, wherein the bottom surface of the inner upper component includes a fourth opening at least partially aligned with the fourth recess, and further wherein the second surface of the foot support component includes a fourth cleat insert extending into the fourth recess, wherein the fourth cleat insert includes a fourth enlarged free end positioned to engage the fourth undercut and secure the fourth cleat insert within the fourth recess, wherein the fourth cleat insert extends through the fourth opening.

Clause 27. The footwear structure according to Clause 26, wherein the outsole portion includes a fifth cleat shell and wherein the footbed portion includes a fifth recess extending into an interior of the fifth cleat shell and defining a fifth undercut within the interior of the fifth cleat shell, wherein the bottom surface of the inner upper component includes a fifth opening at least partially aligned with the fifth recess, and further wherein the second surface of the foot support component includes a fifth cleat insert extending into the fifth recess, wherein the fifth cleat insert includes a fifth enlarged free end positioned to engage the fifth undercut and secure the fifth cleat insert within the fifth recess, wherein the fifth cleat insert extends through the fifth opening.

Clause 28. The footwear structure according to Clause 27, wherein the outsole portion includes a sixth cleat shell and wherein the footbed portion includes a sixth recess extending into an interior of the sixth cleat shell and defining a sixth undercut within the interior of the sixth cleat shell, wherein the bottom surface of the inner upper component includes a sixth opening at least partially aligned with the sixth recess, and further wherein the second surface of the foot support component includes a sixth cleat insert extending into the sixth recess, wherein the sixth cleat insert includes a sixth enlarged free end positioned to engage the sixth undercut and secure the sixth cleat insert within the sixth recess, wherein the sixth cleat insert extends through the sixth opening.

Clause 29. The footwear structure according to Clause 28, wherein: (a) the first cleat insert and the first recess are located at a lateral forefoot region of the footwear structure, (b) the second cleat insert and the second recess are located at a medial forefoot region of the footwear structure, (c) the third cleat insert and the third recess are located at the lateral forefoot region and/or a lateral midfoot region of the footwear structure rearward of the first cleat insert and the first recess, (d) the fourth cleat insert and the fourth recess are located at the medial forefoot region and/or a medial midfoot region of the footwear structure rearward of the second cleat insert and the second recess, (e) the fifth cleat insert and the fifth recess are located at a lateral heel region of the footwear structure, and (f) the sixth cleat insert and the sixth recess are located at a medial heel region of the footwear structure.

Clause 30. A footwear structure comprising:

an outer cage component formed as a unitary, one-piece construction that includes: (i) an outsole portion including a first cleat shell and a second cleat shell separate from the first cleat shell, and (ii) an upper portion, wherein the outer cage component defines an interior chamber, wherein the interior chamber includes a footbed portion formed by an interior surface of the outsole portion, the footbed portion including a first recess extending into an interior of the first cleat shell and defining a first undercut within the interior of the first cleat shell and a second recess extending into an interior of the second cleat shell and defining a second undercut within the interior of the second cleat shell;

an inner upper component formed as a unitary, one-piece construction that defines a foot-receiving chamber including a bottom surface, a heel-containing region, a midfoot-containing region, and a forefoot-containing region, wherein the inner upper component is formed of a fabric material, and wherein the bottom surface includes a first opening at least partially aligned with the first recess and a second opening separated from the first opening and at least partially aligned with the second recess; and a foot support component formed as a unitary, one-piece construction that includes: (i) a top surface for supporting an entire plantar surface of a wearer's foot and (ii) a bottom surface opposite the top surface, wherein the bottom surface includes a first cleat insert extending into the first recess and a second cleat insert extending into the second recess, wherein the first cleat insert includes a first enlarged free end positioned to engage the first undercut and secure the first cleat insert within the first recess, wherein the second cleat insert includes a second enlarged free end positioned to engage the second undercut and secure the second cleat insert within the second recess, and wherein the foot support component is received within the foot-receiving chamber of the inner upper component, wherein the first cleat insert extends through the first opening, and wherein the second cleat insert extends through the second opening.

Clause 31. The footwear structure according to Clause 30, wherein the foot support component includes an integrally formed heel counter.

Clause 32. The footwear structure according to Clause 30, wherein the outer cage component includes lace-engaging openings and the overall footwear structure further including a lace extending thru the lace-engaging openings.

Clause 33. The footwear structure according to Clause 30, wherein each of the first cleat insert and the second cleat insert includes one or more slits.

Clause 34. The footwear structure according to Clause 30, wherein each of the first enlarged free end and the second enlarged free end includes four enlarged cleat components.

Clause 35. The footwear structure according to Clause 30, wherein each of the first enlarged free end and the second enlarged free end includes three enlarged cleat components.

Clause 36. The footwear structure according to Clause 30, wherein the cleat inserts engaging their corresponding cleat shells form the only means of fastening the outer cage component, the inner upper component, and the foot support component together.

Clause 37. The footwear structure according to Clause 30, wherein an exterior surface of the first cleat shell defines a volume of 4,000 $mm^3$ or less.

Clause 38. The footwear structure according to Clause 30, wherein an exterior surface of the first cleat shell defines a volume within the range of 500 $mm^3$ to 4,000 $mm^3$.

Clause 39. The footwear structure according to Clause 30, wherein an exterior surface of the first cleat shell defines a volume within the range of 700 $mm^3$ and 3,500 $mm^3$.

Clause 40. The footwear structure according to Clause 30, wherein the exterior surface of the first cleat shell defines a volume within the range of 800 $mm^3$ and 2,700 $mm^3$.

Clause 41. The footwear structure according to Clause 30, wherein an interior surface of the first recess defines a volume of 1,500 $mm^3$ or less.

Clause 42. The footwear structure according to Clause 30, wherein an interior surface of the first recess defines a volume between 300 $mm^3$ to 1,500 $mm^3$.

Clause 43. The footwear structure according to Clause 30, wherein an interior surface of the first recess defines a volume between 400 $mm^3$ and 1,000 $mm^3$.

Clause 44. The footwear structure according to Clause 30, wherein an interior surface of the first recess defines a volume between 450 $mm^3$ and 900 $mm^3$.

Clause 45. The footwear structure according to Clause 30, wherein a volume ratio of an interior surface of the first recess to an exterior surface of the first cleat shell is within the range of 0.3 to 0.7.

Clause 46. The footwear structure according to Clause 45, wherein the volume ratio is within the range of 0.35 to 0.65.

Clause 47. The footwear structure according to Clause 46, wherein the volume ratio is within the range of 0.4 to 0.6.

Clause 48. The footwear structure according to Clause 30, wherein the first cleat insert and the first recess are located in a forefoot region of the footwear structure and the second cleat insert and the second recess are located in a heel region of the footwear structure.

Clause 49. The footwear structure according to Clause 30, wherein the first cleat insert and the first recess are located in a forefoot region of the footwear structure and the second cleat insert and the second recess are located in the forefoot region of the footwear structure.

Clause 50. The footwear structure according to Clause 30, wherein the first cleat insert and the first recess are located in a heel region of the footwear structure and the second cleat insert and the second recess are located in the heel region of the footwear structure.

Clause 52. The footwear structure according to Clause 30, wherein the first cleat insert and the first recess are located forward of the second cleat insert and the second recess in the footwear structure.

Clause 53. The footwear structure according to Clause 30, wherein the first cleat insert and the first recess are located on a lateral side of the footwear structure and the second cleat insert and the second recess are located on a medial side of the footwear structure.

Clause 54. The footwear structure according to Clause 30, wherein each of the first cleat insert, the first recess, the second cleat insert, and the second recess are located on one of a lateral side or a medial side of the footwear structure.

Clause 55. The footwear structure according to Clause 30, wherein the outsole portion includes a third cleat shell and wherein the footbed portion includes a third recess extending into an interior of the third cleat shell and defining a third undercut within the interior of the third cleat shell, wherein the bottom surface of the inner upper component includes a third opening at least partially aligned with the third recess, and further wherein the second surface of the foot support component includes a third cleat insert extending into the third recess, wherein the third cleat insert includes a third enlarged free end positioned to engage the third undercut and secure the third cleat insert within the third recess, wherein the third cleat insert extends through the third opening.

Clause 56. The footwear structure according to Clause 55, wherein the outsole portion includes a fourth cleat shell and wherein the footbed portion includes a fourth recess extending into an interior of the fourth cleat shell and defining a fourth undercut within the interior of the fourth cleat shell, wherein the bottom surface of the inner upper component includes a fourth opening at least partially aligned with the fourth recess, and further wherein the second surface of the foot support component includes a fourth cleat insert extending into the fourth recess, wherein the fourth cleat insert includes a fourth enlarged free end positioned to engage the fourth undercut and secure the fourth cleat insert within the fourth recess, wherein the fourth cleat insert extends through the fourth opening.

Clause 57. The footwear structure according to Clause 56, wherein the outsole portion includes a fifth cleat shell and wherein the footbed portion includes a fifth recess extending into an interior of the fifth cleat shell and defining a fifth undercut within the interior of the fifth cleat shell, wherein the bottom surface of the inner upper component includes a fifth opening at least partially aligned with the fifth recess, and further wherein the second surface of the foot support component includes a fifth cleat insert extending into the fifth recess, wherein the fifth cleat insert includes a fifth enlarged free end positioned to engage the fifth undercut and secure the fifth cleat insert within the fifth recess, wherein the fifth cleat insert extends through the fifth opening.

Clause 58. The footwear structure according to Clause 57, wherein the outsole portion includes a sixth cleat shell and wherein the footbed portion includes a sixth recess extending into an interior of the sixth cleat shell and defining a sixth undercut within the interior of the sixth cleat shell, wherein the bottom surface of the inner upper component includes a sixth opening at least partially aligned with the sixth recess, and further wherein the second surface of the foot support component includes a sixth cleat insert extending into the sixth recess, wherein the sixth cleat insert includes a sixth enlarged free end positioned to engage the sixth undercut and secure the sixth cleat insert within the sixth recess, wherein the sixth cleat insert extends through the sixth opening.

Clause 59. The footwear structure according to Clause 58, wherein: (a) the first cleat insert and the first recess are located at a lateral forefoot region of the footwear structure, (b) the second cleat insert and the second recess are located at a medial forefoot region of the footwear structure, (c) the third cleat insert and the third recess are located at the lateral forefoot region and/or a lateral midfoot region of the footwear structure rearward of the first cleat insert and the first recess, (d) the fourth cleat insert and the fourth recess are located at the medial forefoot region and/or a medial midfoot region of the footwear structure rearward of the second cleat insert and the second recess, (e) the fifth cleat insert and the fifth recess are located at a lateral heel region of the footwear structure, and (f) the sixth cleat insert and the sixth recess are located at a medial heel region of the footwear structure.

Clause 60. A footwear structure comprising:

an outer cage component formed as a unitary, one-piece construction that includes: (i) an outsole portion including a plurality of cleat shells, and (ii) an upper portion, wherein the outer cage component defines an interior chamber, wherein the interior chamber includes a footbed portion formed by an interior surface of the outsole portion, the footbed portion including a plurality of recesses, wherein each of the plurality of recesses extends into an interior of each of the plurality of cleat shells and defines an undercut within the interior of each of the plurality of cleat shells;

an inner upper component formed as a unitary, one-piece construction that defines a foot-receiving chamber including a bottom surface, a heel-containing region, a midfoot-containing region, and a forefoot-containing region, wherein the inner upper component is formed of a fabric material, and wherein the bottom surface includes a plurality of openings, wherein each of the plurality of openings is at least partially aligned with a respective one of the plurality of recesses; and a foot support component formed as a unitary, one-piece construction that includes: (i) a top surface for supporting an entire plantar surface of a wearer's foot and (ii)

a bottom surface opposite the top surface, wherein the bottom surface includes a plurality of cleat inserts, wherein each of the plurality of cleat inserts extends into a respective one of the plurality of recesses, wherein each of the plurality of cleat inserts includes an enlarged free end positioned to engage a respective undercut and secure each of the plurality of cleat inserts within a respective one of the plurality of recesses, and wherein the foot support component is received within the foot-receiving chamber of the inner upper component, wherein each of the plurality of cleat inserts extends through a respective one of the plurality of openings.

Clause 61. The footwear structure according to Clause 60, wherein the foot support component includes an integrally formed heel counter.

Clause 62. The footwear structure according to Clause 60, wherein the outer cage component includes lace-engaging openings and the overall footwear structure further including a lace extending thru the lace-engaging openings.

Clause 63. The footwear structure according to Clause 60, wherein each of the plurality of cleat inserts include one or more slits.

Clause 64. The footwear structure according to Clause 60, wherein each of the plurality of enlarged free ends include four enlarged cleat components.

Clause 65. The footwear structure according to Clause 60, wherein each of the plurality of enlarged free ends include three enlarged cleat components.

Clause 66. The footwear structure according to Clause 60, wherein the cleat inserts engaging their corresponding cleat shells form the only means of fastening the outer cage component, the inner upper component, and the foot support component together.

Clause 67. The footwear structure according to Clause 60, wherein an exterior surface of each of the plurality of cleat shells defines a volume of 4,000 $mm^3$ or less.

Clause 68. The footwear structure according to Clause 60, wherein an exterior surface of each of the plurality of cleat shells defines a volume within the range of 500 $mm^3$ to 4,000 $mm^3$.

Clause 69. The footwear structure according to Clause 60, wherein an exterior surface of each of the plurality of cleat shells defines a volume within the range of 700 $mm^3$ and 3,500 $mm^3$.

Clause 70. The footwear structure according to Clause 60, wherein an exterior surface of each of the plurality of cleat shells defines a volume within the range of 800 $mm^3$ and 2,700 $mm^3$.

Clause 71. The footwear structure according to Clause 60, wherein an interior surface of each of the plurality of recesses defines a volume of 1,500 $mm^3$ or less.

Clause 72. The footwear structure according to Clause 60, wherein an interior surface of each of the plurality of recesses defines a volume between 300 $mm^3$ to 1,500 $mm^3$.

Clause 73. The footwear structure according to Clause 60, wherein an interior surface of each of the plurality of recesses defines a volume between 400 $mm^3$ and 1,000 $mm^3$.

Clause 74. The footwear structure according to Clause 60, wherein an interior surface of each of the plurality of recesses defines a volume between 450 $mm^3$ and 900 $mm^3$.

Clause 75. The footwear structure according to Clause 60, wherein a volume ratio of an interior surface each of the plurality of recesses to an exterior surface of each of the plurality of cleat shells is within the range of 0.3 to 0.7.

Clause 76. The footwear structure according to Clause 75, wherein the volume ratio is within the range of 0.35 to 0.65.

Clause 77. The footwear structure according to Clause 75, wherein the volume ratio is within the range of 0.4 to 0.6.

Clause 78. The footwear structure according to Clause 60, wherein one or more of the plurality of cleat inserts and the recesses are located in a forefoot region of the footwear structure and one or more of the plurality of cleat inserts and the recesses are located in a heel region of the footwear structure.

Clause 79. The footwear structure according to Clause 60, wherein the plurality of cleat inserts and recesses are located in a forefoot region of the footwear structure.

Clause 80. The footwear structure according to Clause 60, wherein the plurality of cleat inserts and recesses are located in a heel region of the footwear structure.

Clause 81. The footwear structure according to Clause 60, wherein one or more of the plurality of cleat inserts and the recesses are located on a lateral side of the footwear structure and one or more of the plurality of cleat inserts and the recesses are located on a medial side of the footwear structure.

Clause 82. The footwear structure according to Clause 60, wherein the plurality of cleat inserts and recesses are located on one of a lateral side or a medial side of the footwear structure.

Clause 83. The footwear structure according to Clause 60, wherein the plurality of cleat inserts is defined by six cleat inserts.

Clause 84. The footwear structure according to Clause 60, wherein the plurality of cleat inserts is defined by eight cleat inserts.

Clause 85. The footwear structure according to Clause 60, wherein the plurality of cleat inserts is defined by ten cleat inserts.

Clause 86. The footwear structure according to Clause 60, wherein the plurality of cleat inserts is defined by twelve cleat inserts.

Clause 87. A foot support component configured to releasably engage with an outer cage component and an inner upper component to form an article of footwear, the outer cage component including an outsole portion and an upper portion, with the inner upper component fitting inside the outer cage component, the foot support component comprising:

a top surface for supporting an entire plantar surface of a wearer's foot;

a bottom surface opposite the top surface, wherein the bottom surface includes a plurality of cleat inserts, wherein one or more of the plurality of cleat inserts is configured to extend into a corresponding recess of the outer cage component; and an integrally formed heel counter structure extending from the top surface at a heel region of the foot support component, the heel counter structure including a sidewall having a lateral sidewall, a medial sidewall, and a rear sidewall extending between the lateral sidewall and the medial sidewall, the heel counter structure further including a void structure formed in the sidewall, the void structure defined by one or more of openings, voids, or grooves, wherein the foot support component is formed as a unitary, one-piece construction.

Clause 88. The foot support component according to Clause 87, wherein the void structure includes a central hub with a plurality of spokes that radiate from the central hub.

Clause 89. The foot support component according to Clause 88, wherein one or more of the plurality of spokes includes a circular hole opposite the central hub.

Clause 90. The foot support component according to Clause 88, wherein the plurality of spokes includes four spokes.

Clause 91. The foot support component according to Clause 88, wherein the plurality of spokes includes six spokes.

Clause 92. The foot support component according to Clause 88, wherein the plurality of spokes includes eight spokes.

Clause 93. The foot support component according to Clause 88, wherein the plurality of spokes includes ten spokes.

Clause 94. The foot support component according to Clause 88, wherein the plurality of spokes are spaced equidistant around the central hub.

Clause 95. The foot support component according to Clause 88, wherein the void structure is located only on the rear sidewall.

Clause 96. The foot support component according to Clause 88, wherein the central hub of the void structure is located along the rear sidewall and one or more of the plurality of spokes extend into portions of the medial sidewall and the lateral sidewall.

Clause 97. The foot support component according to Clause 87, wherein the void structure includes an opening and a slit extending upward from the opening towards an upper portion of the sidewall.

Clause 98. The foot support component according to Clause 97, wherein the opening is a circular opening.

Clause 99. The foot support component according to Clause 87, wherein the opening and the slit are located on the rear sidewall.

Clause 99. The foot support component according to Clause 87, wherein the void structure includes a groove that extends from a portion of the medial sidewall through the rear sidewall to a portion of the lateral sidewall.

Clause 100. The foot support component according to Clause 99, wherein the groove extends in a vertical continuous V-shape from a bottom portion of the heel counter structure to an upper portion of the heel counter structure.

Clause 101. The foot support component according to Clause 87, wherein the void structure defines a surface area of 1,500 $mm^2$ or less.

Clause 102. The foot support component according to Clause 101, wherein the surface area of the void structure is within a range of 500 $mm^2$ to 1,500 $mm^2$.

Clause 103. The foot support component according to Clause 102, wherein the surface area of the void structure is within a range of 750 $mm^2$ to 1,250 $mm^2$.

Clause 104. The foot support component according to Clause 103, wherein the surface area of the void structure is within a range of 900 $mm^2$ to 1,000 $mm^2$.

Clause 105. The foot support component according to Clause 87, wherein one or more of the plurality of cleat inserts includes an enlarged free end configured to engage an undercut in the recess of the outer cage component and secure the plurality of cleat inserts within its respective recess.

Clause 106. The foot support component according to Clause 105, wherein the cleat inserts include one or more slits.

Clause 107. The foot support component according to Clause 105, wherein the enlarged free ends include four enlarged cleat components.

Clause 108. The foot support component according to Clause 105, wherein the enlarged free ends include three enlarged cleat components.

Clause 109. The foot support component according to Clause 87, wherein one or more of the plurality of cleat inserts are located in a forefoot region of the bottom surface and one or more of the plurality of cleat inserts are located in a heel region of the bottom surface.

Clause 110. The foot support component according to Clause 87, wherein the plurality of cleat inserts are located in a forefoot region of the bottom surface.

Clause 111. The foot support component according to Clause 87, wherein the plurality of cleat inserts are located in a heel region of the bottom surface.

Clause 112. The foot support component according to Clause 87, wherein one or more of the plurality of cleat inserts are located on a lateral side of the bottom surface and one or more of the plurality of cleat inserts are located on a medial side of the bottom surface.

Clause 113. The foot support component according to Clause 87, wherein the plurality of cleat inserts are located on one of a lateral side or a medial side of the bottom surface.

Clause 114. The foot support component according to Clause 87, wherein the plurality of cleat inserts is defined by six cleat inserts.

Clause 115. The foot support component according to Clause 87, wherein the plurality of cleat inserts is defined by eight cleat inserts.

Clause 116. The foot support component according to Clause 87, wherein the plurality of cleat inserts is defined by ten cleat inserts.

Clause 117. The foot support component according to Clause 87, wherein the plurality of cleat inserts is defined by twelve cleat inserts.

Clause 118. A footwear structure comprising:

an outer cage component that includes: (i) an outsole portion including a plurality of cleat shells, and (ii) an upper portion, the outer cage component defining an interior chamber;

an inner upper component that defines a foot-receiving chamber including a bottom surface, a heel-containing region, a midfoot-containing region, and a forefoot-containing region; and a foot support component releasably engaged with the outer cage component and the inner upper component to form the footwear structure, with the inner upper component fitting inside the outer cage component, the foot support component comprising:

a top surface for supporting an entire plantar surface of a wearer's foot;

a bottom surface opposite the top surface, wherein the bottom surface includes a plurality of cleat inserts, wherein one or more of the plurality of cleat inserts is configured to extend into a corresponding one of a plurality of recesses defined in the outsole portion of the outer cage component; and an integrally formed heel counter structure extending from the top surface at a heel region of the foot support component, the heel counter structure including a sidewall defined by a lateral sidewall, a medial sidewall, and a rear sidewall formed between the lateral sidewall and the medial sidewall, the heel counter structure further including a void structure formed in the sidewall, the void structure defined by one or more of openings, voids, or grooves, wherein the foot support component is formed as a unitary, one-piece construction.

Clause 119. The footwear structure according to Clause 118, wherein the interior chamber includes a footbed portion formed by an interior surface of the outsole portion, the footbed portion including the plurality of recesses, wherein one or more of the plurality of recesses extends into an interior of a respective one of the plurality of cleat shells and defines an undercut within the interior of one or more of the plurality of cleat shells.

Clause 120. The footwear structure according to Clause 119, wherein the inner upper component is formed of a fabric material, and wherein the bottom surface includes a plurality of openings, wherein one or more of the plurality of openings is at least partially aligned with a respective one of the plurality of recesses.

Clause 121. The footwear structure according to Clause 119, wherein one or more of the plurality of cleat inserts includes an enlarged free end configured to engage the undercut in a respective one of the recesses of the outer cage component and secure one or more of the plurality of cleat inserts within its respective recess.

Clause 122. The footwear structure according to Clause 121, wherein the cleat inserts include one or more slits.

Clause 123. The footwear structure according to Clause 121, wherein one or more of the enlarged free ends include four enlarged cleat components.

Clause 124. The footwear structure according to Clause 121, wherein one or more of the enlarged free ends include three enlarged cleat components.

Clause 125. The footwear structure according to Clause 118, wherein the void structure includes a central hub with a plurality of spokes that radiate from the central hub.

Clause 126. The footwear structure according to Clause 125, wherein one or more of the plurality of spokes includes a circular hole opposite the central hub.

Clause 127. The footwear structure according to Clause 125, wherein the plurality of spokes includes four spokes.

Clause 128. The footwear structure according to Clause 125, wherein the plurality of spokes includes six spokes.

Clause 129. The footwear structure according to Clause 125, wherein the plurality of spokes includes eight spokes.

Clause 130. The footwear structure according to Clause 125, wherein the plurality of spokes includes ten spokes.

Clause 131. The footwear structure according to Clause 125, wherein the plurality of spokes are spaced equidistant when radiating from the central hub.

Clause 132. The footwear structure according to Clause 125, wherein the void structure is located only on the rear sidewall.

Clause 133. The footwear structure according to Clause 125, wherein the central hub of the void structure is located along the rear sidewall and one or more of the plurality of spokes extend into portions of the medial sidewall and the lateral sidewall.

Clause 134. The footwear structure according to Clause 118, wherein the void structure includes an opening and a slit extending upward from the opening towards an upper portion of the sidewall.

Clause 135. The footwear structure according to Clause 134, wherein the opening is a circular opening.

Clause 136. The footwear structure according to Clause 134, wherein the opening and the slit are located on the rear sidewall.

Clause 137. The footwear structure according to Clause 118, wherein the void structure includes a groove that extends from a portion of the medial sidewall through the rear sidewall to a portion of the lateral sidewall.

Clause 138. The footwear structure according to Clause 137, wherein the groove extends in a vertical continuous V-shape from a bottom portion of the heel counter structure to an upper portion of the heel counter structure.

Clause 139. The footwear structure according to Clause 118, wherein the void structure defines a surface area of 1,500 $mm^2$ or less.

Clause 140. The footwear structure according to Clause 139, wherein the surface area of the void structure is within a range of 500 $mm^2$ to 1,500 $mm^2$.

Clause 141. The footwear structure according to Clause 140, wherein the surface area of the void structure is within a range of 750 $mm^2$ to 1,250 $mm^2$.

Clause 142. The footwear structure according to Clause 141, wherein the surface area of the void structure is within a range of 900 $mm^2$ to 1,000 $mm^2$.

Clause 143. The footwear structure according to Clause 118, wherein one or more of the plurality of cleat inserts are located in a forefoot region of the bottom surface and one or more of the plurality of cleat inserts are located in a heel region of the bottom surface.

Clause 144. The footwear structure according to Clause 118, wherein the plurality of cleat inserts are located in a forefoot region of the bottom surface.

Clause 145. The footwear structure according to Clause 118, wherein the plurality of cleat inserts are located in a heel region of the bottom surface.

Clause 146. The footwear structure according to Clause 118, wherein one or more of the plurality of cleat inserts are located on a lateral side of the bottom surface and one or more of the plurality of cleat inserts are located on a medial side of the bottom surface.

Clause 147. The footwear structure according to Clause 118, wherein the plurality of cleat inserts are located on one of a lateral side or a medial side of the bottom surface.

Clause 148. The footwear structure according to Clause 118, wherein the plurality of cleat inserts is defined by six cleat inserts.

Clause 149. The footwear structure according to Clause 118, wherein the plurality of cleat inserts is defined by eight cleat inserts.

Clause 150. The footwear structure according to Clause 118, wherein the plurality of cleat inserts is defined by ten cleat inserts.

Clause 151. The footwear structure according to Clause 118, wherein the plurality of cleat inserts is defined by twelve cleat inserts.

What is claimed is:

1. A footwear structure comprising:

an outer cage component that includes: (i) an outsole portion, and (ii) an upper portion, the outer cage component defining an interior chamber;

an inner upper component that defines a foot-receiving chamber including a bottom surface, a heel-containing region, a midfoot-containing region, and a forefoot-containing region; and a foot support component releasably engaged with the outer cage component and the inner upper component to form the footwear structure, with the inner upper component fitting inside the outer cage component, the foot support component comprising:

a top surface for supporting an entire plantar surface of a wearer's foot;

a bottom surface opposite the top surface; and an integrally formed heel counter structure extending from the top surface at a heel region of the foot support component, the heel counter structure including a sidewall defined by a lateral sidewall, a medial sidewall, and a rear sidewall formed between the lateral sidewall and the medial sidewall, the heel counter structure further including a void structure formed in the sidewall, the void structure defined by one or more of openings, voids, or grooves, wherein the void structure includes a central hub with a plurality of spokes that radiate from the central hub, wherein the foot support component is formed as a unitary, one-piece construction.

2. The footwear structure according to claim 1, wherein one or more of the plurality of spokes includes a circular hole opposite the central hub.

3. The footwear structure according to claim 1, wherein the plurality of spokes are spaced equidistant when radiating from the central hub.

4. The footwear structure according to claim 1, wherein the bottom surface of the foot support component includes a plurality of cleat inserts, wherein one or more of the plurality of cleat inserts is configured to extend into a corresponding one of a plurality of recesses defined in the outsole portion of the outer cage component.

5. The footwear structure according to claim 4, wherein the outsole portion includes a plurality of cleat shells.

6. The footwear structure according to claim 5, wherein the interior chamber includes a footbed portion formed by an interior surface of the outsole portion, the footbed portion including the plurality of recesses, wherein one or more of the plurality of recesses extends into an interior of a respective one of the plurality of cleat shells and defines an undercut within an interior of one or more of the plurality of cleat shells.

7. A foot support component configured to releasably engage with an outer cage component and an inner upper component to form an article of footwear, the outer cage component including an outsole portion and an upper portion, with the inner upper component fitting inside the outer cage component, the foot support component comprising:

a top surface for supporting an entire plantar surface of a wearer's foot;

a bottom surface opposite the top surface; and an integrally formed heel counter structure extending from the top surface at a heel region of the foot support component, the heel counter structure including a sidewall having a lateral sidewall, a medial sidewall, and a rear sidewall extending between the lateral sidewall and the medial sidewall, the heel counter structure further including a void structure formed in the sidewall, the void structure defined by one or more of openings, voids, or grooves, wherein the void structure includes a central hub with a plurality of spokes that radiate from the central hub, wherein the plurality of spokes are spaced equidistant around the central hub, wherein the foot support component is formed as a unitary, one-piece construction.

8. The foot support component according to claim 7, wherein the void structure is located only on the rear sidewall.

9. The foot support component according to claim 7, wherein the central hub of the void structure is located along the rear sidewall and one or more of the plurality of spokes extend into portions of the medial sidewall and the lateral sidewall.

10. A footwear structure comprising:

an outer cage component that includes: (i) an outsole portion including a plurality of cleat shells, and (ii) an upper portion, the outer cage component defining an interior chamber;

an inner upper component that defines a foot-receiving chamber including a bottom surface, a heel-containing region, a midfoot-containing region, and a forefoot-containing region; and a foot support component releasably engaged with the outer cage component and the inner upper component to form the footwear structure, with the inner upper component fitting inside the outer cage component, the foot support component comprising:

a top surface for supporting an entire plantar surface of a wearer's foot;

a bottom surface opposite the top surface, wherein the bottom surface includes a plurality of cleat inserts, wherein one or more of the plurality of cleat inserts is configured to extend into a corresponding one of a plurality of recesses defined in the outsole portion of the outer cage component; and an integrally formed heel counter structure extending from the top surface at a heel region of the foot support component, the heel counter structure including a sidewall defined by a lateral sidewall, a medial sidewall, and a rear sidewall formed between the lateral sidewall and the medial sidewall, the heel counter structure further including a void structure formed in the sidewall, the void structure defined by one or more of openings, voids, or grooves, wherein the void structure includes a central hub with a plurality of spokes that radiate from the central hub, wherein the foot support component is formed as a unitary, one-piece construction.

11. The footwear structure according to claim 10, wherein the interior chamber includes a footbed portion formed by an interior surface of the outsole portion, the footbed portion including the plurality of recesses, wherein one or more of the plurality of recesses extends into an interior of a respective one of the plurality of cleat shells and defines an undercut within an interior of one or more of the plurality of cleat shells.

* * * * *